US010086579B2

(12) United States Patent
Armstrong et al.

(10) Patent No.: US 10,086,579 B2
(45) **Date of Patent: *Oct. 2, 2018**

(54) REINFORCED POLYGONAL CONTAINERS AND BLANKS FOR MAKING THE SAME

(71) Applicant: WestRock Shared Services, LLC, Norcross, VA (US)

(72) Inventors: Maureen Ann Armstrong, Fresno, CA (US); Kenneth Charles Smith, Hiram, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/677,096

(22) Filed: Aug. 15, 2017

(65) Prior Publication Data

US 2018/0022052 A1 Jan. 25, 2018

Related U.S. Application Data

(60) Division of application No. 14/274,322, filed on May 9, 2014, now Pat. No. 9,764,524, and a (Continued)

(51) Int. Cl.
*B31B 1/44* (2006.01)
*B31B 3/26* (2006.01)
(Continued)

(52) U.S. Cl.
CPC ..... *B31B 50/26* (2017.08); *B31B 50/28* (2017.08); *B65D 5/003* (2013.01); *B65D 5/0015* (2013.01);
(Continued)

(58) Field of Classification Search
CPC .... B65D 5/443; B65D 5/6632; B65D 5/0015; B65D 5/003; B65D 5/0035; B65D 5/22;
(Continued)

(56) References Cited

U.S. PATENT DOCUMENTS 3,883,067 A * 5/1975 McGlynn ..... B65D 5/0045 229/177
4,676,429 A * 6/1987 Crowe ..... B65D 5/2033 229/109

(Continued)

*Primary Examiner* — Christopher Demeree
(74) *Attorney, Agent, or Firm* — WestRock IP Legal

(57) ABSTRACT

A blank of sheet material for forming a polygonal container is provided. The blank includes a bottom panel, two opposing side panels, two opposing end panels, and a reinforcing panel assembly extending from a first side edge of a first end panel of the two end panels. The reinforcing panel assembly includes a corner panel extending from the first side edge of the first end panel, a first reinforcing side panel extending from a side edge of the corner panel, a second reinforcing side panel extending from a side edge of the first reinforcing side panel, a reinforcing corner panel extending from a side edge of the second reinforcing side panel, and an inner end panel extending from a side edge of the reinforcing corner panel. The corner panel and the reinforcing corner panel are configured, upon articulation of the blank, to be positioned into face-to-face relationship to form a corner wall of the container extending from a side edge of an end wall of the container to an end edge of a side wall of the container.

3 Claims, 42 Drawing Sheets

Related U.S. Application Data continuation-in-part of application No. 14/062,711, filed on Oct. 24, 2013, now Pat. No. 9,764,526, which is a continuation of application No. 12/780,544, filed on May 14, 2010, now Pat. No. 8,579,778, said application No. 14/274,322 is a continuation-in-part of application No. 12/780,509, filed on May 14, 2010, now Pat. No. 8,827,142, which is a continuation-in-part of application No. 12/256,051, filed on Oct. 22, 2008, now Pat. No. 8,820,618.

(60) Provisional application No. 61/051,302, filed on May 7, 2008, provisional application No. 61/822,094, filed on May 10, 2013.

(51) Int. Cl.

| | |
|---|---|
| ***B31B 50/26*** | (2017.01) |
| ***B65D 5/66*** | (2006.01) |
| ***B65D 5/48*** | (2006.01) |
| ***B65D 5/468*** | (2006.01) |
| ***B65D 5/44*** | (2006.01) |
| ***B65D 5/42*** | (2006.01) |
| ***B65D 5/00*** | (2006.01) |
| ***B31B 50/28*** | (2017.01) |
| *B31B 50/52* | (2017.01) |
| *B31B 50/81* | (2017.01) |
| *B31B 50/44* | (2017.01) |
| *B31B 100/00* | (2017.01) |
| *B31B 120/00* | (2017.01) |
| *B31B 50/07* | (2017.01) |

(52) U.S. Cl.

CPC ..... *B65D 5/4295* (2013.01); *B65D 5/443* (2013.01); *B65D 5/4608* (2013.01); *B65D 5/48018* (2013.01); *B65D 5/6629* (2013.01); *B65D 5/6644* (2013.01); *B31B 50/07* (2017.08); *B31B 50/44* (2017.08); *B31B 50/52* (2017.08); *B31B 50/81* (2017.08); *B31B 2100/00* (2017.08); *B31B 2100/0024* (2017.08); *B31B 2120/502* (2017.08)

(58) Field of Classification Search

CPC .... B65D 5/6629; B65D 5/664; B65D 5/0045; B65D 5/002; B65D 5/2033; B65D 2571/00895; B65D 5/001; B31B 2203/105; B31B 2203/066

USPC ..... 229/109, 192, 918, 177, 179, 915, 919, 229/117.13, 117.15, 117.16, 122.32

See application file for complete search history.

(56) References Cited

U.S. PATENT DOCUMENTS

| | | | | |
|---|---|---|---|---|
| 5,535,941 | A * | 7/1996 | Garza | B65D 5/002 229/191 |
| 8,985,431 | B2 * | 3/2015 | Smith | B65D 5/42 229/109 |
| 2011/0281705 | A1 * | 11/2011 | Aganovic | B65D 5/003 493/89 |

* cited by examiner

REINFORCED POLYGONAL CONTAINERS AND BLANKS FOR MAKING THE SAME

CROSS REFERENCE TO RELATED APPLICATIONS

This patent application is a divisional of U.S. patent application Ser. No. 14/274,322, filed on May 9, 2014, which claims priority to U.S. Provisional Patent Application Ser. No. 61/822,094, filed on May 10, 2013, and which is a continuation-in-part of U.S. patent application Ser. No. 14/062,711, filed on Oct. 24, 2013, which is a continuation of U.S. patent application Ser. No. 12/780,544, filed on May 14, 2010, now U.S. Pat. No. 8,579,778, and is a continuation-in-part of U.S. patent application Ser. No. 12/780,509, filed on May 14, 2010, which is a continuation-in-part of U.S. patent application Ser. No. 12/256,051, filed on Oct. 22, 2008, which claims priority to U.S. Provisional Patent Application Ser. No. 61/051,302, filed on May 7, 2008, all of which are hereby incorporated by reference in their entirety.

BACKGROUND

The embodiments described herein relate generally to a blank and a reinforced polygonal container formed from the blank and more particularly, to a blank of sheet material for forming a reinforced polygonal container having end panels, side panels, and reinforcing panels, wherein the reinforcing panels are attached to an outer surface of the side panels so that each interior face of the container is substantially planar.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include reinforced corners or side walls for providing additional strength including stacking strength. In at least some known embodiments, additional panels may be placed in a face-to-face relationship with a corner panel or side panel. However, it is difficult to form a container from a single sheet of material that includes multiple reinforcing panels along the corner and side panels.

Additionally, in at least some known containers, reinforced corner or side panels are attached to an interior surface of the formed container. Containers having reinforced corner or side panels attached to an interior surface of the container are less than optimal for certain applications, such as storing and transporting fresh fruit or produce, because the interior reinforced panels create non-planar interior surfaces that can damage or "bruise" the contents within the container. Accordingly, a need exists for a reinforced container formed from a single blank that can be easily formed at high-speeds and that has a generally planar interior surface.

BRIEF DESCRIPTION

In one aspect, a blank of sheet material for forming a polygonal container is provided. The blank includes a bottom panel, two opposing side panels, two opposing end panels, and a reinforcing panel assembly extending from a first side edge of a first end panel of the two end panels. Each side panel extends from a side edge of the bottom panel, and each end panel extends from an end edge of the bottom panel. The reinforcing panel assembly includes a corner panel extending from the first side edge of the first end panel, a first reinforcing side panel extending from a side edge of the corner panel, a second reinforcing side panel extending from a side edge of the first reinforcing side panel, a reinforcing corner panel extending from a side edge of the second reinforcing side panel, and an inner end panel extending from a side edge of the reinforcing corner panel. The corner panel and the reinforcing corner panel are configured, upon articulation of the blank, to be positioned into face-to-face relationship to form a corner wall of the container extending from a side edge of an end wall of the container to an end edge of a side wall of the container.

In another aspect, a polygonal container formed from a blank of sheet material is provided. The container includes a bottom panel, two opposing side panels, two opposing end panels, and a reinforcing panel assembly extending from a first side edge of a first end panel of the two end panels. Each side panel emanates from a side edge of the bottom panel, and each end panel emanates from an end edge of the bottom panel. The reinforcing panel assembly includes a corner panel extending from the first side edge of the first end panel, a first outer reinforcing side panel extending from a side edge of the corner panel, a first inner reinforcing side panel at least partially overlying the first outer reinforcing side panel, and a reinforcing corner panel positioned in face-to-face relationship with the corner panel. The corner panel and the reinforcing corner panel form a corner wall extending between the first end panel and a first side panel of the two side panels.

In yet another aspect, a method for forming a polygonal container from a blank of sheet material is provided. The blank includes a bottom panel, two opposing side panels each extending from a side edge of the bottom panel, two opposing end panels each extending from an end edge of the bottom panel, and a reinforcing panel assembly extending from a first side edge of a first end panel of the two end panels. The reinforcing panel assembly includes a corner panel extending from the first side edge of the first end panel, a first reinforcing side panel extending from a side edge of the corner panel, a second reinforcing side panel extending from a side edge of the first reinforcing side panel, a reinforcing corner panel extending from a side edge of the second reinforcing side panel, and an inner end panel extending from a side edge of the reinforcing corner panel. The method includes rotating the second reinforcing side panel toward an interior surface of the first reinforcing side panel about a fold line connecting the second reinforcing side panel and the first reinforcing side panel, where the rotating aligns the first and second reinforcing side panels in a substantially face-to-face relationship, the corner panel and the reinforcing corner panel in a substantially face-to-face relationship, and the inner end panel and the first end panel in a substantially face-to-face relationship, rotating the first side panel inwardly into a substantially perpendicular relationship with the bottom panel, rotating the first end panel inwardly into a substantially perpendicular relationship with the bottom panel, the first end panel and inner end panel forming a first end wall of the polygonal container, rotating the corner panel and the reinforcing corner panel toward the interior surface of the first end panel, the corner panel and the reinforcing corner panel forming a first corner wall of the polygonal container, rotating the first and second reinforcing side panels toward the interior surface of the first end panel about a fold line connecting the second reinforcing side panel and the reinforcing corner panel and about a fold line connecting the first reinforcing side panel and the corner panel, and attaching the first side panel to one of the first and second reinforcing side panels to form a first side wall of the container.

DETAILED DESCRIPTION

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

The present disclosure provides a stackable, reinforced container formed from a single sheet of material, and a method for constructing the container. The container is sometimes referred to as a reinforced mitered tray or a reinforced eight-sided tray. This reinforced miter tray is configured to have a generally planar interior surface because the reinforcing panel assemblies are attached to the exterior surface of the container. Thus, the container provides a reinforced-structure without an uneven interior surface that may damage the product placed inside the container. The container may be constructed from a blank of sheet material using a machine. In one embodiment, the container is fabricated from a corrugated cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

Figure 1:
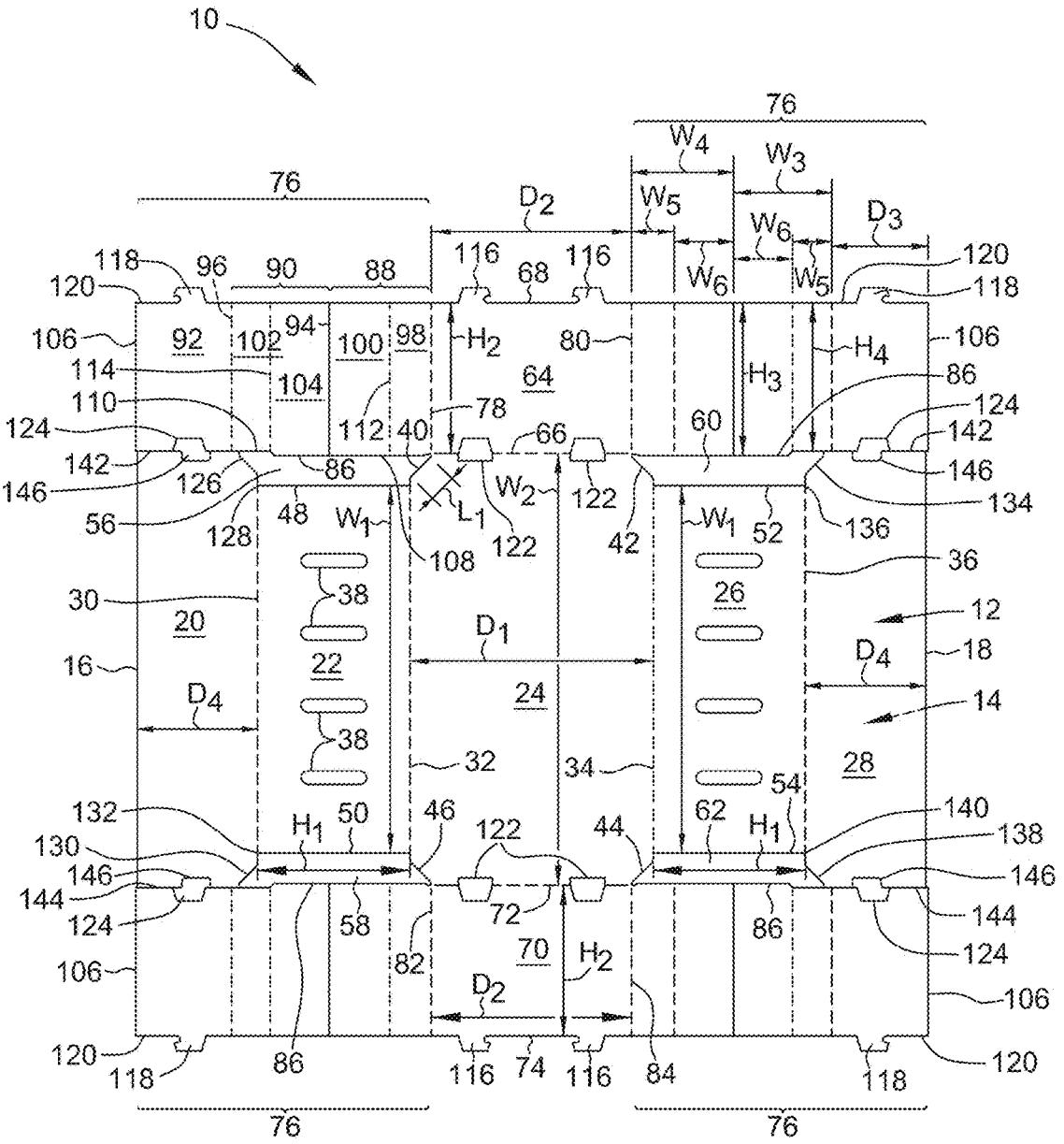
FIG. 1 is a top plan view of a blank of sheet material for constructing a container according to a first embodiment of the present disclosure.

Referring now to the drawings, and more specifically to FIG. 1, which is a top plan view of an example embodiment of a blank 10 of sheet material. A container 150 (shown in FIG. 2) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a first top panel 20, a front panel 22 (generally, a first side panel), a bottom panel 24, a rear panel 26 (generally, a second side panel), and a second top panel 28 coupled together along preformed, generally parallel, fold lines 30, 32, 34, and 36, respectively. More specifically, first top panel 20 extends between leading edge 16 and fold line 30, first side panel 22 extends from first top panel 20 along fold line 30 to fold line 32, bottom panel 24 extends from first side panel 22 along fold line 32, second side panel 26 extends from bottom panel 24 along fold line 34 to fold line 36, and second top panel 28 extends from second side panel 26 along fold line 36 to trailing edge 18. When a container 150 (shown in FIG. 2) is formed from blank 10, fold line 30 defines a front edge of top panel 20 and a top edge of first side panel 22, and fold line 36 defines a top edge of second side panel 26 and a rear edge of top panel 28.

Fold lines 30, 32, 34, and/or 36, as well as other fold lines and/or hinge lines described herein, may include any suitable line of weakening and/or line of separation known to those skilled in the art and guided by the teachings herein provided. As noted above, front and rear panels 22 and 26 may be considered side panels. When container 150 is formed from blank 10, fold line 32 defines a bottom edge of first side panel 22 and a front edge, or first side edge, of bottom panel 24, and fold line 34 defines a rear edge, or second side edge, of bottom panel 24 and a bottom edge of second side panel 26. As used throughout this description, front edges and rear edges are also considered to be side edges and outer edges of bottom panel 24. In the example embodiment, four oval shaped cutouts 38 are defined within first and second side panels 22 and 26. In an alternative embodiment, cutouts 38 may be of any shape and/or defined within any suitable panel, such as first end panel 64 and/or second end panel 70, described in more detail below. Alternatively, blank 10 may include more or less than four cutouts 38, or blank 10 may not include any cutouts 38.

First side panel 22 and second side panel 26 are substantially congruent and have a rectangular shape. Bottom panel 24 has an octagonal shape. More specifically, first side panel 22 and second side panel 26 have a width $W_1$. Bottom panel 24 has a width $W_2$, which is longer that width $W_1$. Alternatively, width $W_1$ is substantially equal to or longer than width $W_2$. Further, in the example embodiment, first and second side panels 22 and 26 have a first height $H_1$, and bottom panel 24 has a first depth $D_1$ that is larger than first height $H_1$. In an alternative embodiment, height $H_1$ is substantially equal to or larger than depth $D_1$. In the example embodiment, first side panel 22, second side panel 26, and/or bottom panel 24 are equally dimensioned, however, first side panel 22, second side panel 26, and/or bottom panel 24 may be other than equally dimensioned.

In the example embodiment, bottom panel 24 may be considered to be substantially rectangular in shape with four cut-off corners or angled edges 40, 42, 44, and 46 formed by cut lines. As such, the cut-off corner edges of otherwise rectangular bottom panel 24 define an octagonal shape of bottom panel 24. As used throughout this description, angled edges 40, 42, 44, and 46 are considered outer edges of bottom panel 24. Moreover, each angled corner edge 40, 42, 44, and 46 has a length $L_1$, and angled edges 40 and 44 and angled edges 42 and 46 are substantially parallel. Alternatively, bottom panel 24 may have any suitable shape that enables container 150 to function as described herein. For example, bottom panel 24 may be in the shape of a rectangle having corners that are truncated by a segmented edge such that bottom panel 24 has more than eight sides. In another example, bottom panel 24 may be in the shape of a rectangle having corners that are truncated by an arcuate edge such that bottom panel 24 has four substantially straight sides and four arcuate sides.

In the example embodiment, first side panel 22 includes two free side edges 48 and 50, and second side panel 26 includes two free side edges 52 and 54. Side edges 48, 50, 52, and 54 are substantially parallel to each other. Alternatively, side edges 48, 50, 52, and/or 54 are other than substantially parallel. In the example embodiment, each side edge 48, 50, 52, and 54 is connected to a respective angled edge 40, 42, 44, or 46. Each side edge 48, 50, 52, and 54 may be directly connected to a respective angled edge 40, 42, 44, or 46 or, as shown in FIG. 1, may be slightly offset from a respective angled edge 40, 42, 44, or 46 to facilitate forming container 150 from blank 10 by allowing clearance for a thickness of a panel that is directly or indirectly attached to first side panel 22 or second side panel 26. Side edges 48, 50, 52, and 54 and angled edges 40, 42, 44, and 46 partially define a respective cutout 56, 58, 60, or 62. More specifically, side edge 48 and angled edge 40 partially define cutout 56, side edge 52 and angled edge 42 partially define cutout 60, side edge 54 and angled edge 44 partially define cutout 62, and side edge 50 and angled edge 46 partially define cutout 58.

A first end panel 64 extends from bottom panel 24 along a fold line 66 to a free edge 68, and a second end panel 70 extends from bottom panel 24 along a fold line 72 to a free edge 74. Fold line 66 defines a bottom edge of first end panel 64 and a side edge of bottom panel 24, and fold line 72 defines a bottom edge of second end panel 70 and a side edge of bottom panel 24. First and second end panels 64 and 70 are each generally rectangularly shaped. End panels 64 and 70 each have a depth $D_2$ that is shorter than depth $D_1$ such that end panels 64 and 70 are narrower than bottom panel 24. In the example embodiment, end panels 64 and 70 each have a height $H_2$ such that height $H_2$ is substantially equal to height $H_1$. Alternatively, height $H_2$ is other than equal to height $H_1$. In the example embodiment, fold line 66 extends between ends of angled corner edges 40 and 42, and fold line 72 extends between ends of angled corner edges 44 and 46.

In the example embodiment, a reinforcing panel 76 extends from side edges of each end panel 64 and 70. Reinforcing panel 76 is also referred to herein as a reinforcing panel assembly that includes a plurality of panels as described in more detail herein. Each side edge of end panels 64 and 70 is defined by a respective fold line 78, 80, 82, or 84. Fold lines 78, 80, 82, and 84 are substantially parallel to each other. Alternatively, fold lines 78, 80, 82, and/or 84 are other than substantially parallel. In the example embodiment, each reinforcing panel assembly 76 includes a free bottom edge 86. Each free bottom edge 86 at least partially defines cutouts 56, 58, 60, and 62. Further, each reinforcing panel assembly 76 is substantially similar and includes an outer reinforcing panel assembly 88, an inner reinforcing panel assembly 90, and an inner end panel 92 connected along substantially parallel fold lines 94 and 96. Fold line 94 defines a side edge of outer reinforcing panel assembly 88 and a side edge of inner reinforcing panel assembly 90, and fold line 96 defines a side edge of inner reinforcing panel assembly 90 and a side edge of inner end panel 92. Moreover, outer reinforcing panel assembly 88 includes a corner panel 98 and a first reinforcing side panel 100, and inner reinforcing panel assembly 90 includes a reinforcing corner panel 102 and a second reinforcing side panel 104. Each reinforcing panel assembly 76 is configured to form a reinforcing corner assembly 151 (shown in FIG. 2) when container 150 is formed from blank 10.

Figure 2:
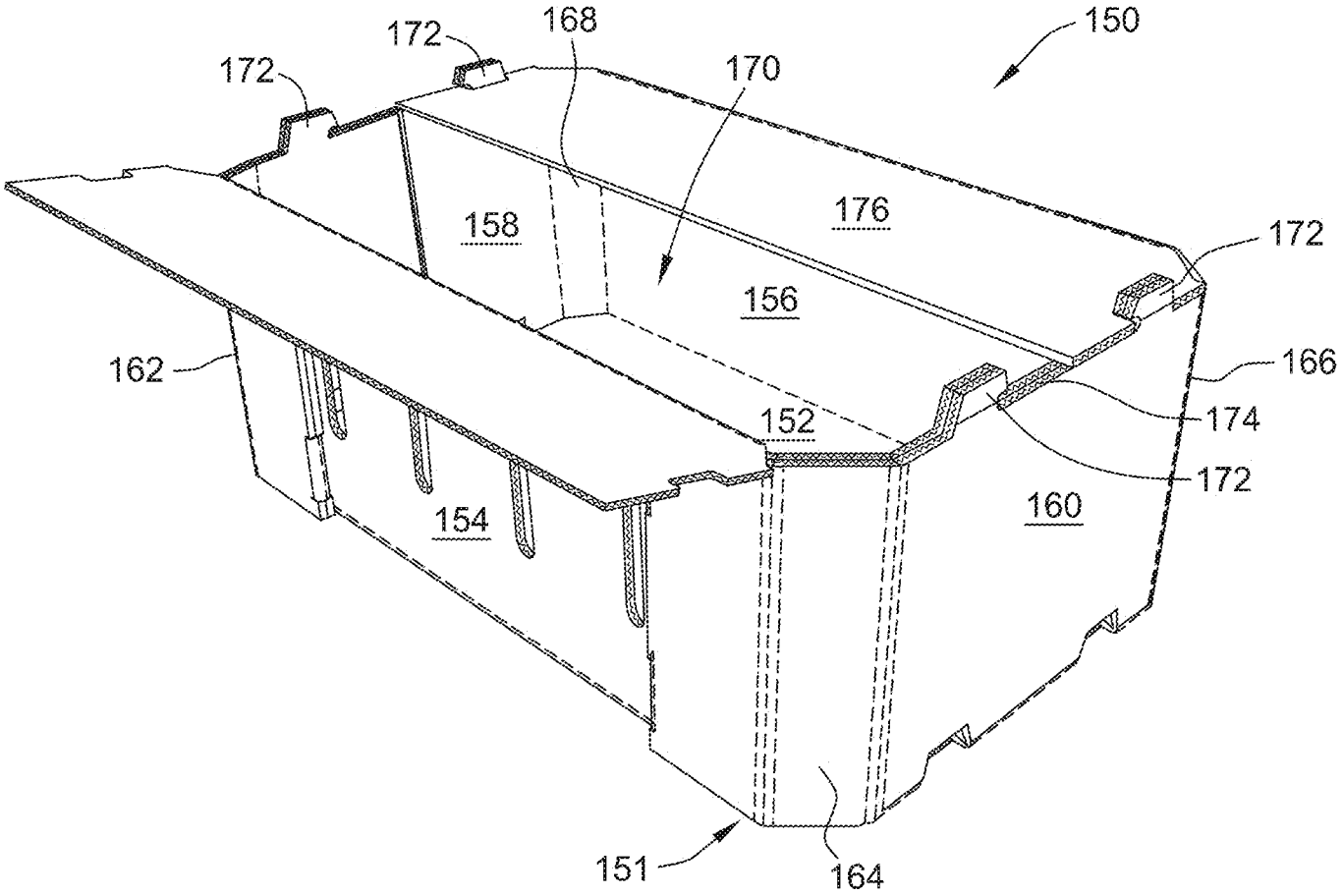
FIG. 2 is a perspective view of a container formed from the blank shown in FIG. 1.

More specifically, outer reinforcing panel assembly 88 extends along each of fold lines 78, 80, 82, and 84. Further, inner reinforcing panel assembly 90 extends from each outer reinforcing panel assembly 88 along fold line 94, and inner end panel 92 extends from each inner reinforcing panel assembly 90 along fold line 96 to a free edge 106. Inner reinforcing panel assemblies 90 and outer reinforcing panel assemblies 88 are substantially rectangular in shape. More specifically, inner reinforcing panel assemblies 90 have a width $W_3$, and outer reinforcing panel assemblies 88 have a width $W_4$, which is substantially equal to width $W_3$. Further, in the example embodiment, corner panel 98, first reinforcing side panel 100, and second reinforcing side panel 104 have a height $H_3$ that is greater than height $H_2$ of end panels 64 and 70 such that, when container 150 (FIG. 2) is formed, corner panel 98, first reinforcing side panel 100, and/or second reinforcing side panel 104 are in face-to-face relationship with an outer edge of bottom panel 24 as shown in FIG. 2. In an alternative embodiment, height $H_3$ is equal to or less than height $H_2$. Further, in the example embodiment, inner end panel 92 and reinforcing corner panel 102 have a height $H_4$ that is less than height $H_3$. Accordingly, bottom edge 86 includes an outer bottom edge 108 and an inner bottom edge 110 which is offset from outer bottom edge 108. In the example embodiment, outer bottom edge 108 extends from a respective fold line 78, 80, 82, or 84 to fold line 114, and inner bottom edge 110 extends from fold line 114 to free edge 106. In the example embodiment, the difference between height $H_1$ and $H_4$ is substantially equal to a thickness of the bottom panel 24, such that at least a portion of inner bottom edge 110 rests on bottom panel 24 when blank 10 is articulated to form container 150.

Each outer reinforcing panel assembly 88 includes a fold line 112 that bisects each outer reinforcing panel assembly 88 into corner panel 98 and first reinforcing side panel 100. Fold line 112 defines an edge of corner panel 98 and a side edge of first reinforcing side panel 100, and fold line 94 defines a side edge of first reinforcing side panel 100. In the example embodiment, corner panel 98 and first reinforcing side panel 100 are substantially rectangular. Further, in the example embodiment, each inner reinforcing panel assembly 90 includes a fold line 114 that bisects each inner reinforcing panel assembly 90 into reinforcing corner panel 102 and second reinforcing side panel 104. Fold line 114 defines an edge of reinforcing corner panel 102 and a side edge of second reinforcing side panel 104, fold line 96 defines a side edge of reinforcing corner panel 102, and fold line 94 defines a side edge of second reinforcing side panel 104.

In the example embodiment, reinforcing corner panel 102 and second reinforcing side panel 104 are substantially rectangular. Further, corner panel 98 and reinforcing corner panel 102 are substantially congruent, and first and second reinforcing side panels 100 and 104 are substantially congruent.

Each corner panel 98 and each reinforcing corner panel 102 have a width $W_5$ that is substantially equal to length $L_1$. In addition, each first reinforcing side panel 100 and second reinforcing side panel 104 have a width $W_6$ that is greater than width $W_5$. In an alternative embodiment, width $W_6$ is other than greater than width $W_5$. Further, in the example embodiment, each inner end panel 92 has a depth $D_3$ that is equal to approximately half of the depth $D_2$ of first and second end panels 64 and 70. In an alternative embodiment, depth $D_3$ is other than equal to approximately half the depth $D_2$.

In the example embodiment, first end panel 64 includes two tabs 116 extending from free edge 68, and second end panel 70 includes two tabs 116 extending from free edge 74. Alternatively, first end panel 64 and/or second end panel 70 may include any suitable number of tabs 116 that enables blank and/or container to function as described herein. Alternatively, first end panel 64 and/or second end panel 70 does not include any tabs 116. Moreover, it will be understood that one or more tabs 116 may be included in any of the embodiments described herein. For example, one or more tabs 116 may extend from leading edge 16, trailing edge 18, fold line 30, and/or fold line 36 of the embodiments described herein.

In the example embodiment, each inner end panel 92 includes a reinforcing tab 118 extending from a top edge 120 of inner end panel 92. Each reinforcing tab 118 is positioned along top edge 120 such that reinforcing tab 118 is substantially aligned with, and in a face-to-face relationship with a respective tab 116 on end panel 64 or 70 when inner end panel 92 is rotated about fold line 94 to form container 150 (described in more detail below). Alternatively, one or more inner end panels 92 does not include reinforcing tab 118.

Further, in the example embodiment, a pair of cutouts 122 is defined along each fold line 66 and 72. Cutouts 122 may have any suitable configuration that enables blank 10 and/or container 150 to function as described herein. In one embodiment, each cutout 122 is sized to receive a reinforced tab 172 (FIG. 2) for stacking containers 150 and/or to provide venting for cavity 170 (FIG. 2). Alternatively, fold line 66 and/or fold line 72 may include any suitable number of cutouts 122 that enables blank 10 and/or container 150 to function as described herein. Alternatively, fold line 66 and/or fold line 72 does not include any cutouts 122. Moreover, it will be understood that cutouts 122 may be included in any of the embodiments described herein. For example, one or more cutouts 122 may be defined in fold lines 32 and/or 34 of the embodiments described herein.

Further, in the example embodiment, each inner end panel 92 includes a notch 124 defined in the bottom edge 86 thereof. Notch 124 is configured to correspond to one of cutouts 122 such that cutout 122 is not obstructed by inner end panel 92 when container 150 is formed. In an alternative embodiment, notch 124 may have any suitable configuration that enables blank 10 and/or container 150 to function as described herein. Alternatively, one or more inner end panels 92 does not include notch 124. Moreover, it will be understood that notch 124 may be included in any of the embodiments described herein on any suitable panel.

In the example embodiment, first top panel 20 and second top panel 28 are substantially congruent and have a trapezoidal shape. More specifically, first top panel 20 includes an angled edge 126 extending between an intersection 128 of fold line 30 and free edge 48 toward bottom edge 86, and an angled edge 130 extending between an intersection 132 of fold line 30 and free edge 50 toward bottom edge 86. Similarly, second top panel 28 includes an angled edge 134 extending between an intersection 136 of fold line 36 and free edge 52 toward bottom edge 86, and an angled edge 138 extending between an intersection 140 of fold line 36 and free edge 54 toward bottom edge 86. As such, angled edge 126, free edge 48, angled edge 40, and bottom edge 86 partially define cutout 56; angled edge 134, free edge 52, angled edge 42, and bottom edge 86 partially define cutout 60; angled edge 138, free edge 54, angled edge 44, and bottom edge 86 partially define cutout 62; and angled edge 130, free edge 50, angled edge 46, and bottom edge partially define cutout 58. In the illustrated embodiment, angled edges 126 and 130 are offset from the intersections 128 and 132 between fold line 30 and free edges 48 and 50, and angled edges 134 and 138 are offset from the intersections 136 and 140 between fold line 34 and free edges 52 and 54. In alternative embodiments, angled edges 126, 130, 134, and/or 138 may extend from a respective intersection 128, 132, 136, or 140.

In addition, first and second top panels 20 and 28 have a depth $D_4$ that is smaller than half of depth $D_1$. In an alternative embodiment, depth $D_4$ is substantially equal to or larger than half of depth $D_1$. In the example embodiment, first side panel 22 and second side panel 26 and/or bottom panel 24 and top panels 20 and 28 are equally dimensioned, however, first side panel 22 and second side panel 26 and/or bottom panel 24 and top panels 20 and 28 may be other than equally dimensioned. In the illustrated embodiment, first top panel 20 is separated from adjacent reinforcing panel assemblies 76 by a first side edge 142 and a second side edge 144. Similarly, second top panel 28 is separated from adjacent reinforcing panel assemblies 76 by first side edge 142 and second side edge 144.

Further, in the example embodiment, each first side edge 142 and each second side edge 144 include a notch 146 defined therein. Notch 146 is configured to correspond to a reinforced tab 172 (FIG. 2) formed by tab 116 and reinforcing tab 118 such that first and second top panels 20 and 28 lay flush with the top edge 174 (FIG. 2) of container 150 when container 150 is formed. In an alternative embodiment, notch 146 may have any suitable configuration that enables blank 10 and/or container 150 to function as described herein. Alternatively, one or more first side edge 142 and/or second side edge 144 does not include notch 146. Moreover, it will be understood that notch 146 may be included in any of the embodiments described herein on any suitable panel.

FIG. 2 is a perspective view of container 150 that is formed from blank 10 (shown in FIG. 1). Although container 150 is shown as being formed without a product to be contained therein, container 150 may also be formed having a product therein. Further, container 150 may include any suitable number of products of any suitable shape.

Container 150 is formed using machine 1000, described in more detail below. In the example embodiment, bottom panel 24 is sized to correspond to product(s) contained within container 150. Each inner end panel 92 and respective inner reinforcing panel assembly 90 are folded about fold line 94 such that inner reinforcing panel assembly 90 and outer reinforcing panel assembly 88 are in an at least partially overlying relationship, and such that inner end panel 92 is in an at least partially overlying relationship with at least a portion of first or second end panel 64 or 70. More specifically, blank 10 is folded along fold line 94 such that corner panel 98 and reinforcing corner panel 102 are substantially aligned in an at least partially overlying relationship, first and second reinforcing side panels 100 and 104 are substantially aligned in an at least partially overlying relationship, and inner end panel 92 and at least a portion of first or second end panel 64 or 70 are substantially aligned in an at least partially overlying relationship. In the example embodiment, inner end panel 92, a respective end panel 64 or 70, reinforcing side panels 100 and 104, and/or corner panel 98 and reinforcing corner panel 102 are secured in the above-described relationships. For example, inner end panel 92, a respective end panel 64 or 70, reinforcing side panels 100 and 104, and/or corner panel 98 and reinforcing corner panel 102 are held against the product to be contained or by a section of machine 1000 (described in more detail below) which applies a force on exterior surface 14 as container 150 continues to be erected. In another example, inner end panel 92 may be adhered to a respective end panel 64 or 70, reinforcing side panels 100 and 104 may be adhered together, and/or corner panels 98 and 102 may be adhered together. A reinforcing corner assembly 151 is formed by corner panels 98 and 102, reinforcing side panels 100 and 104, and inner end panel 92. Exterior surfaces 14 of inner end panel 92, reinforcing corner panel 102, and second reinforcing side panel 104 define an interior surface of reinforcing corner assemblies 151, and exterior surfaces 14 of corner panel 98 and first reinforcing side panel 100 define an exterior surface of reinforcing corner assemblies 151.

First side panel 22 is rotated about fold line 32 toward interior surface 12, and second side panel 26 is rotated about fold line 34 toward interior surface 12. More specifically, first side panel 22 and second side panel 26 are rotated to be substantially perpendicular to bottom panel 24, as shown in FIG. 2. First and second end panels 64 and 70 are rotated about fold lines 66 and 72, respectively, toward interior surface 12. Reinforcing panel assemblies 88 and 90 are rotated about fold lines 78, 80, 82, and 84 and fold lines 96. Further, reinforcing side panels 100 and 104 are rotated about fold lines 112 and 114 toward corner panels 98 and 102 before or after reinforcing panel assemblies 88 and 90 are rotated about fold lines 78, 80, 82, and 84 and fold lines 96. In the example embodiment, reinforcing panel assemblies 88 and 90 and reinforcing side panels 100 and 104 are rotated such that reinforcing side panels 100 and 104 are substantially perpendicular to end panels 64 and 70.

An exterior surface of first side panel 22 is secured to an interior surface of two adjacent reinforcing corner assemblies 151, and exterior surface of second side panel 26 is attached to an interior surface of two adjacent reinforcing corner assemblies 151. More specifically, exterior surface 14 of first side panel 22 is secured to exterior surface 14 of two adjacent second reinforcing side panels 104, and exterior surface 14 of second side panel 26 is secured to exterior surface 14 of two adjacent second reinforcing side panels 104. In the example embodiment, first side panel 22 and second side panel 26 are adhered to respective second reinforcing side panels 104. Alternatively, first side panel 22 and second side panel 26 are otherwise attached to respective second reinforcing side panels 104 using, for example, fasteners, a bonding material, and/or any suitable method for attached the panels.

When container 150 is formed, interior surface 12 of first and second side panels 22 and 26 is adjacent the side walls of the product. Further, height $H_1$ of first and second side panels 22 and 26 is sized to correspond to a height of the products within container 150 such that height $H_1$ is substantially equal to or greater than the height of the products. Bottom panel 24 forms a bottom wall 152 of container 150, first side panel 22 and a pair of reinforcing side panels 100 and 104 forms a front wall 154 of container 150, and second side panel 26 and a pair of reinforcing side panels 100 and 104 forms a rear wall 156 of container 150. Front wall 154 and rear wall 156 are also referred to as first and second side walls of container 150, respectively. End panel 64 and two inner end panels 92 form a first end wall 158, and end panel 70 and two inner end panels 92 form a second end wall 160. Corner panel 98 and reinforcing corner panel 102 of each reinforcing panel assembly 76 form a respective corner wall of container 150. As shown in FIG. 2, the corner panels 98 and 102 form a first corner wall 162, a second corner wall 164, a third corner wall 166, and a fourth corner wall 168. Bottom wall 152, first side wall 154, second side wall 156, first end wall 158, second end wall 160, and corner walls 162, 164, 166, and 168 define a cavity 170 of container 150. Each tab 116 and a corresponding reinforcing tab 118 form a reinforced tab 172 extending from a top edge 174 of container 150.

To close container 150, first top panel 20 is rotated about fold line 30 toward cavity 170 such that first top panel 20 is substantially perpendicular to first side panel 22 and substantially parallel to bottom panel 24. Further, second top panel 28 is rotated about fold line 36 toward cavity 170 such that second top panel 28 is substantially perpendicular to second side panel 26 and substantially parallel to bottom panel 24. First and second top panels 20 and 28 thereby form a top wall 176 of container 150. As shown in FIG. 2, each of first top panel 20 and second top panel 28 are in face-to-face relationship with an upper edge of reinforcing corner assemblies 151 such that at least a portion of the upper edge of reinforcing corner assemblies 151 is covered by top wall 176. More specifically, interior surface 12 of first top panel 20 is in face-to-face relationship with an upper edge of two reinforcing corner assemblies 151, specifically, an upper edge of each of inner end panel 92, corner panel 98, and reinforcing corner panel 102. Similarly, interior surface of second top panel 28 is in face-to-face relationship with an upper edge of two reinforcing corner assemblies 151, specifically, an upper edge of each of inner end panel 92, corner panel 98, and reinforcing corner panel 102. The offset of angled edges 126, 130, 134, and 138 permits top panels 20 and 28 to fully cover the upper edges of corner panel 98 and reinforcing corner panel 102. The offset of angled edges 126, 130, 134, and 138 thereby facilitates protecting corner assemblies 151 from being damaged during use, and further facilitates keeping moisture out of container 150.

Figure 6:
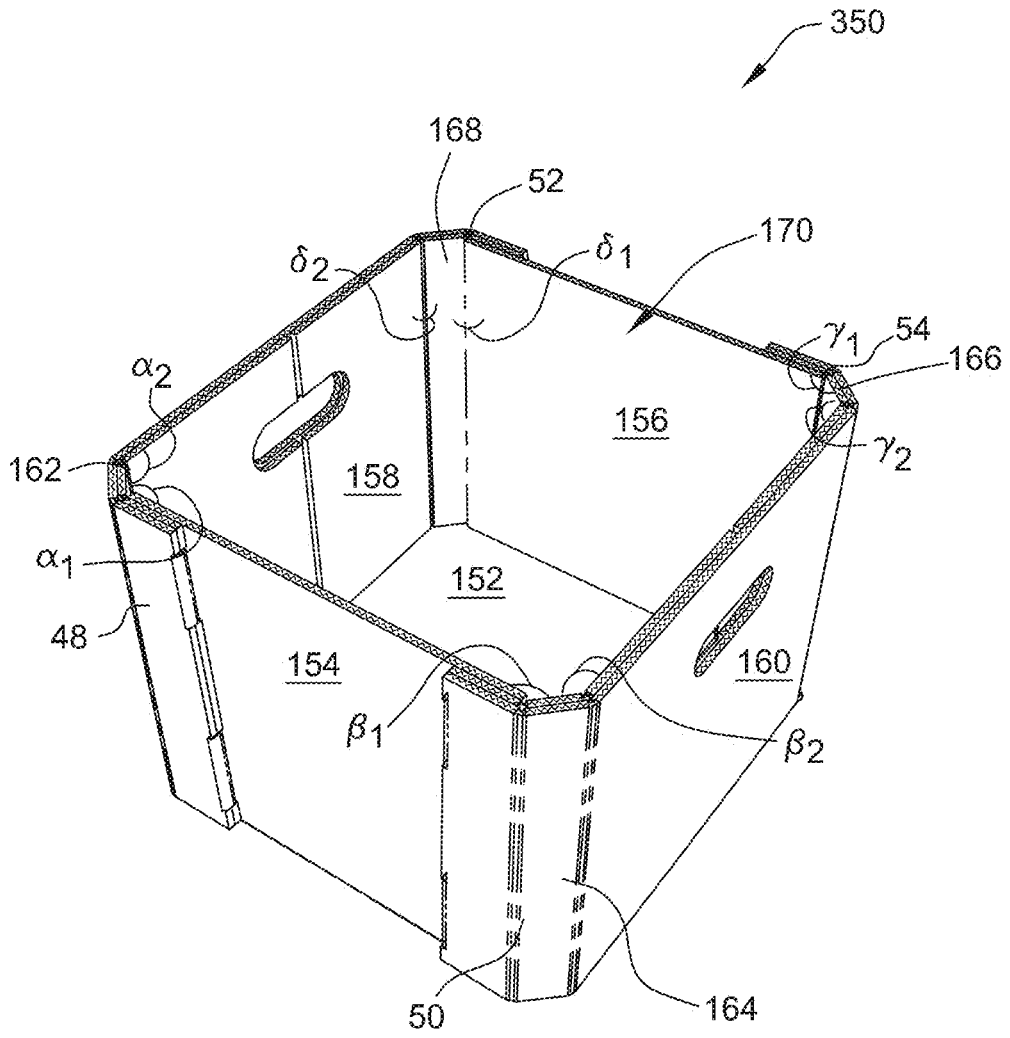
FIG. 6 is a perspective view of a container formed from the blank shown in FIG. 5.

In the example embodiment, first corner wall 162 is oriented at an oblique angle $\alpha 1$ with respect to first side wall 154 and an oblique angle $\alpha 2$ with respect to end wall 158 (shown in FIG. 6). Similarly, second corner wall 164 is oriented at an oblique angle $\beta 1$ with respect to first side wall 154 and an oblique angle $\beta 2$ with respect to end wall 160 (shown in FIG. 6). Similarly, third corner wall 166 is oriented at an oblique angle $\gamma 1$ with respect to second side wall 156 and an oblique angle $\gamma 2$ with respect to end wall 160, and fourth corner wall 168 is oriented at an oblique angle $\delta 1$ with respect to second side wall 156 and an oblique angle $\delta 2$ with respect to end wall 158 (shown in FIG. 6). In the example embodiment, angles $\alpha 1$, $\alpha 2$, $\beta 1$, $\beta 2$, $\gamma 1$, $\gamma 2$, $\delta 1$, and $\delta 2$ are substantially equal, however, angles $\alpha 1$, $\alpha 2$, $\beta 1$, $\beta 2$, $\gamma 1$, $\gamma 2$, $\delta 1$, and/or $\delta 2$ can be other than equal depending of the products positioned within container 150. Further, in the example embodiment, inner bottom edges 110 of reinforcing panel assemblies 76 are substantially aligned with fold lines 66 and 72, and angled edges 40, 42, 44, and 46, and outer bottom edges 108 of reinforcing panel assemblies 76 overlap fold lines 32 and 34, and angled edges 40, 42, 44, and 46.

As described above, second reinforcing side panels 104 of reinforcing panel assembly 76 are attached to the exterior surface 14 of side panels 22 and 26. The reduced height $H_4$ of inner end panel 92 and reinforcing corner panel 102 compared to the height $H_3$ enables reinforcing side panel 104 to be attached to the exterior surface 14 of first and second side panels 22 and 26 when blank 10 is articulated to form container 150. At the same time, reduced height $H_4$ of inner end panel 92 and reinforcing corner panel 102 enables reinforcing corner panels 102 to rest on bottom panel 24 when blank 10 is articulated to form container 150, thereby providing additional stacking support for container 150. Thus, the interior surfaces 12 of walls forming container 150 are generally planar, having no open or free edges within container 150. As a result, container 150 is better suited for transporting products that can be easily damaged during storage or transport, such as fresh fruit or produce.

The above-described method to construct container 150 from blank 10 may be performed using a machine, as described in more detail below. The machine performs the above-described method to continuously form container 150 from blank 10 as blank 10 is moved through the machine. In one embodiment, the machine includes at least one plow or finger to at least partially rotate at least one of panels 22, 26, 64, 70, 92, 98, 100, 102, and 104 and/or further forms container 150 using a mandrel to complete rotating these panels.

In alternative embodiments, blank 10 may include one or more inner reinforcing corner panels, which partially form one or more corner walls of container 150, as shown and described in more detail below with reference to FIGS. 7 and 8.

Figure 3:
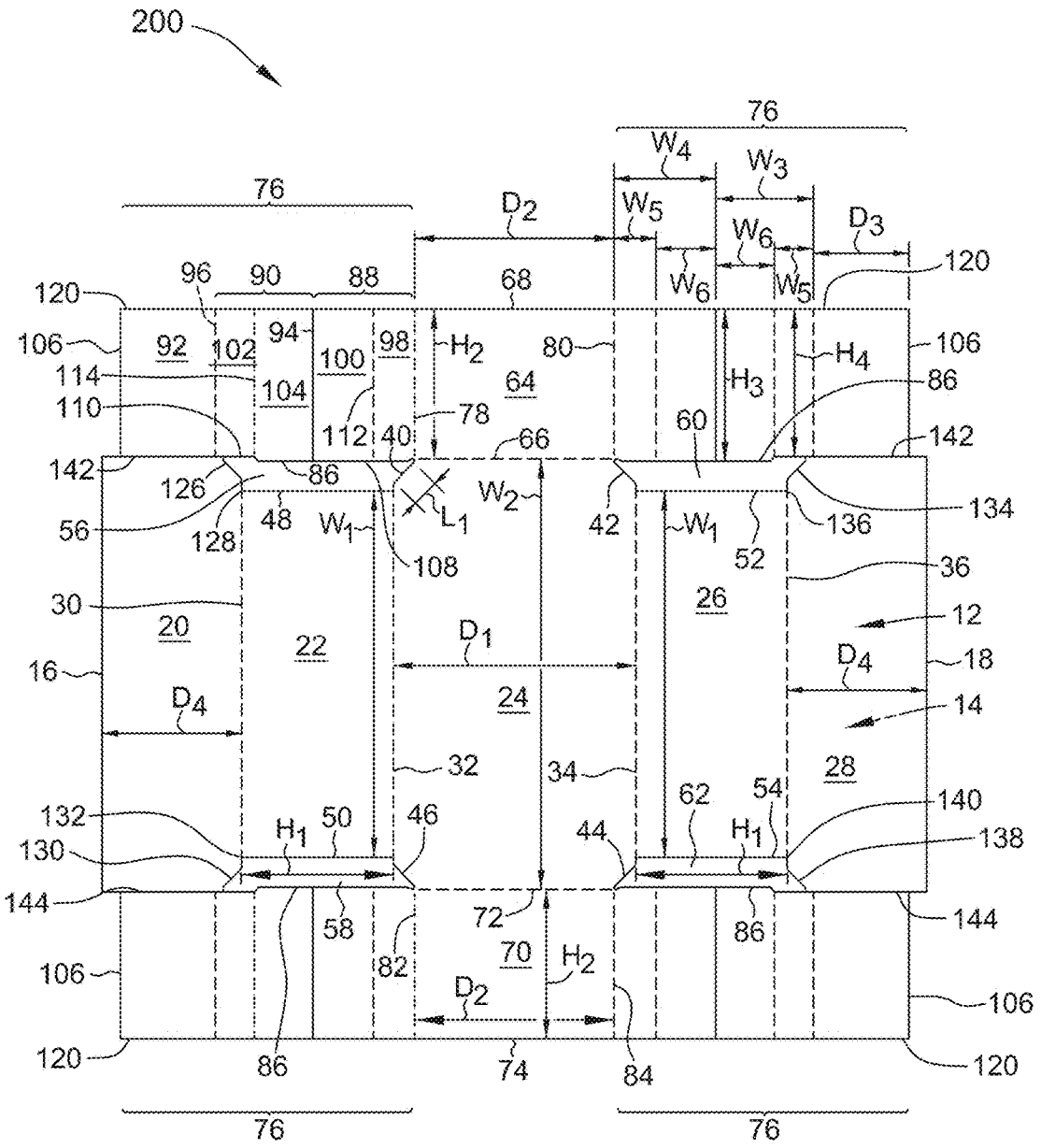
FIG. 3 is a top plan view of a blank of sheet material for constructing a container according to a first alternative embodiment of the present disclosure.

FIG. 3 is a top plan view of an example embodiment of a blank 200 of sheet material. Blank 200 is essentially similar to blank 10 (shown in FIG. 1) and, as such, similar components are labeled with similar references. More specifically, blank 200 does not include tabs 116, reinforcing tabs 118, cutouts 122, notches 124, or notches 146.

Figure 4:
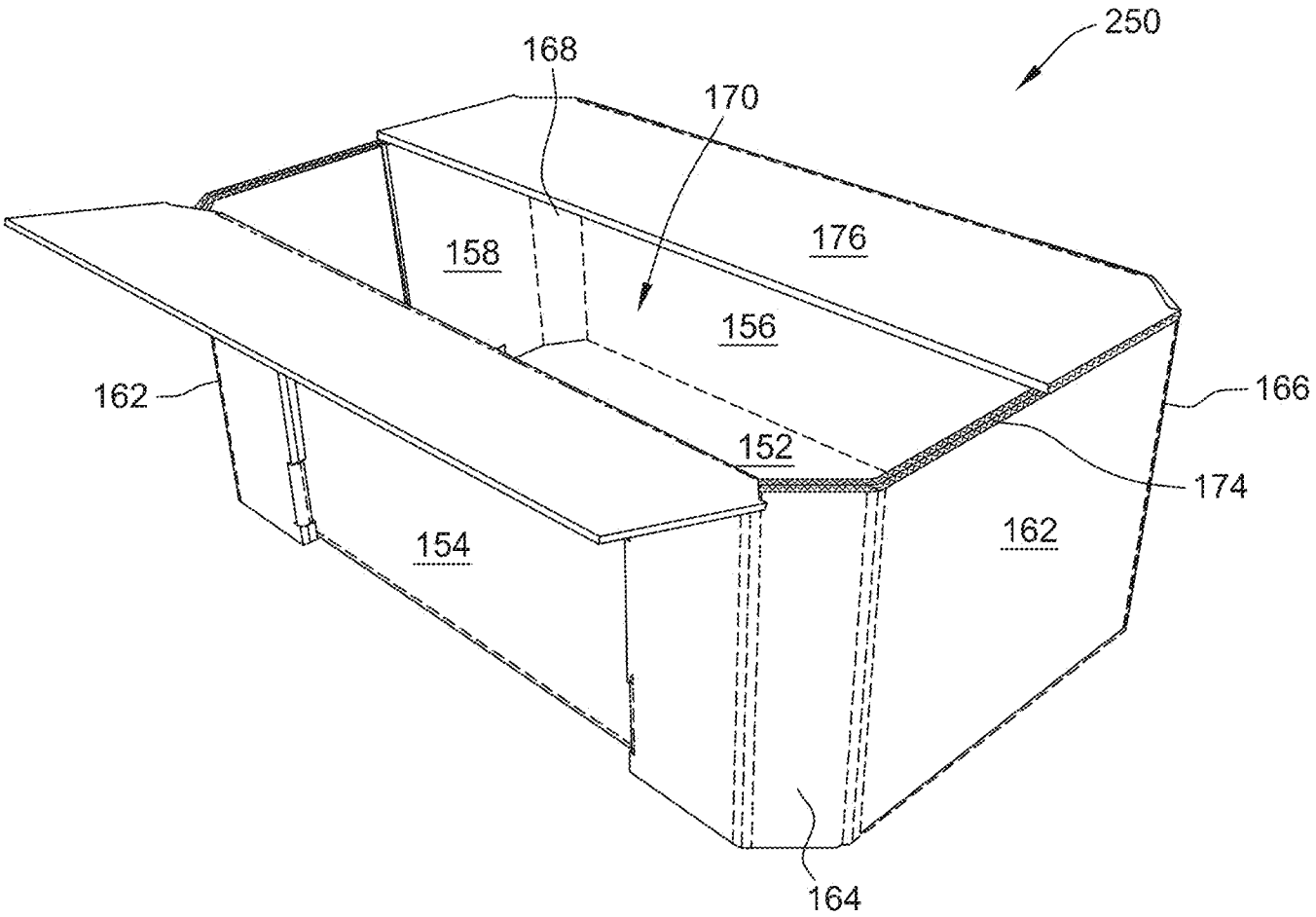
FIG. 4 is a perspective view of a container formed from the blank shown in FIG. 3.

FIG. 4 is a perspective view of container 250 that is formed from blank 200 (shown in FIG. 3). Container 250 is essentially similar to container 150 (shown in FIG. 2) and, as such, similar components are labeled with similar references. More specifically, container 250 does not include reinforced tabs 172, cutouts 122, notches 124 or notches 146. Although container 250 is shown as being formed without a product to be contained therein, container 250 may also be formed having a product therein. Further, container 250 may include any suitable number of products of any suitable shape. To construct container 250 from blank 200 a method that is substantially similar to the method for forming container 150 from blank 10 is used.

Figure 5:
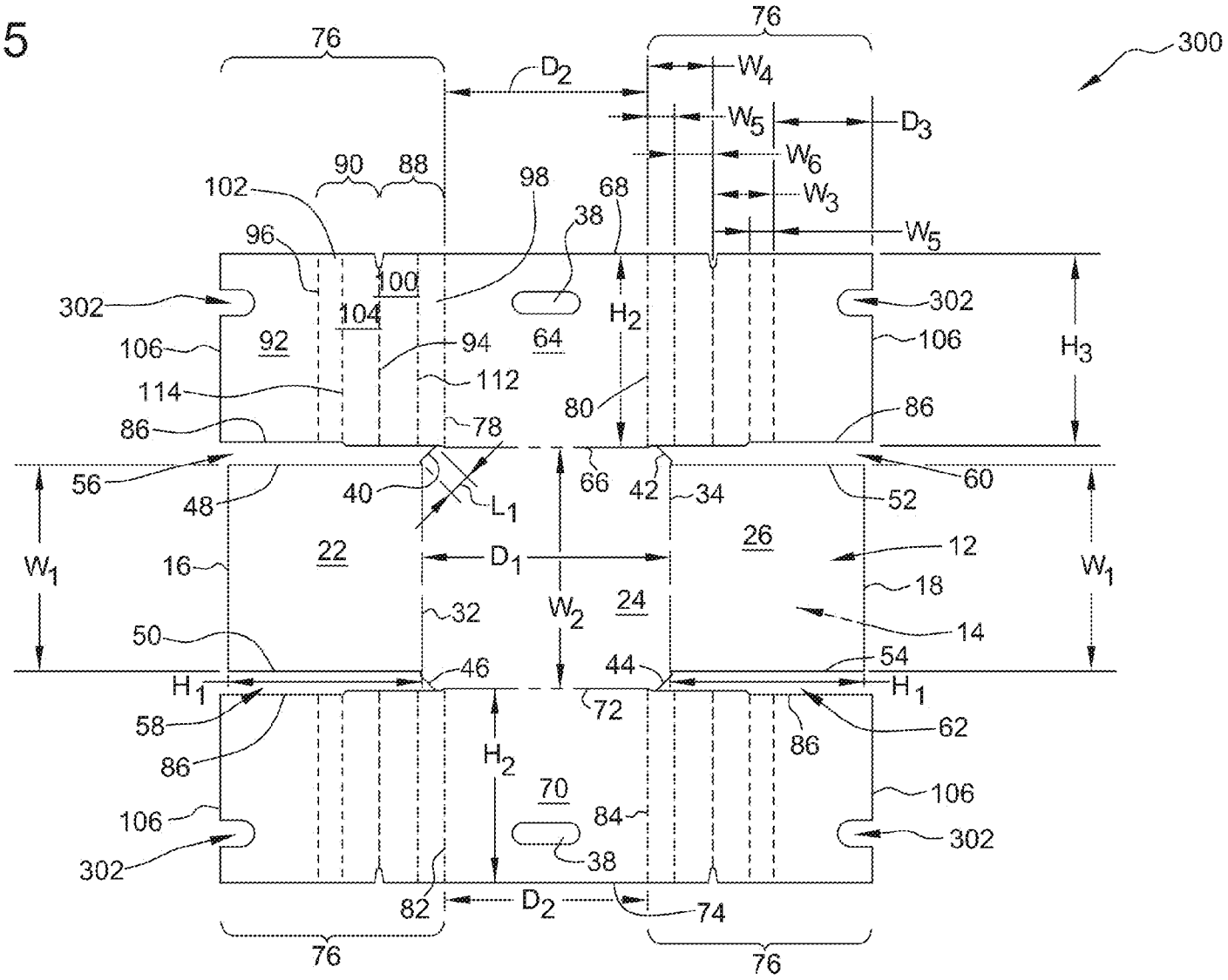
FIG. 5 is a top plan view of a blank of sheet material for constructing a container according to a second alternative embodiment of the present disclosure.

FIG. 5 is a top plan view of an example embodiment of blank 300 of sheet material. Blank 300 is essentially similar to blank 10 (shown in FIG. 1) and, as such, similar components are labeled with similar references. More specifically, blank 300 does not include top panels 20 and 28. Moreover, blank 300 includes leading edge 16 and trailing edge 18 as top edges of first side panel 22 and second side panel 26, respectively, rather than fold lines 30 and 36. Moreover, blank 300 includes cutouts 302 on each inner end panel 92. Moreover cutouts 38 are defined within first and second end panels 64 and 70, rather than first and second side panels 22 and 26. Moreover, blank 300 does not include tabs 116, reinforcing tabs 118, cutouts 122, notches 124, or notches 146.

In the example embodiment, blank 300 includes, in series from leading edge 16 to trailing edge 18, a first side panel 22, a bottom panel 24, and a second side panel 26, coupled together along preformed, generally parallel, fold lines 32 and 34, respectively. More specifically, first side panel 22 extends from leading edge 16 to fold line 32, bottom panel 24 extends from first side panel 22 along fold line 32, and second side panel 26 extends from bottom panel 24 along fold line 34 to trailing edge 18.

In the example embodiment, a single oval shaped cutout 38 is defined within first and second end panels 64 and 70. Further, in the example embodiment, each inner end panel 92 has a depth $D_3$ that is equal to approximately half of the depth $D_2$ of first and second top panels 20 and 28, such that a cutout 302 extending inward from free edge 106 is substantially aligned with at least a portion of cutout 38. In an alternative embodiment, depth $D_3$ is other than equal to approximately half the depth $D_2$. Alternatively, blank 300 does not include cutout 302.

FIG. 6 is a perspective view of container 350 that is formed from blank 300 (shown in FIG. 5). Container 350 is essentially similar to container 150 (shown in FIG. 2) and, as such, similar components are labeled with similar references. More specifically, container 350 does not include top wall 176, reinforced tabs 172, cutouts 122, notches 124 or notches 146. Although container 350 is shown as being formed without a product to be contained therein, container 350 may also be formed having a product therein. Further, container 350 may include any suitable number of products of any suitable shape.

To construct container 350 from blank 300 a method that is substantially similar to the method for forming container 150 from blank 10 is used. However, no top wall 176 is formed during construction of container 350, as blank does not include top panels 20 and 28.

Figure 7:
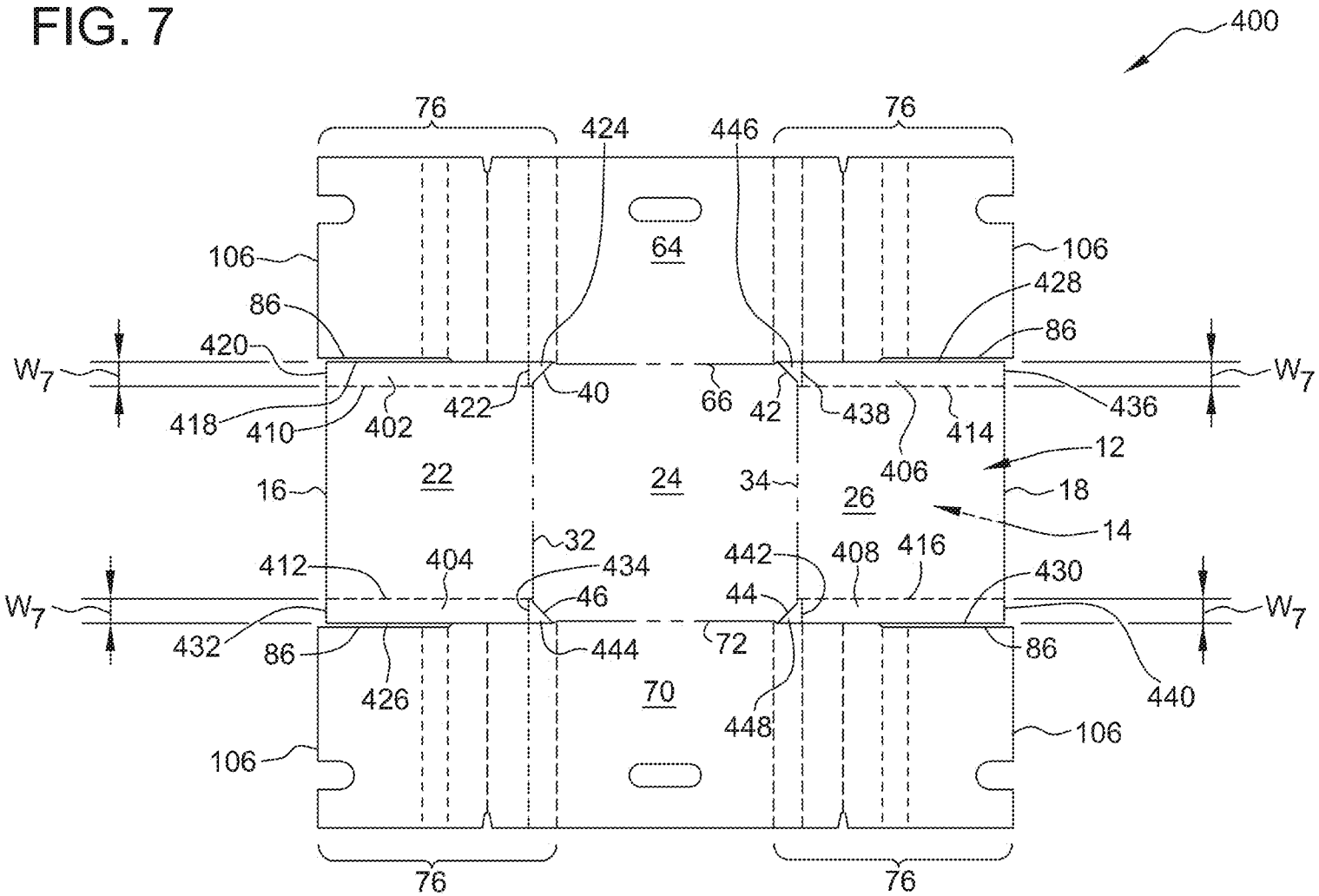
FIG. 7 is a top plan view of a blank of sheet material for constructing a container according to a third alternative embodiment of the present disclosure.

FIG. 7 is a top plan view of an example embodiment of a blank 400 of sheet material. Blank 400 is essentially similar to blank 300 (shown in FIG. 5) and, as such, similar components are labeled with similar references. More specifically, blank 400 includes inner reinforcing corner panels 402, 404, 406, and 408. Further, blank 400 includes fold lines 410, 412, 414, and 416 rather than free side edges 48, 50, 52, and 54.

In the illustrated embodiment, a first inner reinforcing corner panel 402 extends from first side panel 22 along fold line 410 to a free edge 418. Fold line 410 and free edge 418 define side edges of first inner reinforcing corner panel 402, and fold line 410 defines a side edge of first side panel 22. First inner reinforcing corner panel 402 is substantially rectangular shaped having a top edge 420 and a bottom edge 422. Bottom edge 422, angled edge 40, and bottom edge 86 define a removable cutout 424. Further, first inner reinforcing corner panel 402 has substantially height Its such that first inner reinforcing corner panel 402 and reinforcing corner panel 102 have a substantially equal height. Top edge 420 is substantially collinear with leading edge 16, which defines a top edge of first side panel 22. As such bottom edge 422 is offset from fold line 32. In the example embodiment, bottom edge 422 is offset from fold line 32 by a distance substantially equal to the thickness of bottom panel 24. Further, first inner reinforcing corner panel 402 has a width $W_7$. Width $W_7$ is substantially equal to or greater than length $L_1$. Alternatively, width $W_7$ is less than length $L_1$. In the illustrated embodiment, first inner reinforcing corner panel 402 has substantially constant width $W_7$ from top edge 420 to bottom edge 422 such that first inner reinforcing corner panel 402 does not include cutoff corners and/or tapered top and/or bottom edges.

A second inner reinforcing corner panel 404 extends from first side panel 22 along fold line 412 to a free edge 426, third inner reinforcing corner panel 406 extends from second side panel 26 along fold line 414 to a free edge 428, and fourth inner reinforcing corner panel 408 extends from second side panel 26 along fold line 416 to a free edge 430. In the illustrated embodiment, second inner reinforcing corner panel 404, third inner reinforcing corner panel 406, and fourth inner reinforcing corner panel 408 are each substantially rectangular and have substantially height $H_4$ extending between respective top edges 432, 436, 440 and bottom edges 434, 438, and 442 such that inner reinforcing corner panels 404, 406, and 408 and reinforcing corner panels 102 have a substantially equal height. Top edge 432 of second inner reinforcing corner panel 404 is substantially collinear with leading edge 16. As such, bottom edge 434 of second inner reinforcing corner panel 404 is offset from fold line 32. In the example embodiment, bottom edge 434 is offset from fold line 32 by a distance substantially equal to the thickness of bottom panel 24. Top edge 436 of third inner reinforcing corner panel 406 is substantially collinear with trailing edge 18. As such, bottom edge 438 of third inner reinforcing corner panel 406 is offset from fold line 34. In the example embodiment, bottom edge 438 is offset from fold line 34 by a distance substantially equal to the thickness of bottom panel 24. Top edge 440 of fourth inner reinforcing corner panel 408 is substantially collinear with trailing edge 18. As such, bottom edge 442 of fourth inner reinforcing corner panel 408 is offset from fold line 34. In the example embodiment, bottom edge 442 is offset from fold line 34 by a distance substantially equal to the thickness of bottom panel 24. Further, bottom edge 434 of second inner reinforcing corner panel 404, angled edge 46, and bottom edge 86 define a removable cutout 444, bottom edge 438 of third inner reinforcing corner panel 406, angled edge 42, and bottom edge 86 define a removable cutout 446, and bottom edge 442 of fourth inner reinforcing corner panel 408, angled edge 44, and bottom edge 86 define a removable cutout 448.

Further, second inner reinforcing corner panel 404, third inner reinforcing corner panel 406, and fourth inner reinforcing corner panel 408 have width $W_7$. Alternatively, inner reinforcing corner panels 402, 404, 406, and/or 408 may have any suitable dimensions that enable blank 400 and/or container 450 to function as described herein. In the example embodiment, inner reinforcing corner panels 404, 406, and 408 have substantially constant width $W_7$ from respective top edges 420, 432, 436, 440 to respective bottom edges 422, 434, 438, 442 such that corner panels 404, 406, and 408 do not include cutoff corners and/or tapered top and/or bottom edges. Further, second, third, and fourth inner reinforcing corner panels 404, 406, and 408 are substantially congruent to first corner panel 402. Alternatively, corner panels 402, 404, 406, and/or 408 are other than congruent to each other.

In the example embodiment, fold line 410 is offset from an intersection between angled corner edge 40 of bottom panel 24 and fold line 32, fold line 412 is offset from an intersection between angled corner edge 46 of bottom panel 24 and fold line 32, fold line 414 is offset from an intersection between angled corner edge 42 of bottom panel 24 and fold line 34, and fold line 416 is offset from an intersection between angled edge 44 of bottom panel 24 and fold line 34. Further, fold lines 410, 412, 414, and 416 are substantially parallel. Moreover, free edges 418, 426, 428, and 430 are substantially parallel with fold lines 410, 412, 414, and 416. Alternatively, free edges 418, 426, 428, and/or 430 and/or fold lines 410, 412, 414, and/or 416 are other than parallel. In the example embodiment, each free edge 418, 426, 428, and 430 is adjacent to and substantially parallel with a bottom edge 86.

Figure 8:
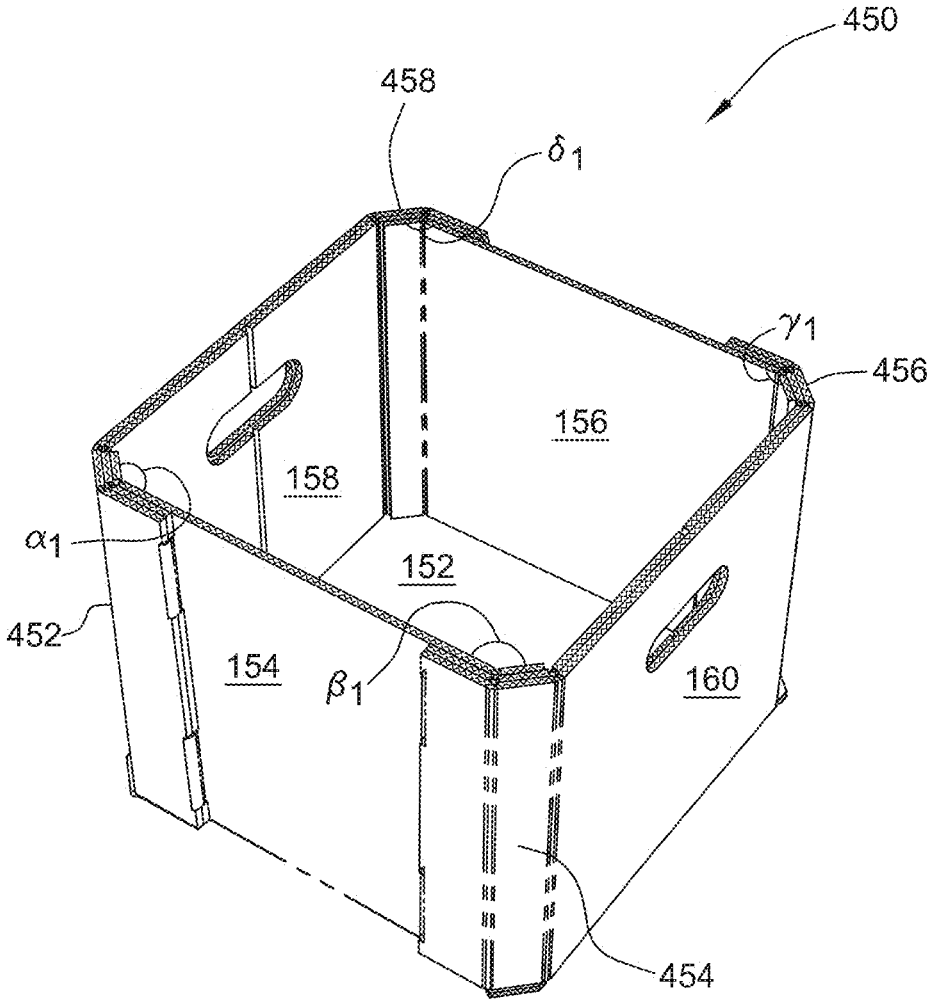
FIG. 8 is a perspective view of a container formed from the blank shown in FIG. 7.

FIG. 8 is a perspective view of container 450 that is formed from blank 400 (shown in FIG. 7). Container 450 is essentially similar to container 350 (shown in FIG. 6) and, as such, similar components are labeled with similar references. Although container 450 is shown as being formed without a product to be contained therein, container 450 may also be formed having a product therein. Further, container 450 may include any suitable number of products of any suitable shape.

To construct container 450 from blank 400 a method that is substantially similar to the method for forming container 350 from blank 300 is used. However, to construct container 450, first inner reinforcing corner panel 402 is rotated about fold line 410 toward interior surface 12, and exterior surface 14 of first inner reinforcing corner panel 402 is secured to exterior surface 14 of reinforcing corner panel 102 located on reinforcing panel assembly 76 extending from fold line 78 of first end panel 64. More specifically, first inner reinforcing corner panel 402 is rotated such that first inner reinforcing corner panel 402 is oriented at oblique angle $\alpha 1$ to first side wall 154. Similarly, second inner reinforcing corner panel 404 is rotated about fold line 412 toward interior surface 12. Exterior surface 14 of second reinforcing corner panel 404 is secured to exterior surface 14 of reinforcing corner panel 102 located on reinforcing panel assembly 76 extending from fold line 82 of second end panel 70. More specifically, second inner reinforcing corner panel 404 is rotated such that second inner reinforcing corner panel 404 is oriented at oblique angle $\beta 1$ to first side wall 154.

In the example embodiment, free edges 418 and 426 of inner reinforcing corner panels 402 and 404 are substantially aligned with fold lines 96 of a respective reinforcing panel assembly 76. Alternatively, first inner reinforcing corner panel 402 and/or second inner reinforcing corner panel 404 only partially overlap corner panels 102 such that free edges 418 and/or 426 are offset from fold lines 96. Further, in the example embodiment, bottom edge 422 of first inner reinforcing corner panel 402 is substantially aligned with angled edge 40 of bottom panel 24, and bottom edge 434 of second inner reinforcing corner panel 404 is substantially aligned with angled edge 46 of bottom panel 24. First inner reinforcing corner panel 402 forms a first corner wall 452 with a pair of corner panels 98 and 102, and second inner reinforcing corner panel 404 forms a second corner wall 454 with a pair of corner panels 98 and 102.

Third inner reinforcing corner panel 406 is rotated about fold line 414 toward interior surface 12. Exterior surface 14 of third inner reinforcing corner panel 406 is secured to exterior surface 14 of reinforcing corner panel 102 located on reinforcing panel assembly 76 extending from fold line 80 of first end panel 64. More specifically, third inner reinforcing corner panel 406 is rotated such that third inner reinforcing corner panel 406 is oriented at oblique angle $\gamma 1$ to second side wall 156. Similarly, fourth inner reinforcing corner panel 408 is rotated about fold line 416 toward interior surface 12. Exterior surface 14 of fourth inner reinforcing corner panel 408 is secured to exterior surface 14 of reinforcing corner panel 102 located on reinforcing panel assembly 76 extending from fold line 84 of second end panel 70. More specifically, fourth inner reinforcing corner panel 408 is rotated such that fourth inner reinforcing corner panel 408 is oriented at oblique angle $\delta 1$ to second side wall 156.

In the example embodiment, free edges 428 and 430 of inner reinforcing corner panels 406 and 408 are substantially aligned with fold lines 96 of a respective reinforcing panel assembly 76. Alternatively, third inner reinforcing corner panel 406 and/or fourth inner reinforcing corner panel 408 only partially overlap corner panels 102 such that free edges 428 and/or 430 are offset from fold lines 96. Further, in the example embodiment, bottom edge 438 of third inner reinforcing corner panel 406 is substantially aligned with angled edge 42 of bottom panel 24, and bottom edge 442 of fourth inner reinforcing corner panel 408 is substantially aligned with angled edge 44 of bottom panel 24. Third inner reinforcing corner panel 406 forms a third corner wall 456 with a pair of corner panels 98 and 102, and fourth inner reinforcing corner panel 408 forms a fourth corner wall 458 with a pair of corner panels 98 and 102. Corner walls 452, 454, 456, and 458 each include three layers of panels, and corner walls 162, 164, 166, and 168 (shown in FIG. 2) each include two layers of panels.

Figure 9:
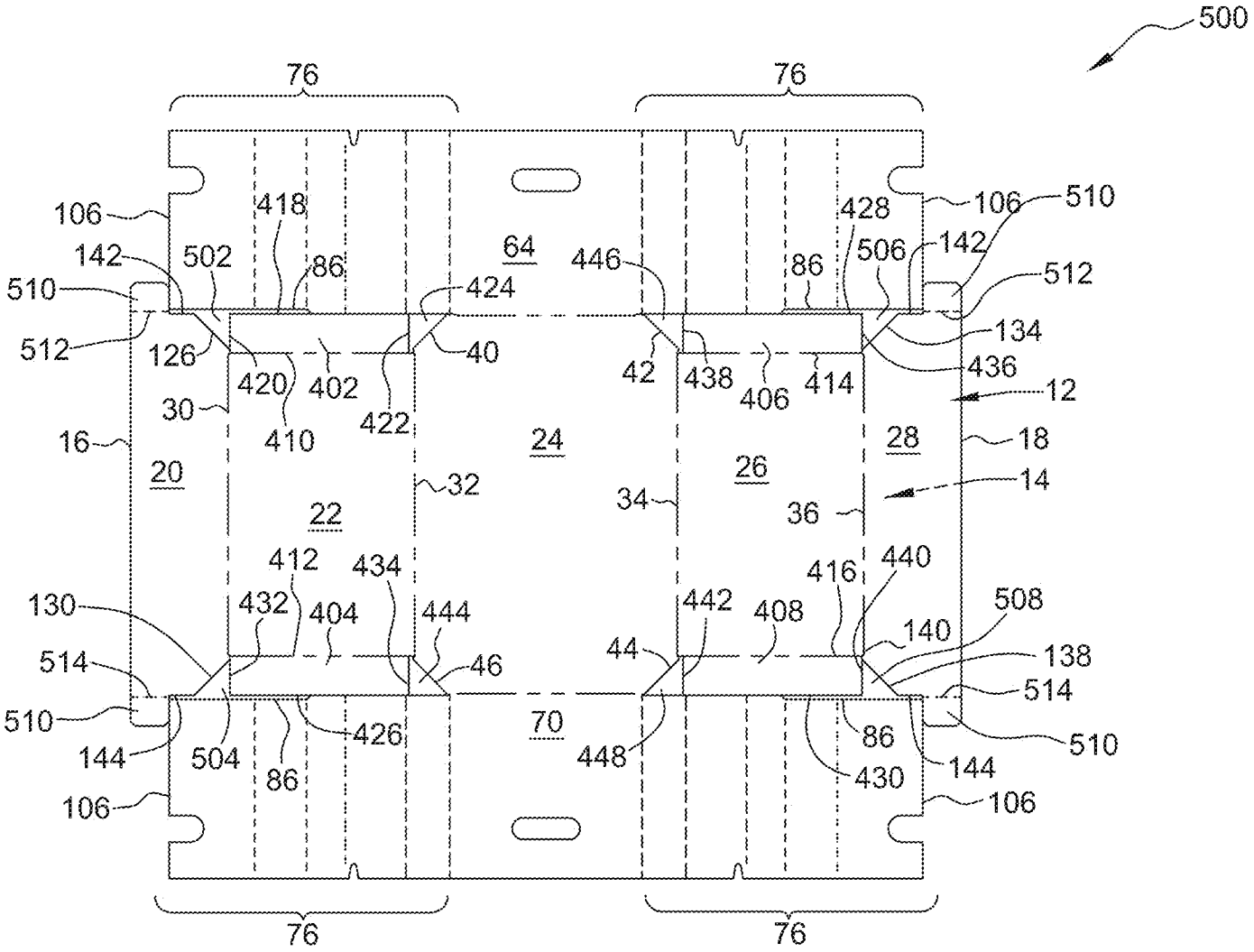
FIG. 9 is a top plan view of a blank of sheet material for constructing a container according to a fourth alternative embodiment of the present disclosure.

FIG. 9 is a top plan view of an example embodiment of a blank 500 of sheet material. Blank 500 is essentially similar to blank 10 (shown in FIG. 1) and blank 400 (shown in FIG. 7) and, as such, similar components are labeled with similar references. More specifically, blank 500 is similar to blank 400 and includes inner reinforcing corner panels 402, 404, 406, and 408, as shown and described with respect to FIG. 7. Further, blank 500 includes fold lines 410, 412, 414, and 416 rather than free side edges 48, 50, 52, and 54 (shown in FIG. 1), as shown and described with respect to FIG. 7. Additionally, blank 500 includes closure flaps 510 extending from first and second top panels 20 and 28.

In the example embodiment, in addition to cutouts 424, 444, 446, and 448, blank 500 includes cutouts 502, 504, 506, and 508. More specifically, angled edge 126, top edge 420, and bottom edge 86 at least partially define a first cutout 502; angled edge 130, top edge 432, and bottom edge 86 at least partially define a second cutout 504; angled edge 134, top edge 436, and bottom edge 86 at least partially define a third cutout 506; and angled edge 138, top edge 440, and bottom edge 86 at least partially define a fourth cutout 508. In addition, first and second top panels 20 and 28 each include opposing closure flaps 510 extending from opposing fold lines 512 and 514.

Figure 10:
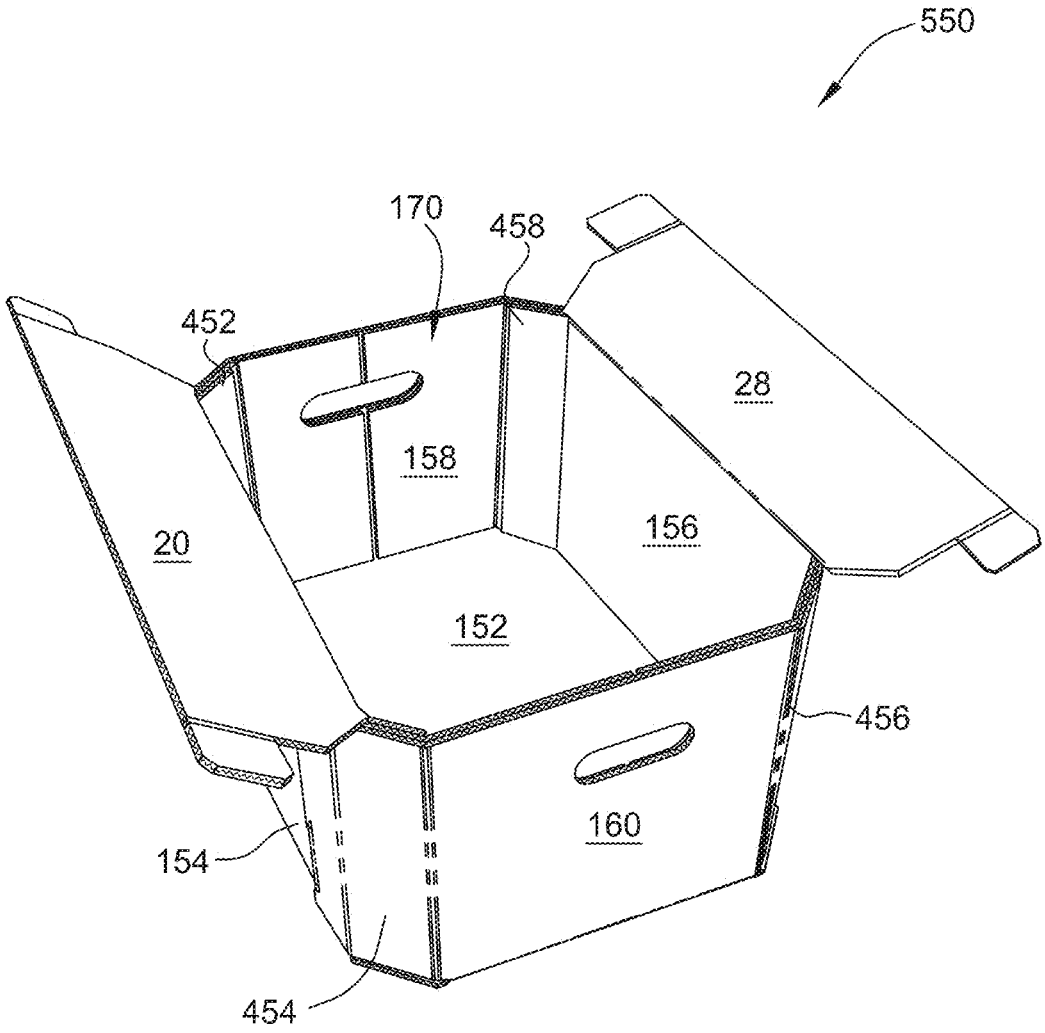
FIG. 10 is a perspective view of a container that is partially formed from the blank shown in FIG. 9.
Figure 11:
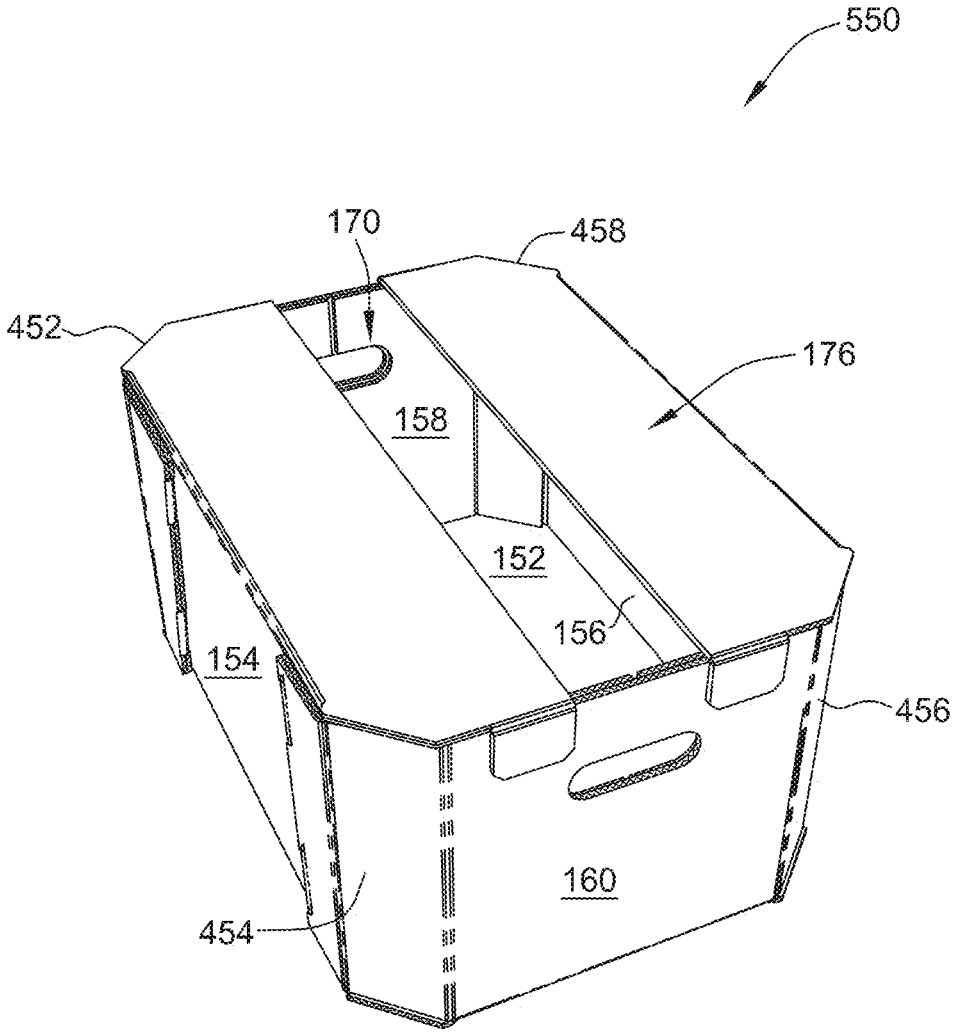
FIG. 11 is a perspective view of a container formed from the blank shown in FIG. 9.

FIG. 10 is a perspective view of a container 550 that is partially formed from blank 500 (shown in FIG. 9). FIG. 11 is a perspective view of container 550 formed from blank 500. Container 550 is essentially similar to container 150 (shown in FIG. 2) and container 450 (shown in FIG. 8) and, as such, similar components are labeled with similar references. Although container 550 is shown as being formed without a product to be contained therein, container 550 may also be formed having a product therein. Further, container 550 may include any suitable number of products of any suitable shape.

To construct container 550 from blank 500 a method that is substantially similar to the method for forming container 450 from blank 400 is used. To close container 550, top wall 176 is formed using the method used to construct container 150 from blank 10. In addition, in the example embodiment, closure flaps 510 are rotated toward exterior surface 14 of first and second end panels 64 and 70 and are secured thereto. In the example embodiment, interior surface 12 of each closure flap 510 is adhered to exterior surface 14 of end panels 64 or 70.

Figure 12:
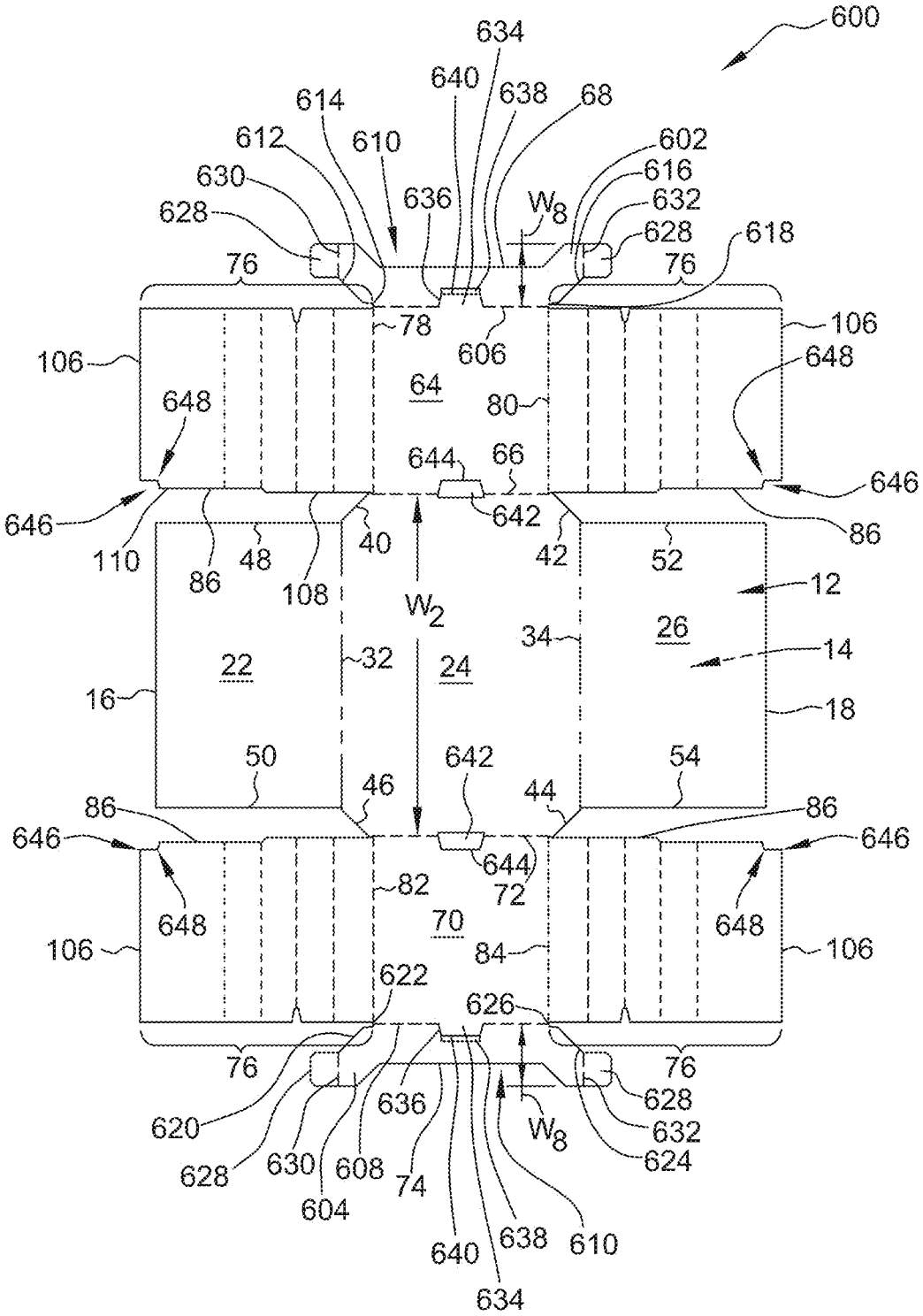
FIG. 12 is a top plan view of a blank of sheet material for constructing a container according to a fifth alternative embodiment of the present disclosure.

FIG. 12 is a top plan view of an example embodiment of a blank 600 of sheet material. Blank 600 is essentially similar to blank 300 (shown in FIG. 5) and, as such, similar components are labeled with similar references. More specifically, blank 600 includes top panels 602 and 604. Further, blank 600 includes fold lines 606 and 608 at top edges of end panels 64 and 70, respectively, rather than free edge 68 and free edge 74 (shown in FIG. 5) defining top edges of end panels 64 and 70, respectively. Moreover, blank 600 does not include cutouts 38 and 302 (shown in FIG. 5), however, it will be understood that blank 600 may include cutouts 38 and/or 302.

In the example embodiment, blank 600 includes, in series from free edge 68 to free edge 74, a first top panel 602, end panel 64, bottom panel 24, end panel 70, and a second top panel 604 coupled together along preformed, generally parallel, fold lines 606, 66, 72, and 608, respectively. More specifically, first top panel 602 extends between free edge 68 and fold line 606, and second top panel 604 extends from end panel 70 along fold line 608 to free edge 74. When a container 650 (shown in FIG. 13) is formed from blank 600, fold line 606 defines a side edge of top panel 602 and a top edge of end panel 64, and fold line 608 defines a side edge of top panel 604 and a top edge of end panel 70.

In the example embodiment, first top panel 602 and second top panel 604 are substantially congruent and have a trapezoidal shape with a cutout portion 610 defined along free edges 68 and 74, respectively. Cutout portion 610 has any suitable configuration that enables blank 600 and/or container 650 to function as described herein. In one embodiment, cutout portion 610 is configured to enable access to cavity 170 (shown in FIG. 13) of container 650. Alternatively, top panel 602 and/or 604 does not include cutout portion 610. In the example embodiment, first top panel 602 includes an angled edge 612 extending outwardly from an intersection 614 of fold line 606 and fold line 78 and an angled edge 616 extending outwardly from an intersection 618 of fold line 606 and fold line 80. Similarly, second top panel 604 includes an angled edge 620 extending outwardly from an intersection 622 of fold line 608 and fold line 82 and an angled edge 624 extending outwardly from an intersection 626 of fold line 608 and fold line 84. Angled edges 612, 616, 620, and 624 are configured similarly to angled edges 40, 42, 44, and 46, respectively.

In addition, first and second top panels 602 and 604 have a width $W_8$ that is smaller than half of width $W_2$. More specifically, top panels 602 and 604 each have width $W_8$ such that each top panel 602 and 604 forms a top shoulder 652 and 654 (shown in FIG. 13), respectively, when container 650 is formed from blank 600. In an alternative embodiment, width $W_8$ is substantially equal to or larger than half of width $W_2$. Alternatively, width We is sized to form a partial top wall. In the example embodiment, top panels 602 and 604 are equally dimensioned, however, top panels 602 and 604 may be other than equally dimensioned. Further, first and second top panels 602 and 604 each have a pair of opposing closure flaps 628 that extend from a first fold line 630 and a second fold line 632 of each of first and second top panels 602 and 604.

In the example embodiment, fold line 606 and fold line 608 each include a tab 634 defined therein. More specifically, a cut line 636 divides each fold line 606 and 608 to form tab 634. Further, a slot 638 defined in each top panel 602 and 604 defines a top 640 of each tab 634. Alternatively, fold line 606 and/or fold line 608 does not include tab 634 and/or top panel 602 and/or top panel 604 does not include slot 638. Moreover, it will be understood that tab 634 and/or slot 638 may be included in any of the embodiments described herein. For example, tab 634 may extend from free edge 68 and/or free edge 74 in any embodiment including such free edges. Further, tab 634 may extend from leading edge 16, trailing edge 18, fold line 30, and/or fold line 36 of the embodiments described herein.

In the example embodiment, fold line 66 and fold line 72 each include a cutout 642 defined therein. More specifically, a cut line 644 divides each fold line 66 and 72 and defines cutout 642. Cutout 642 may have any suitable configuration that enables blank 600 and/or container 650 to function as described herein. In one embodiment, cutout 642 is sized to receive tab 634 for stacking containers 650 and/or to provide venting for cavity 170. Alternatively, fold line 66 and/or fold line 72 does not include cutout 642. Moreover, it will be understood that cutout 642 may be included in any of the embodiments described herein. For example, cutout 642 may be defined in fold lines 32, 34, 66 and/or 72 of the embodiments described herein.

Further, in the example embodiment, each inner end panel 92 includes a notch 646 defined in a lower free corner 648 thereof. More specifically, notch 646 is defined at corner 648 defined by free edge 106 and inner bottom edge 110 on each inner end panel 92. Notch 646 is configured to correspond to a portion of cutout 642 such that cutout 642 is not obstructed by inner end panels 92 when container 650 is formed. In an alternative embodiment, notch 646 may have any suitable configuration that enables blank 600 and/or container 650 to function as described herein. Alternatively, at least one inner end panel 92 does not include notch 646. Moreover, it will be understood that notch 646 may be included in any of the embodiments described herein on any suitable panel.

Figure 13:
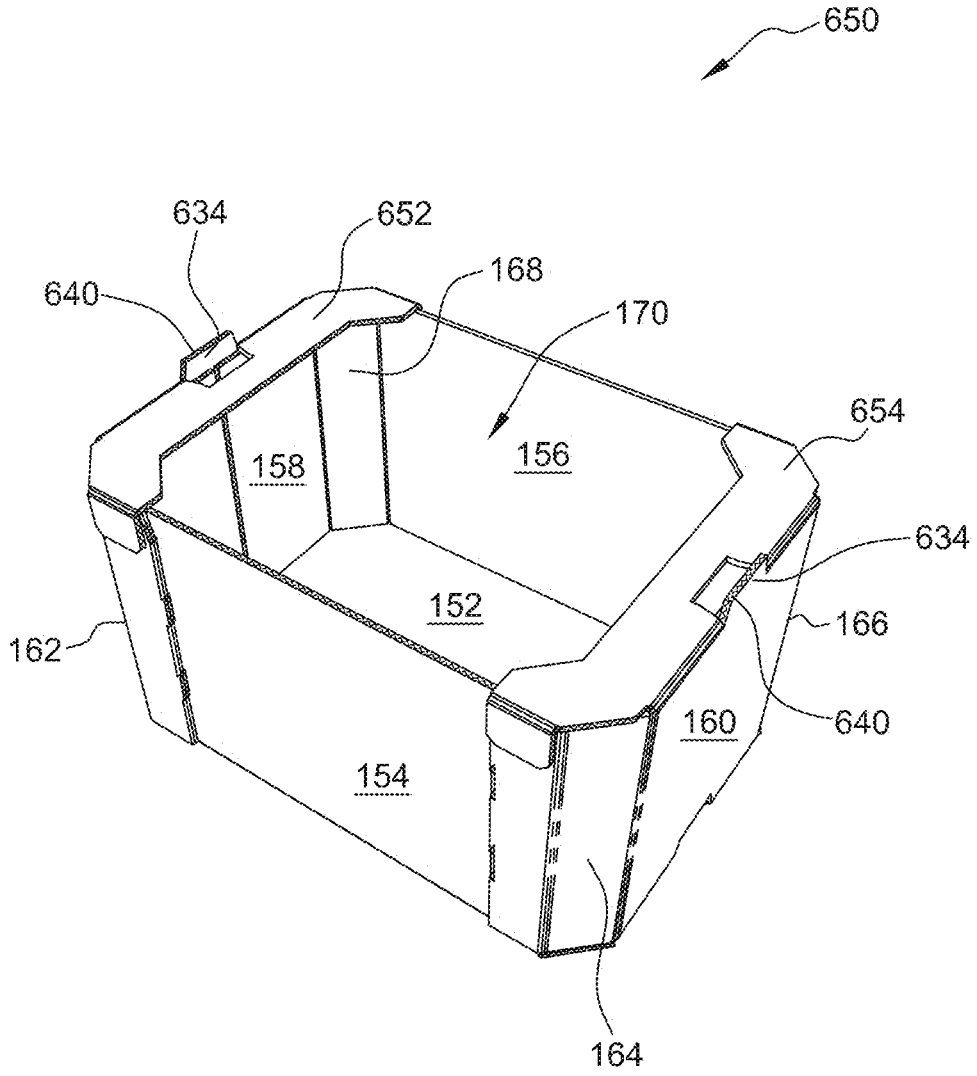
FIG. 13 is a perspective view of a container formed from the blank shown in FIG. 12.

FIG. 13 is a perspective view of container 650 that is formed from blank 600 (shown in FIG. 12). Container 650 is essentially similar to container 350 (shown in FIG. 6) and, as such, similar components are labeled with similar references. Although container 650 is shown as being formed without a product to be contained therein, container 650 may also be formed having a product therein. Further, container 650 may include any suitable number of products of any suitable shape. To construct container 650 from blank 600 a method that is substantially similar to the method for forming container 350 from blank 300 is used. By forming top shoulders 652 and 654 of container 650, container 650 is considered to be in the closed configuration rather than the open configuration of containers 350.

To close container 650 and form top shoulders 652 and 654, first top panel 602 is rotated about fold line 606 toward cavity 170 such that first top panel 602 is substantially perpendicular to first end wall 158 and substantially parallel to bottom wall 152. Further, second top panel 604 is rotated about fold line 608 toward cavity 170 such that second top panel 604 is substantially perpendicular to second end wall 160 and substantially parallel to bottom wall 152. Closure flaps 628 are then rotated toward exterior surface 14 of a respective first reinforcing side panel 100 and are secured thereto to form portions of first side wall 154 and second side wall 156, respectively. In the example embodiment, interior surface 12 of each closure flap 628 is adhered to exterior surface 14 of a respective first reinforcing side panel 100. First and second top panels 602 and 604 form top shoulders 652 and 654 of container 650.

Figure 14:
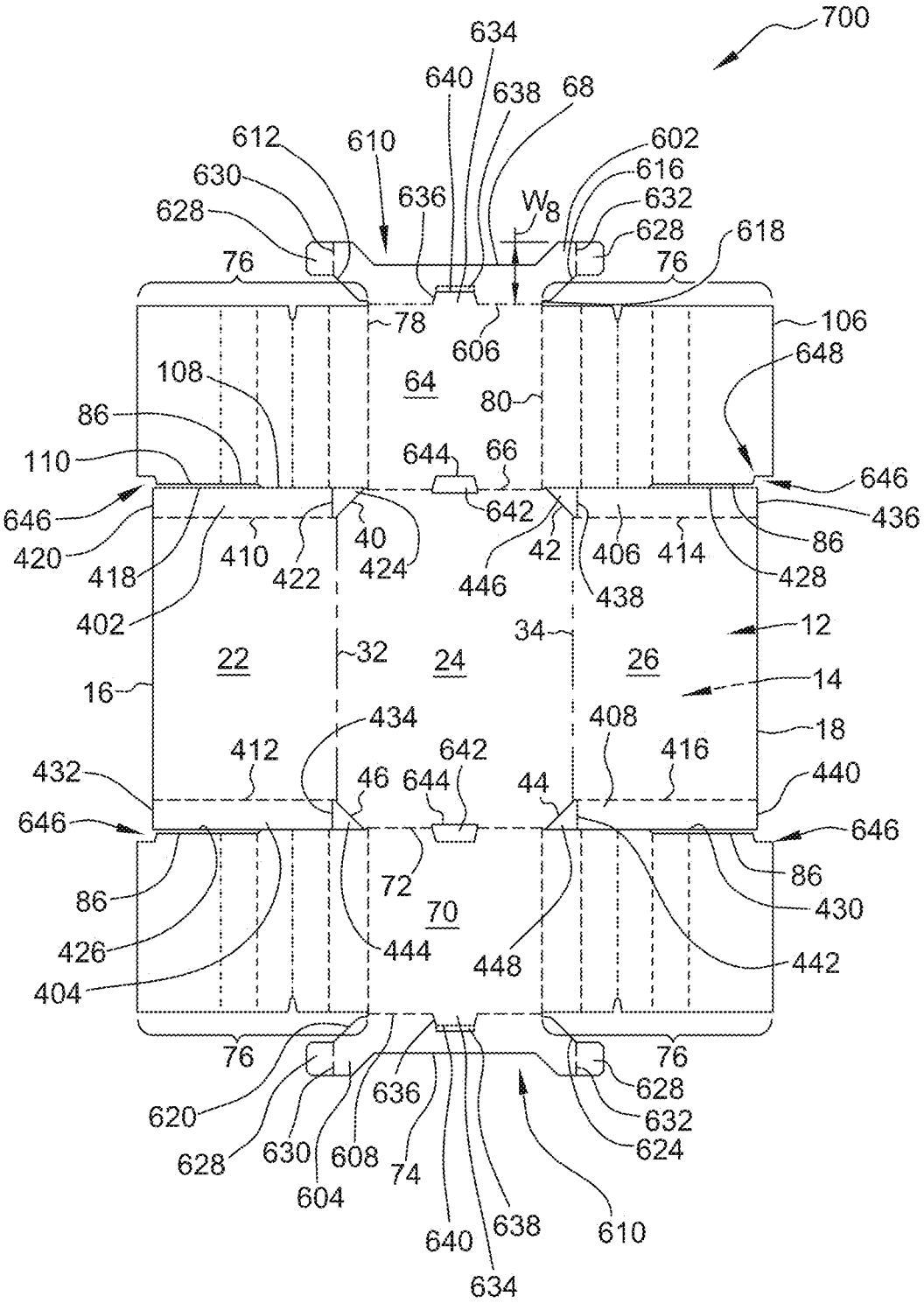
FIG. 14 is a top plan view of a blank of sheet material for constructing a container according to a sixth alternative embodiment of the present disclosure.

FIG. 14 is a top plan view of an example embodiment of a blank 700 of sheet material. Blank 700 is essentially similar to blank 400 (shown in FIG. 7) and blank 600 (shown in FIG. 12) and, as such, similar components are labeled with similar references. More specifically, blank 700 is similar to blank 600 and includes inner reinforcing corner panels 402, 404, 406, and 408, as shown and described with respect to FIG. 7. Further, blank 700 includes fold lines 410, 412, 414, and 416 rather than free side edges 48, 50, 52, and 54 (shown in FIG. 12), as shown and described with respect to FIG. 7.

Figure 15:
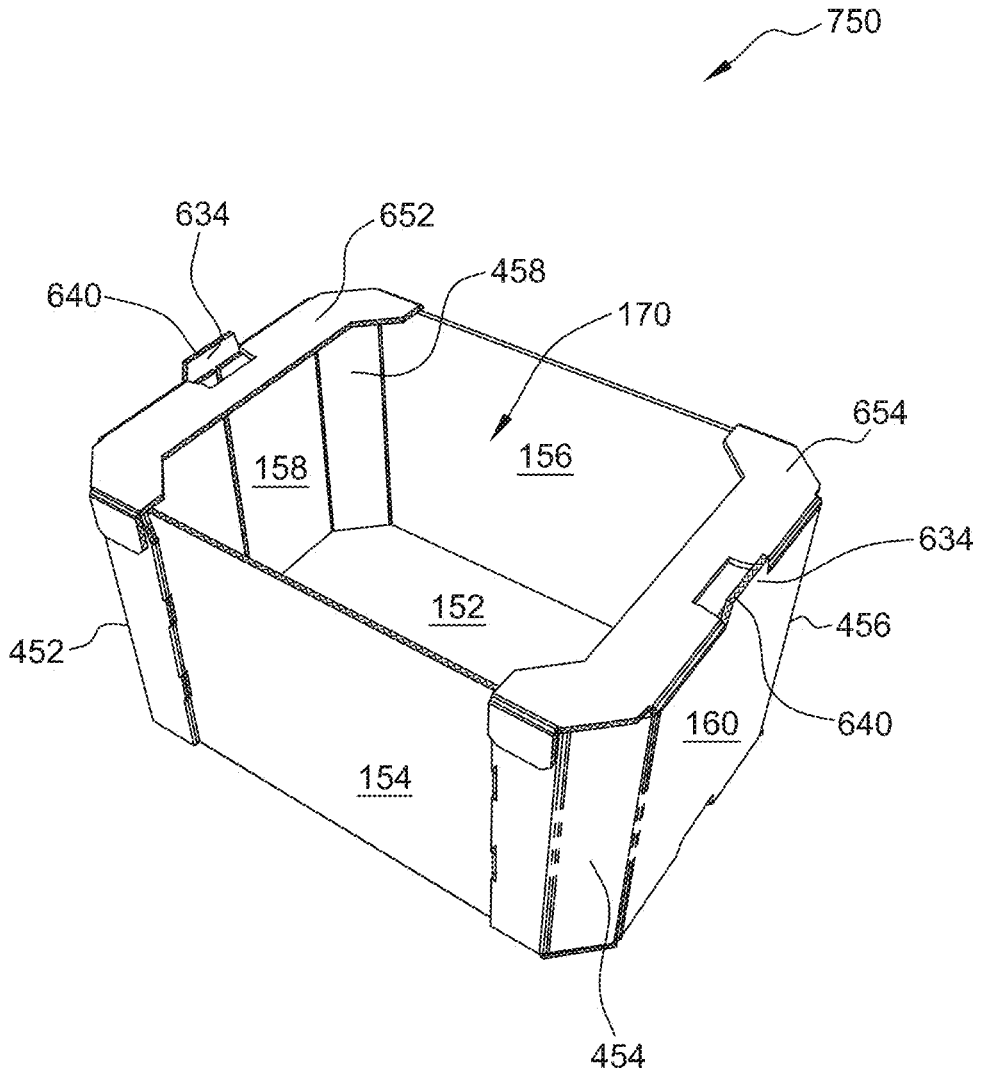
FIG. 15 is a perspective view of a container formed from the blank shown in FIG. 14.

FIG. 15 is a perspective view of a container 750 formed from blank 700 (shown in FIG. 14). Container 750 is essentially similar to container 450 (shown in FIG. 8) and container 650 (shown in FIG. 13) and, as such, similar components are labeled with similar references. Although container 750 is shown as being formed without a product to be contained therein, container 750 may also be formed having a product therein. Further, container 750 may include any suitable number of products of any suitable shape. To construct container 750 from blank 700 a method that is substantially similar to the method for forming container 450 from blank 400 is used. To close container 750, top shoulders 652 and 654 are formed using the method used to construct container 650 from blank 600.

Figure 16:
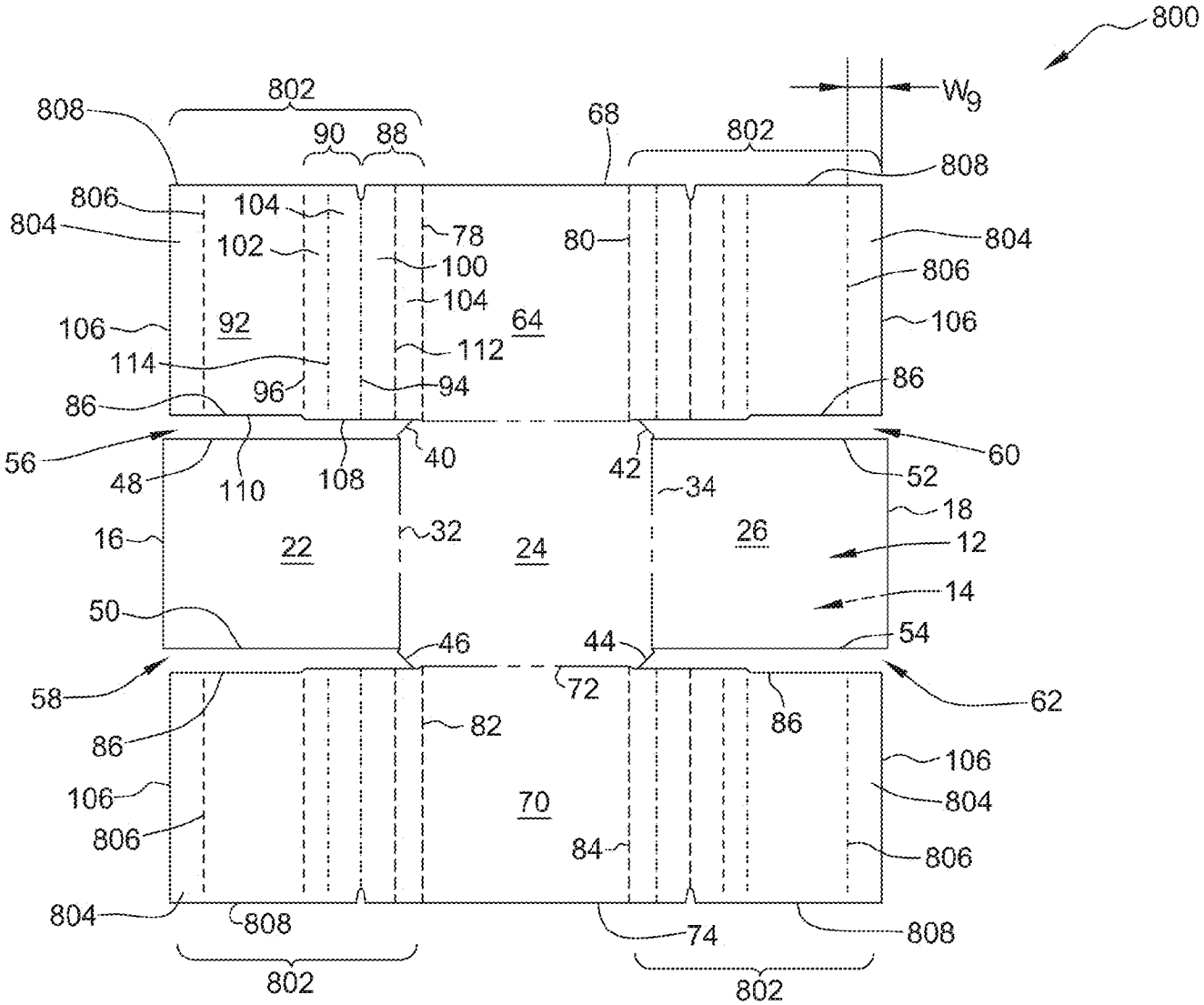
FIG. 16 is a top plan view of a blank of sheet material for constructing a container according to a seventh alternative embodiment of the present disclosure.
Figure 17:
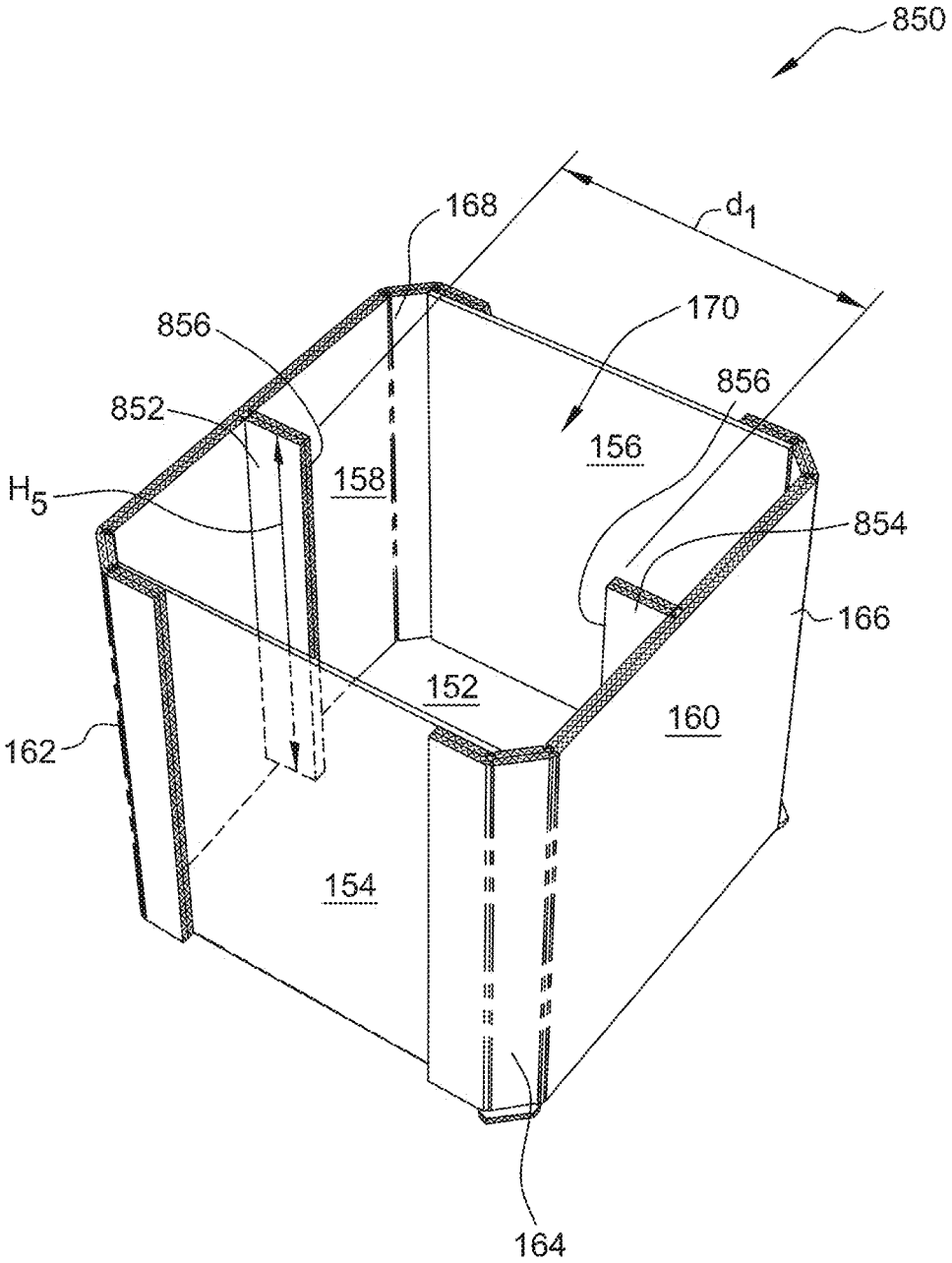
FIG. 17 is a perspective view of a container formed from the blank shown in FIG. 16.

FIG. 16 is a top plan view of an example embodiment of a blank 800 of sheet material for forming a container 850 (shown in FIG. 17). Blank 800 is essentially similar to blank 300 (shown in FIG. 5) and, as such, similar components are labeled with similar references. More specifically, blank 800 includes reinforcing panels 802 that each include a support panel 804. Moreover, blank 800 does not include cutouts 38 and 302, however, it will be understood that blank 800 may include cutouts 38 and/or 302 on end panels 64 and/or 70, first side panel 22, and/or second side panel 26. Further, in an alternative embodiment, blank 800 includes top panels 20 and 28, as shown as described with respect to FIG. 1, and/or top panels 602 and 604, as shown and described with respect to FIG. 12.

In the example embodiment, blank 800 includes a reinforcing panel 802 that extends from each side edge of end panels 64 and 70. Reinforcing panel 802 is also referred to herein as a reinforcing panel assembly that includes a plurality of panels as described in more detail herein. More specifically, a reinforcing panel assembly 802 extends from each of fold lines 78, 80, 82, and 84. Further, each reinforcing panel assembly 802 includes free bottom edge 86. Bottom edge 86 includes an outer bottom edge 108 and an inner bottom edge 110 which is offset from outer bottom edge 108. Each free bottom edge 86 at least partially defines cutouts 56, 58, 60, and 62. Moreover, each reinforcing panel assembly 802 is substantially similar and includes, in series from a fold line 78, 80, 82, or 84 to free edge 106, outer reinforcing panel assembly 88, inner reinforcing panel assembly 90, inner end panel 92, and support panel 804, connected along substantially parallel fold lines 94, 96, and 806. Fold line 806 defines a side edge of inner end panel 92 and a side edge of support panel 804, and free edge 106 defines a side edge of support panel 804.

Outer reinforcing panel assembly 88 includes corner panel 98 and first reinforcing side panel 100, and inner reinforcing panel assembly 90 includes reinforcing corner panel 102 and second reinforcing side panel 104. More specifically, support panel 804 extends between free edge 106 and fold line 806, inner end panel 92 extends from support panel 804 along fold line 806, reinforcing corner panel 102 extends from inner end panel 92 along fold line 96, second reinforcing side panel 104 extends from reinforcing corner panel 102 along fold line 114, first reinforcing side panel 100 extends from second reinforcing side panel 104 along fold line 94, and corner panel 98 extends from first reinforcing side panel 100 along fold line 112 to a respective fold line 78, 80, 82, or 84.

In the example embodiment, each support panel 804 is substantially rectangularly shaped, although it will be understood that support panel 804 may have any suitable shape and/or configuration that enables blank 800 and/or container 850 to function as described in herein. Further, in the example embodiment, support panel 804 has a width $W_9$ that is substantially constant from a top edge 808 of reinforcing panel assembly 802 to bottom edge 86. Alternatively, width $W_9$ may be other than constant between top edge 808 and bottom edge 86. In the example embodiment, width $W_9$ is less than half of width $W_2$ of bottom panel 24. Alternatively, width $W_9$ is equal to or greater than half of width $W_2$ such that support walls 852 and 854 (shown in FIG. 17) formed from support panels 804 divide container 850 and provide support to container 850. In the example embodiment, each support panel 804 includes the same width $W_9$. In an alternative embodiment, at least one support panel 804 includes a width that is different than width $W_9$ of other support panels 804.

FIG. 17 is a perspective view of container 850 that is formed from blank 800 (shown in FIG. 16). Container 850 is essentially similar to container 350 (shown in FIG. 6) and, as such, similar components are labeled with similar references. Although container 850 is shown as being formed without a product to be contained therein, container 850 may also be formed having a product therein. Further, container 850 may include any suitable number of products of any suitable shape. To construct container 850 from blank 800 a method that is substantially similar to the method for forming container 350 from blank 300 is used except support walls 852 and 854 are formed. In the example embodiment, container 850 has an open configuration, however, it will be understood that container 850 may include a top wall and be in a closed configuration.

To construct container 850 from blank 800, each inner end panel 92 and respective inner reinforcing panel assembly 90 are folded about fold line 94 such that inner reinforcing panel assembly 90 and outer reinforcing panel assembly 88 are in an at least partially overlying relationship, and such that inner end panel 92 is in an at least partially overlying relationship with at least a portion of first or second end panel 64 or 70. More specifically, blank 800 is folded along fold line 94 such that corner panel 98 and reinforcing corner panel 102 are substantially aligned in an at least partially overlying relationship, first and second reinforcing side panels 100 and 104 are substantially aligned in an at least partially overlying relationship, and inner end panel 92 and at least a portion of first or second end panel 64 or 70 are substantially aligned in an at least partially overlying relationship. As blank 800 is being folded about fold line 94, support panels 804 are folded about fold lines 806 such that exterior surface 14 of support panel 804 is rotated towards exterior surface 14 of inner end panel 92. Alternatively, support panels 804 are rotated about fold lines 806 before or after blank 800 is folded about fold line 94. In the example embodiment, after blank 800 is folded about fold lines 94 and 806, one support panel 804 is aligned in at least partially overlying relationship with another support panel 804 such that interior surfaces 12 of support panels 804 are adjacent to each other.

In the example embodiment, inner end panel 92, a respective end panel 64 or 70, reinforcing side panels 100 and 104, corner panels 98 and 102 and/or support panels 804 are secured in the above-described relationships. For example, inner end panel 92, a respective end panel 64 or 70, reinforcing side panels 100 and 104, corner panels 98 and 102 and/or support panels 804 are held against the product to be contained by a force on exterior surface 14 as container 850 continues to be erected. In another example, inner end panel 92 may be adhered to a respective end panel 64 or 70, reinforcing side panels 100 and 104 may be adhered together, corner panels 98 and 102 may be adhered together, and/or support panels 804 may be adhered together. Reinforcing panel assemblies 88 and 90 and reinforcing side panels 100 and 104 are rotated about fold lines 78, 80, 82, 84, 96, 112 and/or 114 as described with respect to container 350. Further, the remainder of container 850 is constructed similarly to container 350.

When container 850 is formed, support panels 804 form a first support wall 852 and a second support wall 854 extending into cavity 170. More specifically, first support wall 852 extends from first end wall 158, and second support wall 854 extends from second end wall 160. In the example embodiment, support panels 804 forming each support wall 852 and 854 are in contact with each other along a height $H_5$ of each support wall 852 and 854. Alternatively, a gap may be defined between support panels 804 forming support wall 852 and/or 854 along at least a portion of height $H_5$. Further, in the example embodiment, support wall 852 is separated from support wall 854 by a distance $d_1$. Alternatively, support walls 852 and 854 are in contact along at least a portion of an inner edge 856 of each support wall 852 and 854. In an alternative embodiment, at least a portion of support wall 852 overlaps support wall 854.

Figure 18:
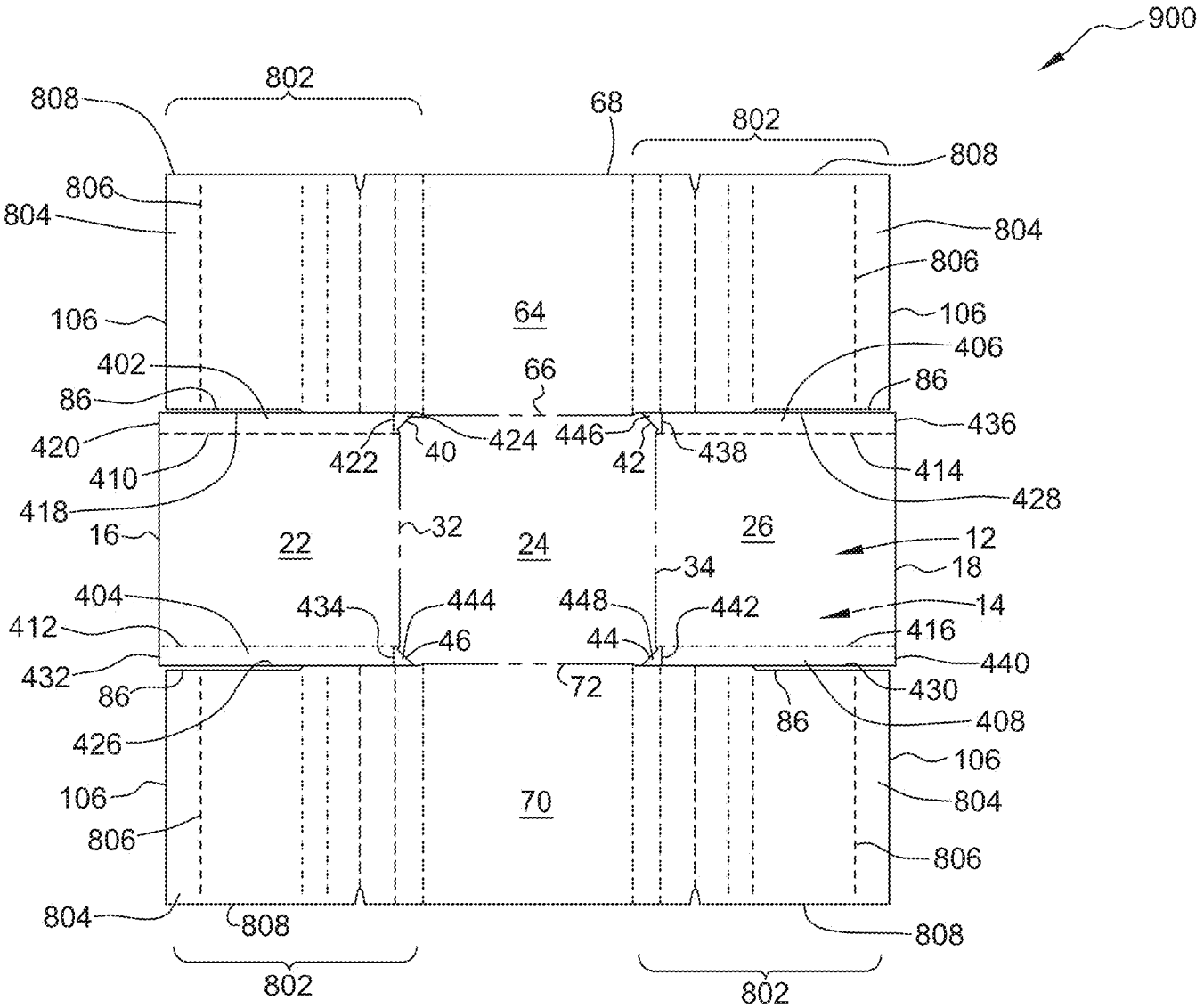
FIG. 18 is a top plan view of a blank of sheet material for constructing a container according to an eighth alternative embodiment of the present disclosure.

FIG. 18 is a top plan view of an example embodiment of a blank 900 of sheet material. Blank 900 is essentially similar to blank 400 (shown in FIG. 7) and blank 800 (shown in FIG. 16) and, as such, similar components are labeled with similar references. More specifically, blank 900 is similar to blank 400 and includes inner reinforcing corner panels 402, 404, 406, and 408, as shown and described with respect to FIG. 7. Further, blank 900 includes fold lines 410, 412, 414, and 416 rather than free side edges 48, 50, 52, and 54 (shown in FIG. 16), as shown and described with respect to FIG. 7. Further, blank 900 includes reinforcing panel assemblies 802, as shown and described with reference to FIG. 16.

In the example embodiment, blank 900 does not include cutouts 38 and 302 (shown in FIG. 7), however, it will be understood that blank 900 may include cutouts 38 and/or 302 on end panels 64 and/or 70, first side panel 22, and/or second side panel 26. Further, in an alternative embodiment, blank 900 includes top panels 20 and 28, as shown as described with respect to FIG. 1, and/or top panels 602 and 604, as shown and described with respect to FIG. 12.

Figure 19:
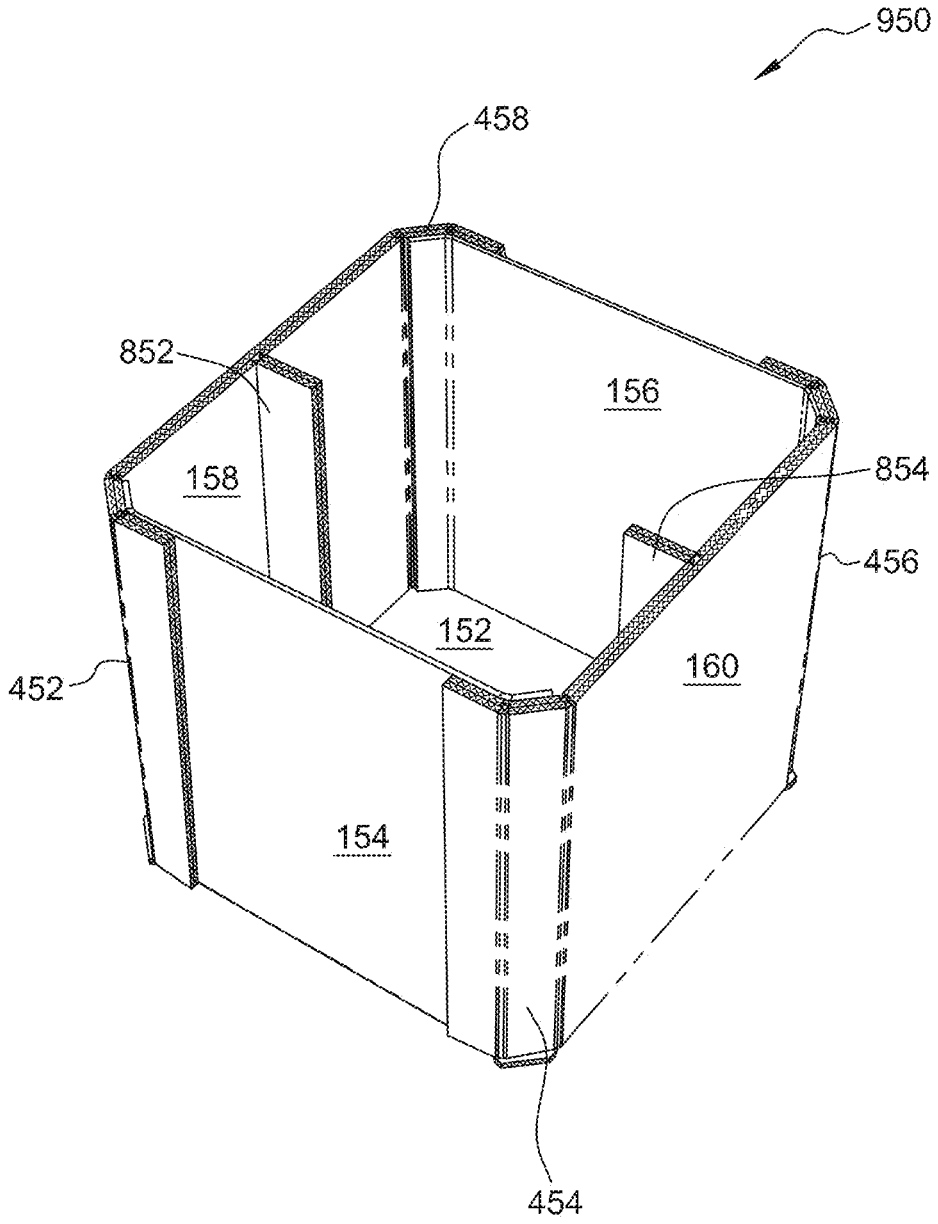
FIG. 19 is a perspective view of a container formed from the blank shown in FIG. 18.

FIG. 19 is a perspective view of a container 950 formed from blank 900 (shown in FIG. 18). Container 950 is essentially similar to container 450 (shown in FIG. 8) and container 850 (shown in FIG. 17) and, as such, similar components are labeled with similar references. Although container 950 is shown as being formed without a product to be contained therein, container 950 may also be formed having a product therein. Further, container 950 may include any suitable number of products of any suitable shape. To construct container 950 from blank 900, a method that is substantially similar to the methods for forming container 450 and container 850 are used.

Figure 20:
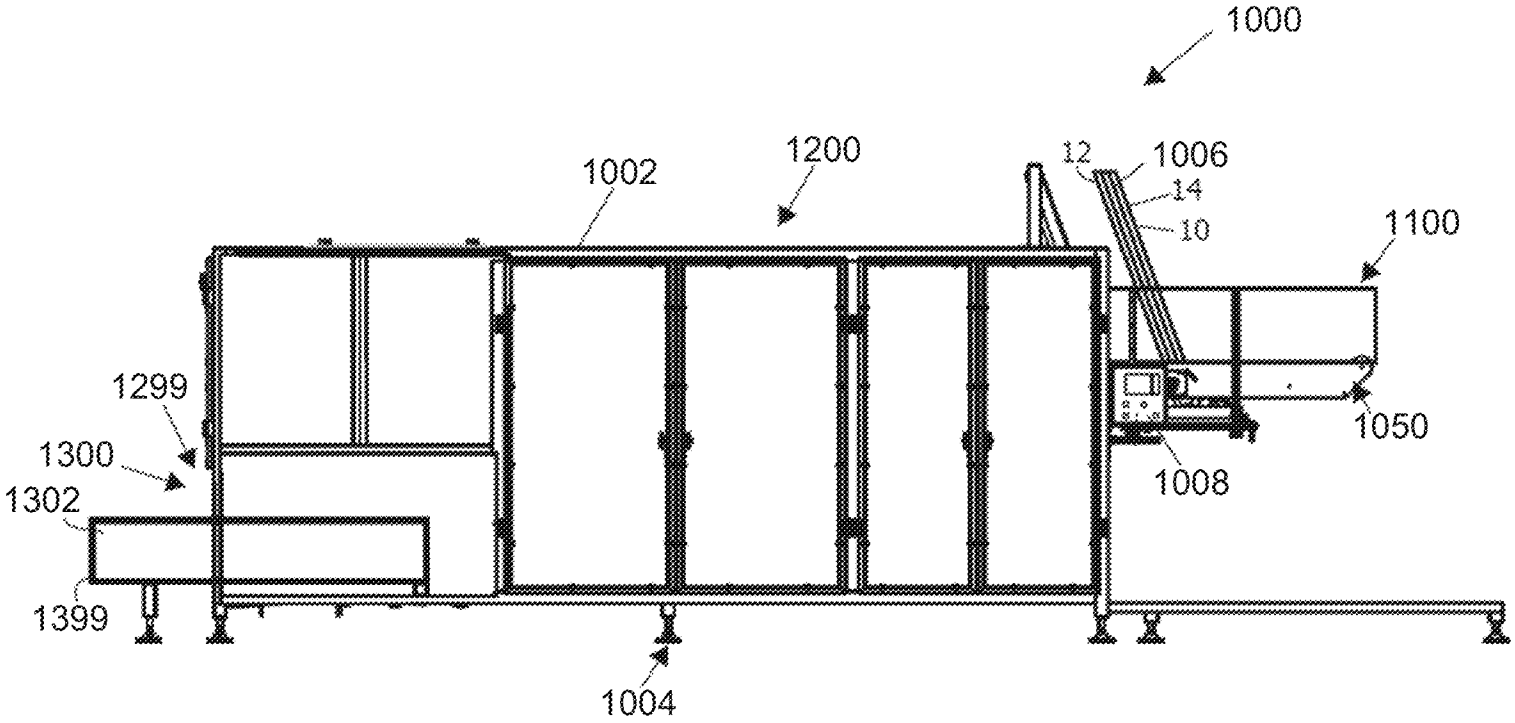
FIG. 20 is a side view of a machine for forming a container from a blank.
Figure 21:
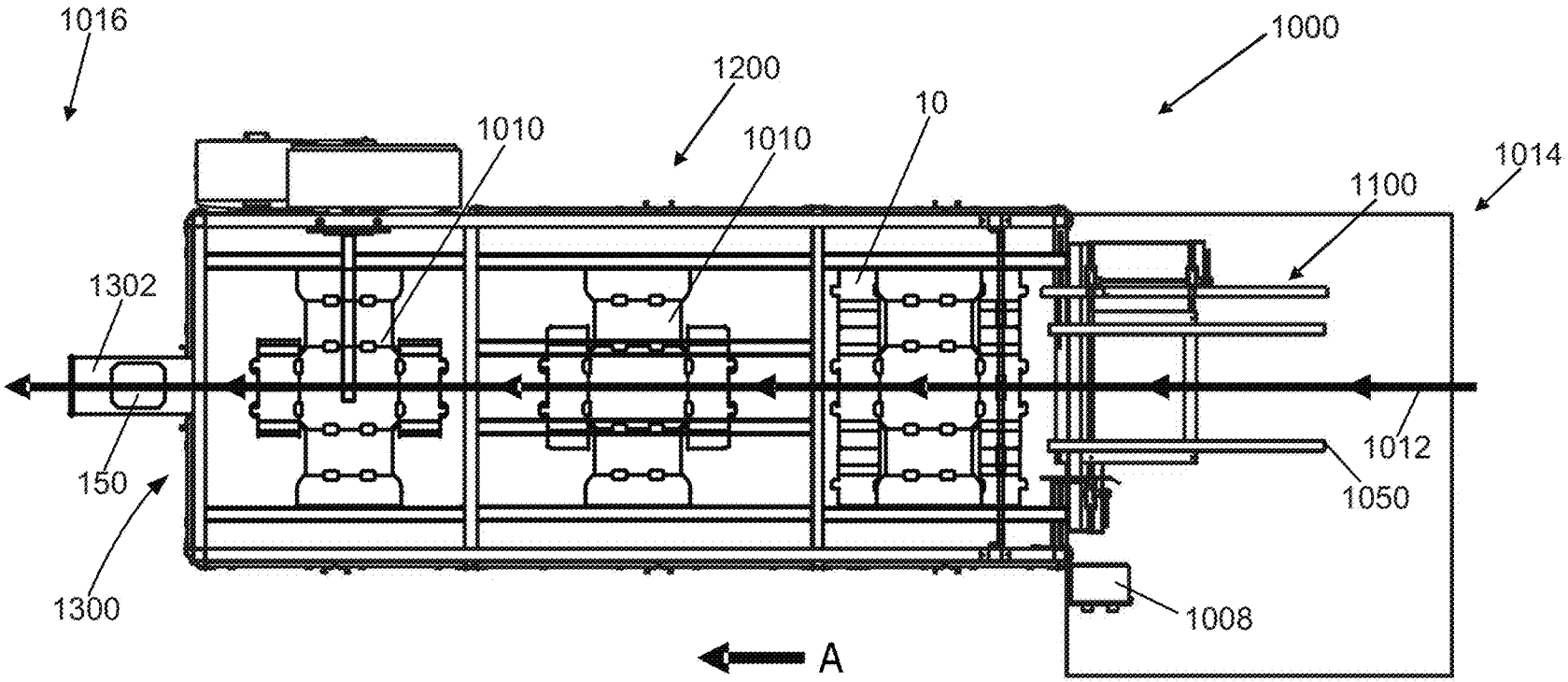
FIG. 21 is a top view of the machine shown in FIG. 20.

FIG. 20 is a side view of a machine 1000 for forming a container from a blank. FIG. 21 is a top view of machine 1000. Various blanks are illustrated as being formed into containers using machine 1000. It will be understood that any of the above-described blanks can be formed into a respective container using machine 1000. However, for clarity, the blanks illustrated as being formed into containers by machine 1000 are labeled with reference number 10 throughout FIGS. 20-42, although the blanks illustrated in at least some of FIGS. 20-42 may not be identical to blank 10 (shown in FIG. 1). Similarly, the containers illustrated as being formed by machine 1000 in FIGS. 20-42 are labeled with reference number 150, although the containers illustrated in at least some of FIGS. 20-42 may not be identical to container 150 (shown in FIG. 2). As used herein, the terms "downward," "down," and variations thereof refer to a direction from a top 1002 of machine 1000 toward a surface or floor 1004 on which machine 1000 is supported, and the terms "upward," "up," and variations thereof refer to a direction from floor 1004 on which machine 1000 is supported toward top 1002 of machine 1000. Further, as used herein, "operational control communication" refers to a link, such as a conductor, a wire, and/or a data link, between two or more components of machine 1000 that enables signals, electric currents, and/or commands to be communicated between the two or more components. The link is configured to enable one component to control an operation of another component of machine 1000 using the communicated signals, electric currents, and/or commands.

In the example embodiment, machine 1000 includes a hopper station 1100, a forming station 1200, and an ejection station 1300. More specifically, hopper station 1100, forming station 1200, and ejection station 1300 are connected by a transport system 1050, such as any suitable conveyor(s) and/or motorized device(s) configured to move blank 10 and/or container 150 through machine 1000. In the example embodiment, hopper station 1100 is configured to store a stack 1006 of blanks 10 in a substantially vertical orientation. More specifically, blanks 10 are stored with interior surface 12 facing in a downstream direction A of the machine 1000 and exterior surface 14 facing away from the downstream direction A, or in an upstream direction. In alternative embodiments, hopper station 1100 may be configured to store stack 1006 of blanks 10 in a horizontal orientation.

Forming station 1200 is generally aligned with and downstream of hopper station 1100, and includes any suitable number and/or configuration of components, such as plows, arms, actuators, plungers, and/or other devices for forming container 150 from blank 10. In the example embodiment, components of forming station 1200 are in communication with a control system 1008. Control system 1008 is configured to control and/or monitor components of forming station 1200 to form container 150 from blank 10. In the example embodiment, control system 1008 includes computer-readable instructions for performing the methods described herein, and a processor configured to execute the computer-readable instructions. In one embodiment, an operator can select which blank 10, 200, 300, 400, 500, 600, 700, 800, and/or 900 is being manipulated by machine 1000 using control system 1008, and control system 1008 performs the corresponding method using the components of forming station 1200. Control system 1008 is also configured to automatically adjust the positioning of arms, plows, and/or other devices described herein that are used for forming container 150. Thus, when a user selects a container for forming, machine 1000 will automatically adjust its forming elements for the various containers.

In the example embodiment, control system 1008 is shown as being centralized within machine 1000, however control system 1008 may be a distributed system throughout machine 1000, within a building housing machine 1000, and/or at a remote control center. Control system 1008 includes a processor configured to perform the methods and/or steps described herein. Further, many of the other components described herein include a processor. As used herein, the term "processor" is not limited to integrated circuits referred to in the art as a processor, but broadly refers to a controller, a microcontroller, a microcomputer, a programmable logic controller (PLC), an application specific integrated circuit, and other programmable circuits, and these terms are used interchangeably herein. It should be understood that a processor and/or control system can also include memory, input channels, and/or output channels.

In the embodiments described herein, memory may include, without limitation, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, input channels may include, without limitation, sensors and/or computer peripherals associated with an operator interface, such as a mouse and a keyboard. Further, in the example embodiment, output channels may include, without limitation, a control device, an operator interface monitor, and/or a display.

Processors described herein process information transmitted from a plurality of electrical and electronic devices that may include, without limitation, sensors, actuators, compressors, control systems, and/or monitoring devices. Such processors may be physically located in, for example, a control system, a sensor, a monitoring device, a desktop computer, a laptop computer, a PLC cabinet, and/or a distributed control system (DCS) cabinet. RAM and storage devices store and transfer information and instructions to be executed by the processor(s). RAM and storage devices can also be used to store and provide temporary variables, static (i.e., non-changing) information and instructions, or other intermediate information to the processors during execution of instructions by the processor(s). Instructions that are executed may include, without limitation, machine control commands. The execution of sequences of instructions is not limited to any specific combination of hardware circuitry and software instructions.

In the example embodiment, ejection station 1300 is configured to eject container 150 from forming station 1200. More specifically, in the example embodiment, ejection station 1300 includes an exit conveyor 1302 for conveying formed containers from an exit 1299 of forming station 1200 to an end 1399 of exit conveyor 1302. In the example embodiment, exit conveyor 1302 is part of transport system 1050.

During operation of machine 1000 to form container 150 from blank 10, stack 1006 of blanks 10 is placed within hopper station 1100. Transport system 1050 removes one blank 10 from stack 1006 and transfers blank 10 to forming station 1200. Transport system 1050 transfers blank 10 through the components of forming station 1200. The components of forming station 1200 perform the method for forming container 150 from blank 10. Within forming station 1200, blank 10 is folded into a partially formed container 1010. Partially formed container 1010 is formed into container 150 within forming station 1200, and a subsequent blank 10 is transferred from hopper station 1100 into forming station 1200. As such, containers 150 are formed continuously by machine 1000. After container 150 is formed in forming station 1200, transport system 1050 transfers container 150 to ejection station 1300 for ejection from machine 1000.

FIGS. 22-42 show perspective views of machine 1000. Arrow A shows a direction of movement of blank 10 and/or container 150 through machine 1000. Further, the head of arrow A indicates a "downstream" or "forward" direction and the tail of arrow A indicates an "upstream" or "backward" direction. The term "front" as used herein with respect to movement through machine 1000 refers to the downstream end of blank 10, and the term "rear" as used herein with respect to movement through machine 1000 refers to the upstream end of blank 10.

Figure 22:
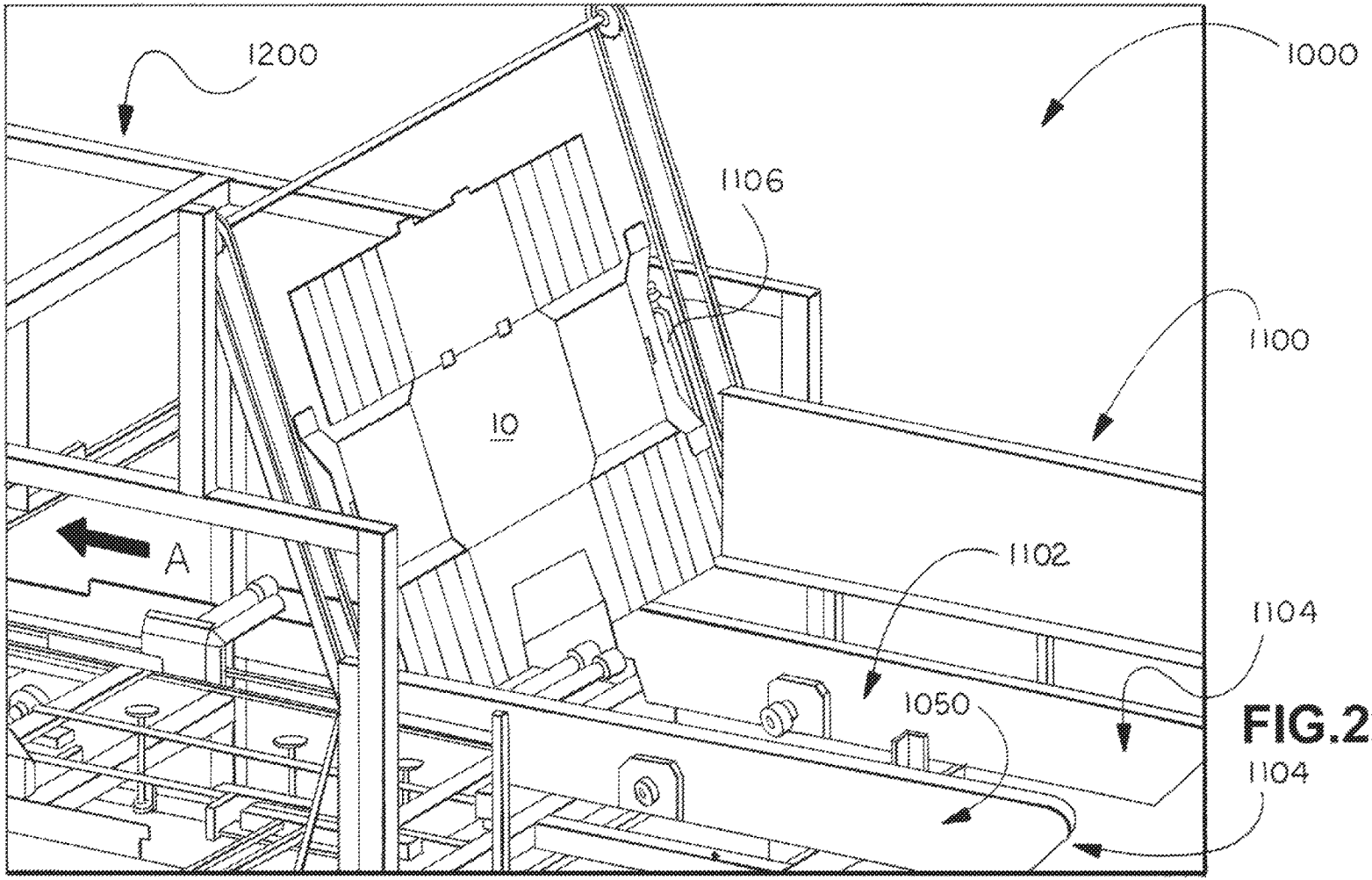
FIG. 22 is a perspective view of a hopper station of the machine shown in FIGS. 20 and 21.
Figure 23:
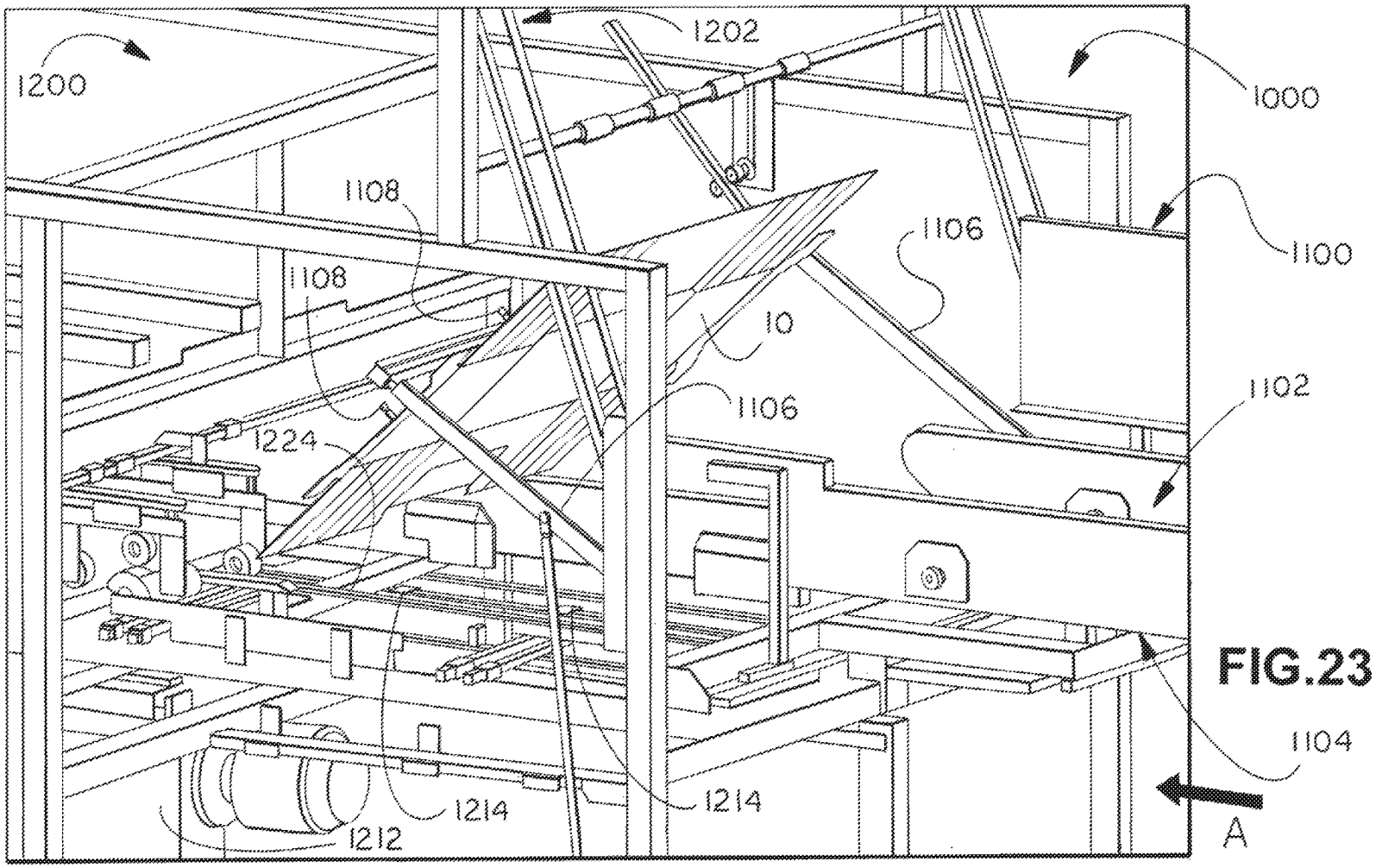
FIG. 23 is perspective view of the hopper station shown in FIG. 22 and a forming station of the machine shown in FIGS. 20 and 21.
Figure 24:
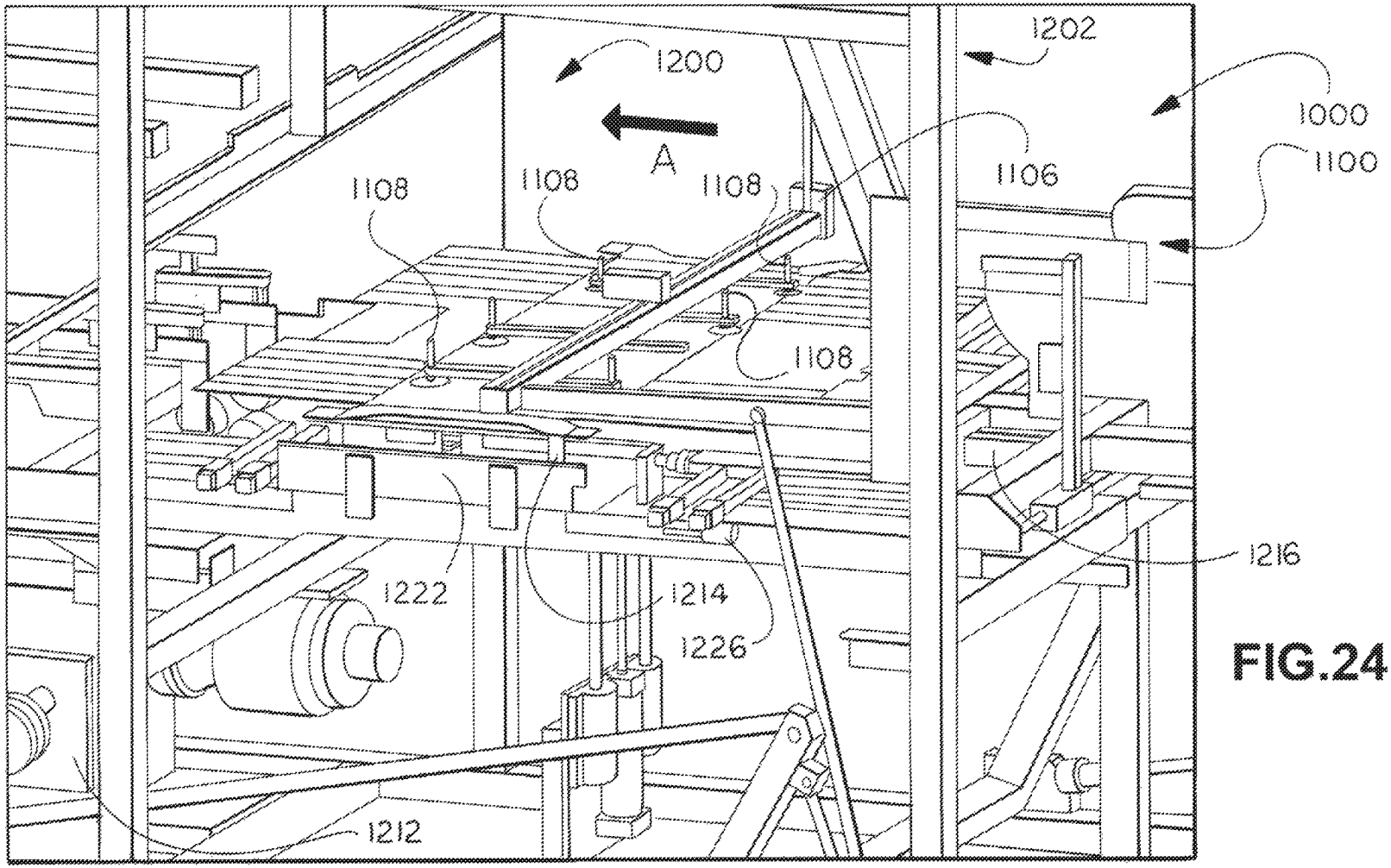
FIG. 24 is another perspective view of the forming station of the machine shown in FIGS. 20 and 21.

FIG. 22 shows a perspective view of hopper station 1100 having a generally vertically oriented blank 10 therein. FIG. 23 shows a perspective view of hopper station 1100 and forming station 1200 wherein blank 10 is being transported from hopper station 1100 to forming station 1200 using transport system 1050. FIG. 24 shows a perspective view of forming station 1200 with blank 10 being placed into a substantially horizontal position by transport system 1050.

Figure 25:
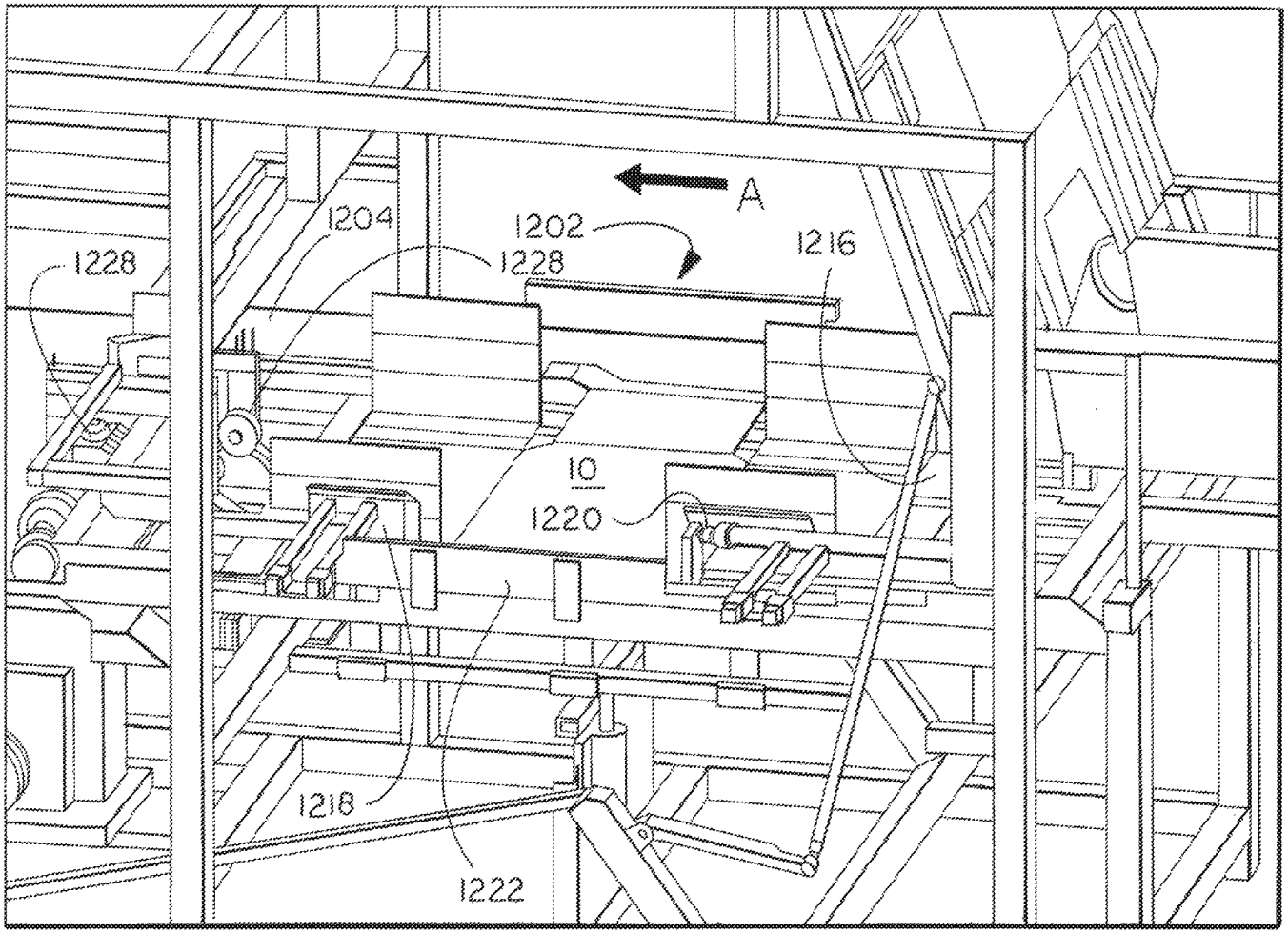
FIG. 25 is a perspective view of an initial forming station of the forming station shown in FIGS. 23 and 24.
Figure 26:
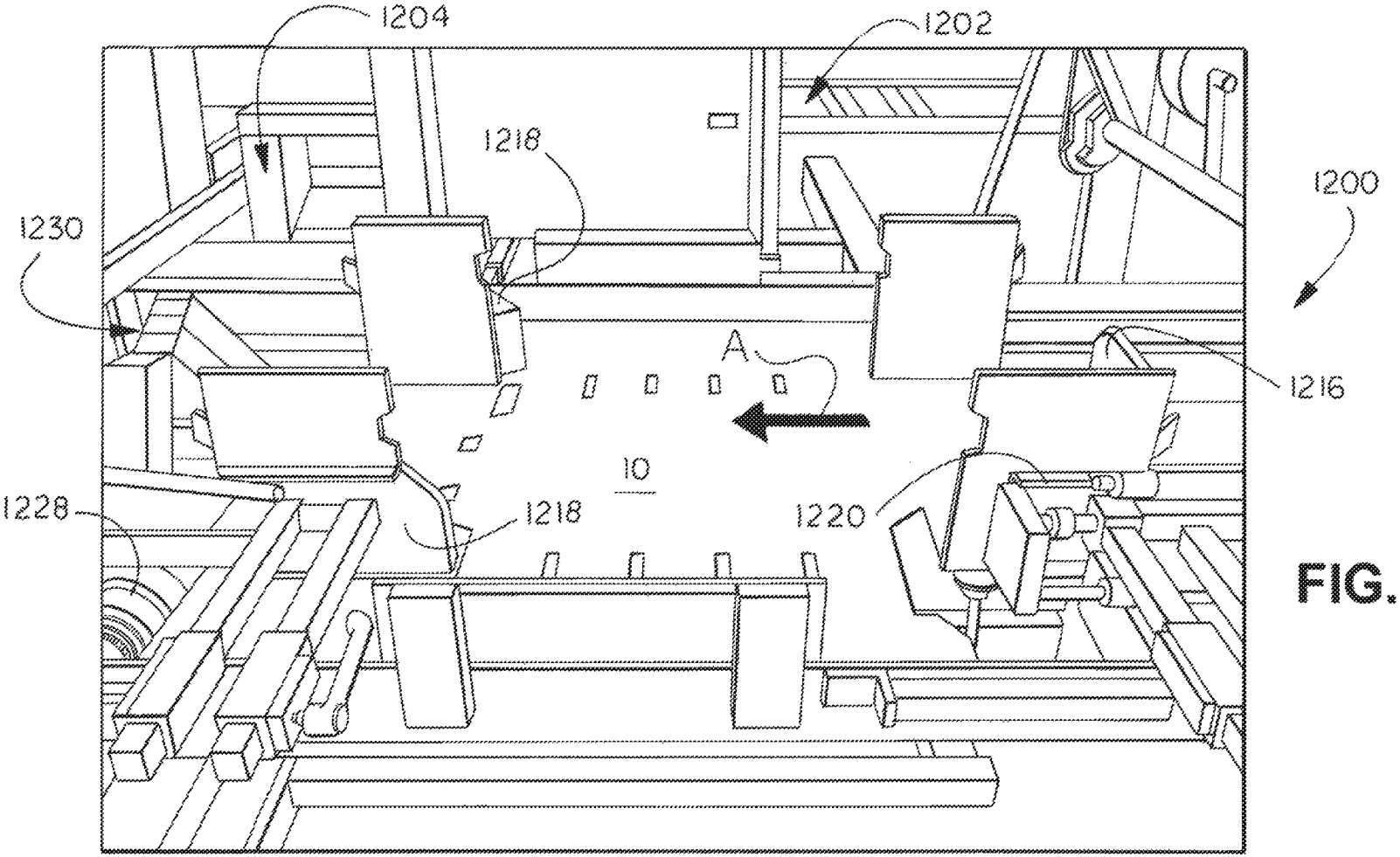
FIG. 26 is an enlarged view of the initial forming station shown in FIG. 25.
Figure 27:
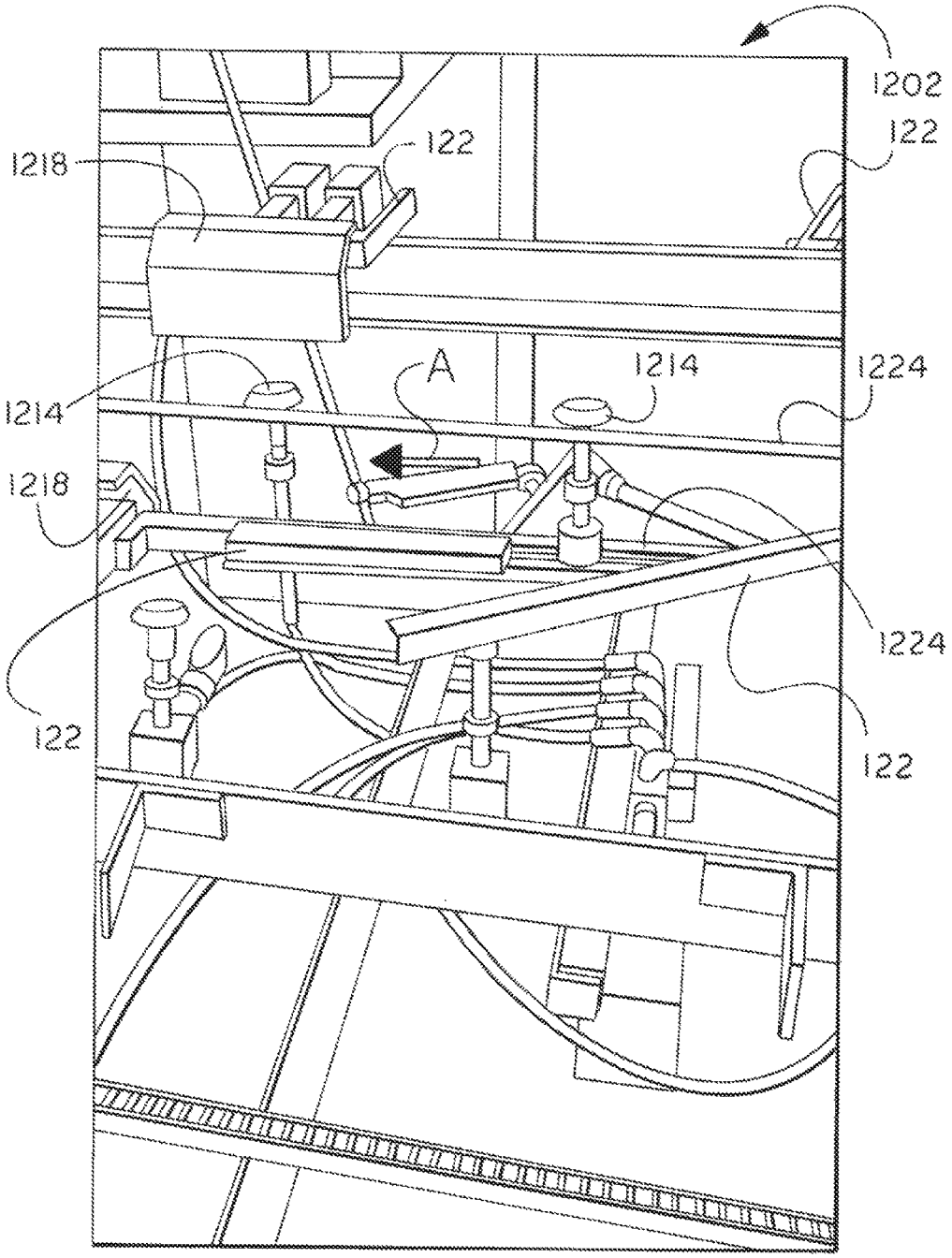
FIG. 27 is a perspective view of rotatable guide rails suitable for use in the forming station shown in FIGS. 23 and 24.

FIG. 25 shows a perspective view of forming station 1200 with blank 10 being placed onto transport system 1050 with inner reinforcing panel assemblies 90 and inner end panels 92 rotated substantially perpendicular to the remainder of blank 10. FIG. 26 shows an enlarged view of forming station 1200 with blank 10 placed onto transport system 1050 with inner reinforcing panel assemblies 90 and inner end panels 92 rotated substantially perpendicular to the remainder of blank 10. FIG. 27 shows an enlarged view of another suitable embodiment of forming station 1200 which includes guide rails configured to maintain inner reinforcing panel assemblies 90 and inner end panels 92 in an upright position as blank 10 is transported from an initial forming station of forming station 1200 through a first adhesive application station to a secondary forming station of forming station 1200.

Figure 28:
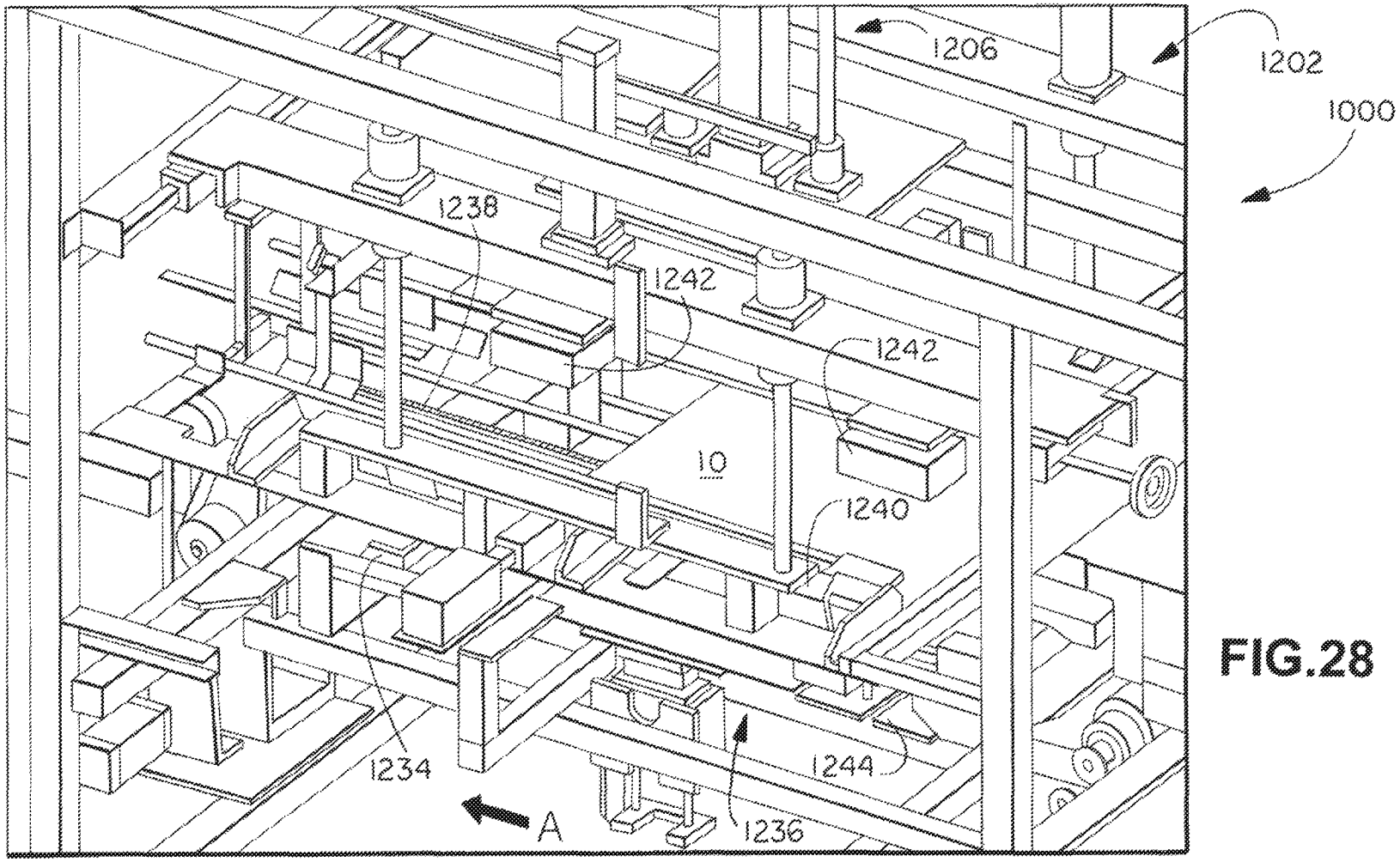
FIG. 28 is a perspective view of a secondary forming station of the forming station shown in FIGS. 23 and 24.
Figure 29:
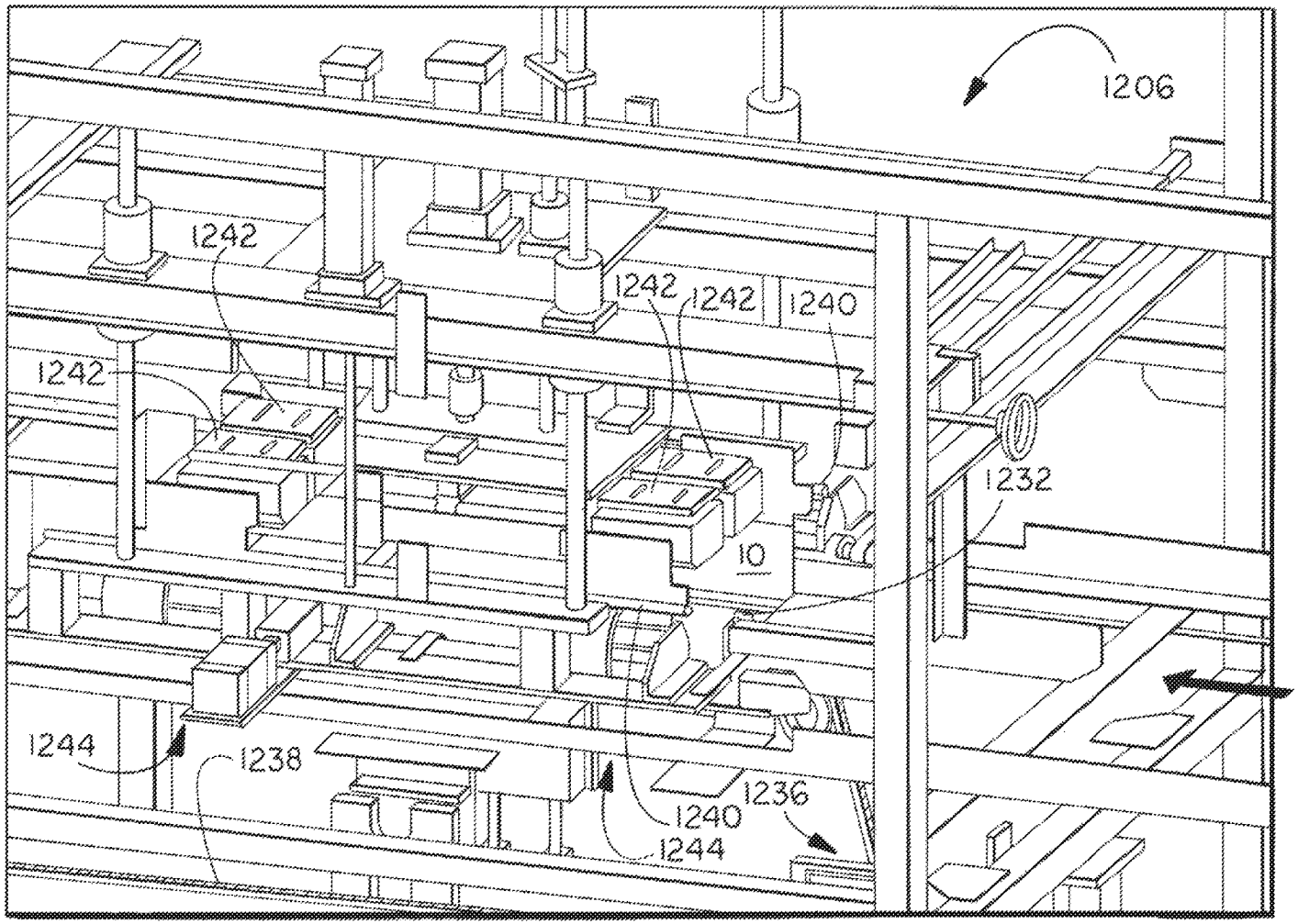
FIG. 29 is another perspective view of the secondary forming station shown in FIG. 28.
Figure 30:
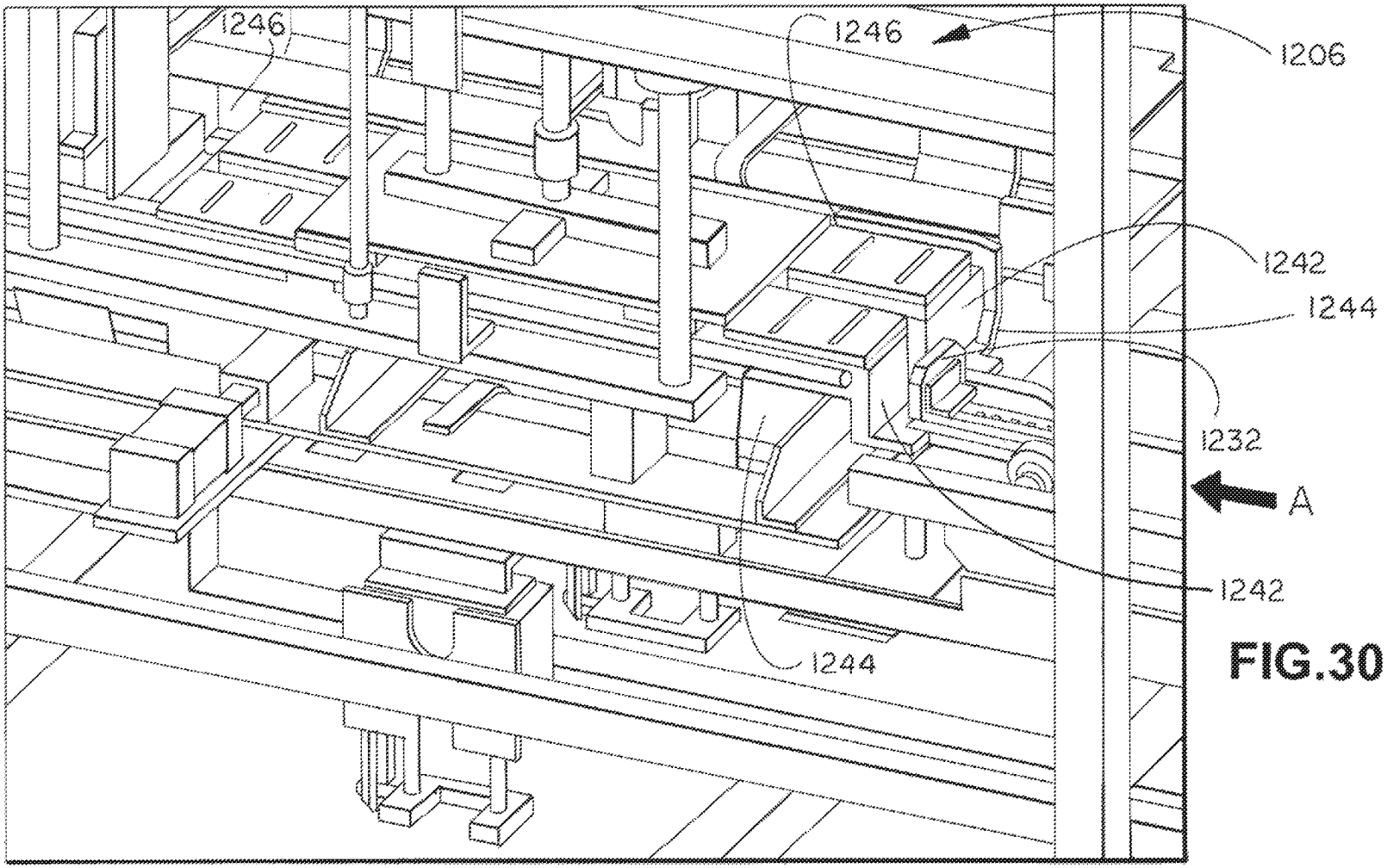
FIG. 30 is an enlarged view of the secondary forming station shown in FIGS. 28 and 29.
Figure 31:
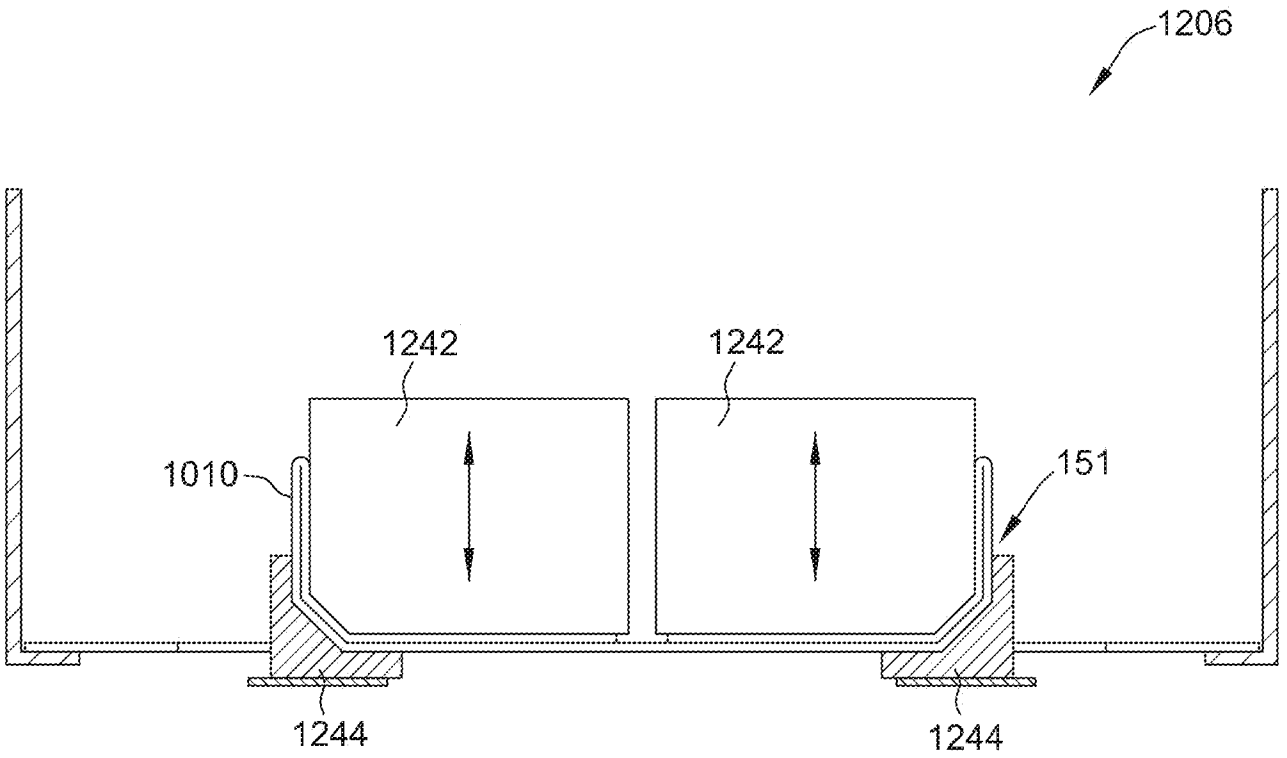
FIG. 31 is a schematic cross-sectional view of the secondary forming station shown in FIGS. 28-30.
Figure 32:
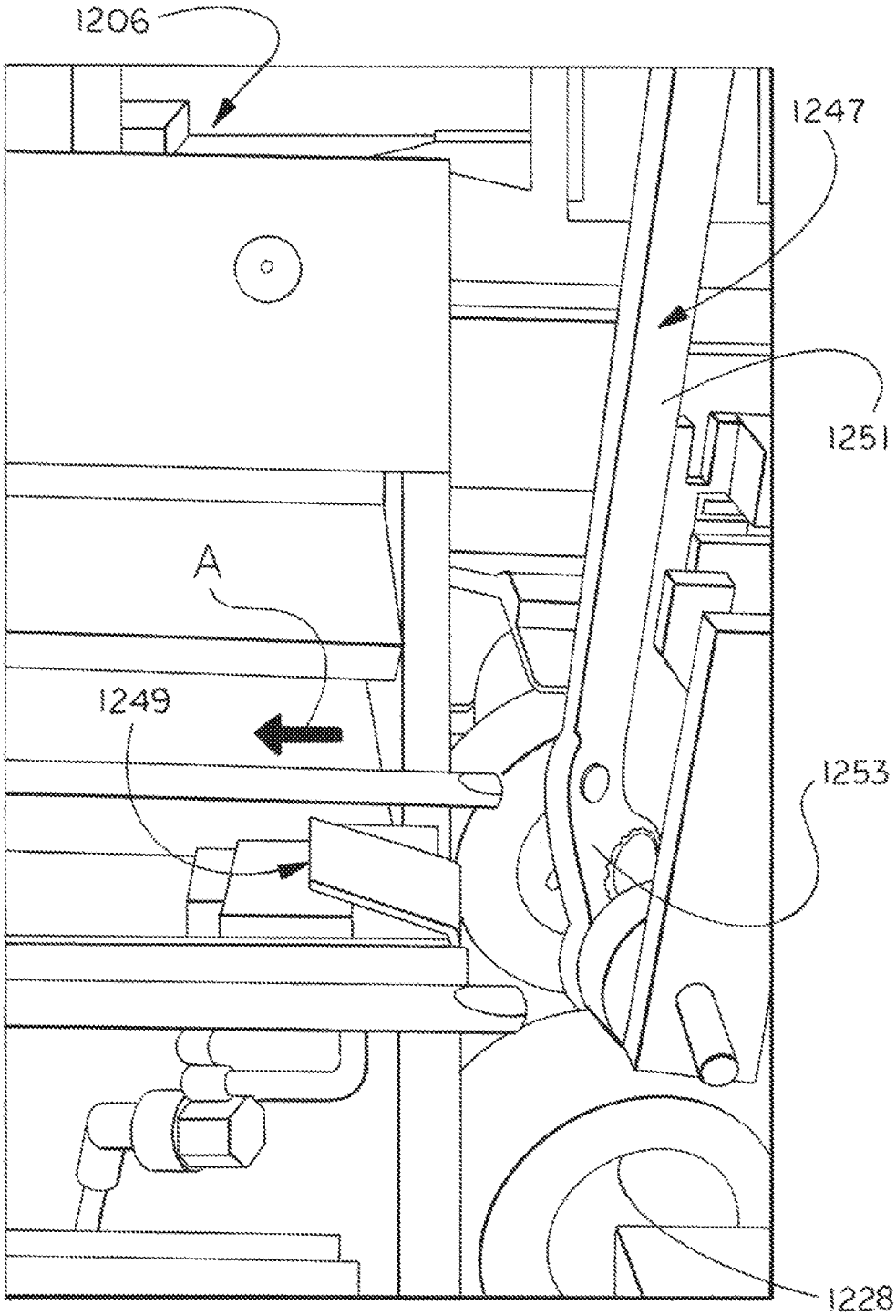
FIG. 32 is a perspective view of transfer mechanisms suitable for use in an upstream end of the secondary forming station shown in FIGS. 28-30.
Figure 33:
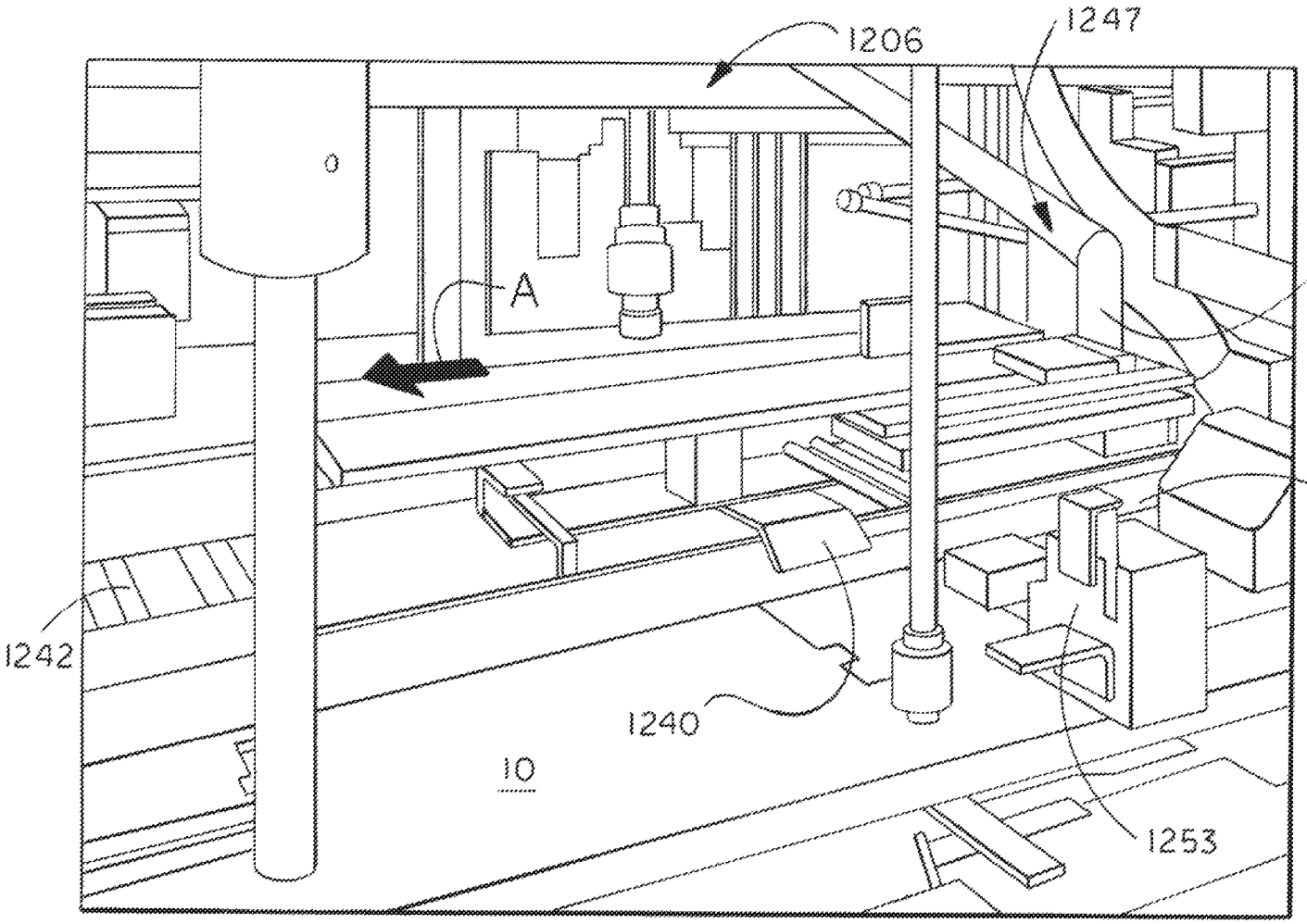
FIG. 33 is another perspective view of the secondary forming station shown in FIG. 28.
Figure 34:
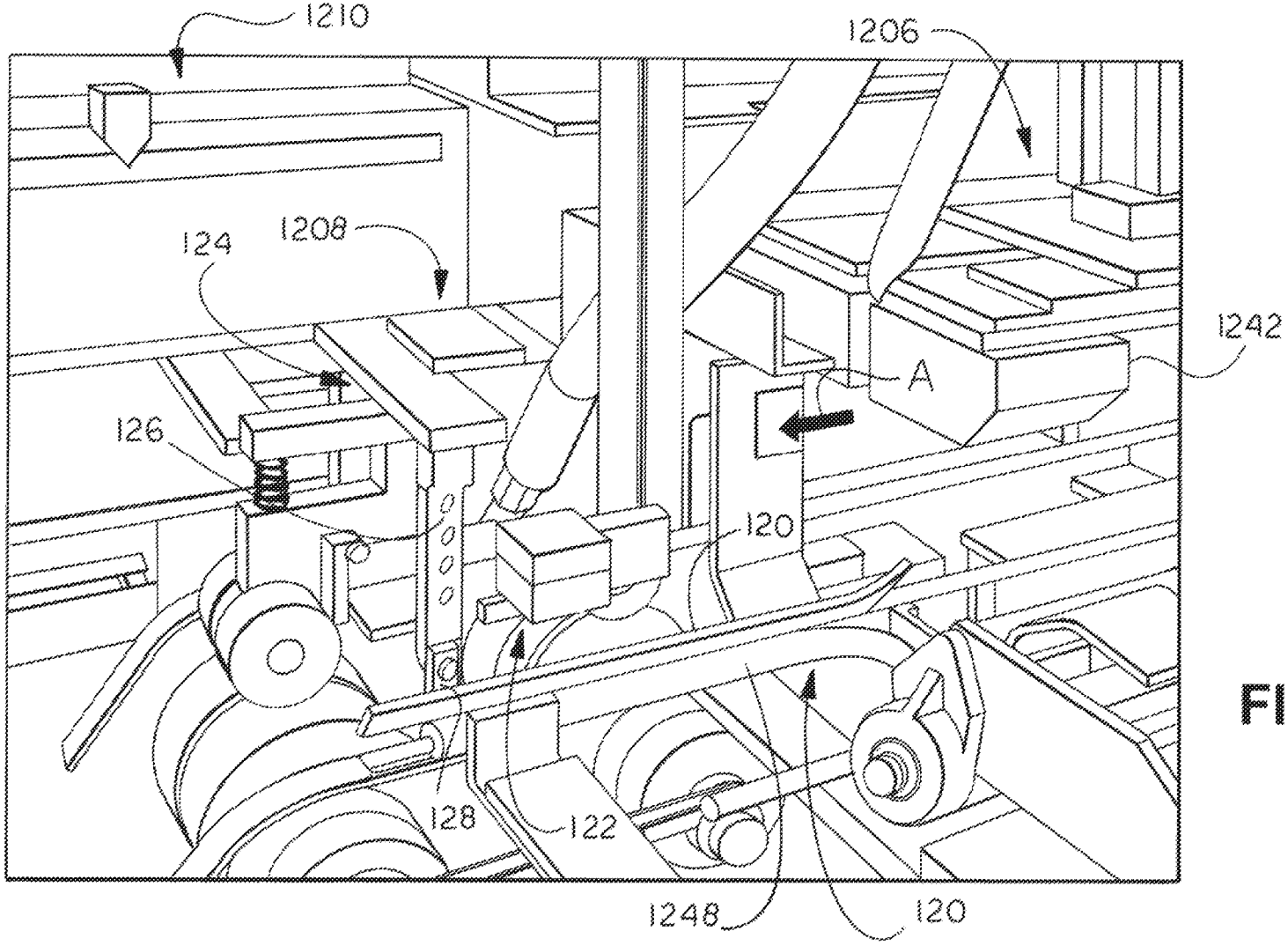
FIG. 34 is a perspective view of an angling station and a second adhesive application station of the forming station shown in FIGS. 23 and 24.
Figure 35:
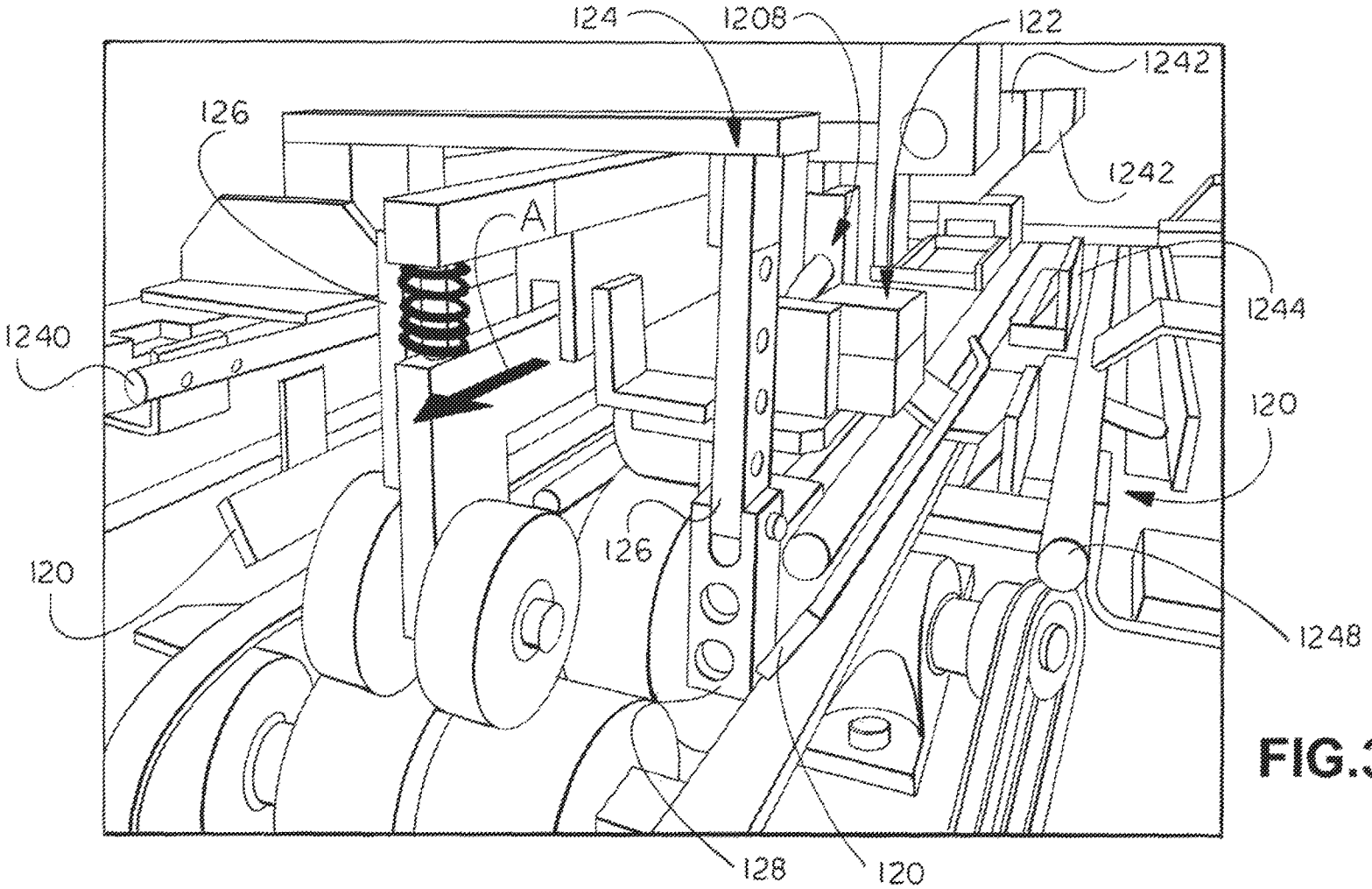
FIG. 35 is another perspective view of the angling station and the second adhesive application station shown in FIG. 34.

FIG. 28 is a perspective view of the secondary forming station of forming station 1200. FIG. 29 shows a perspective view of blank 10 being further formed within the secondary forming station of forming station 1200. FIG. 30 shows a perspective view of blank 10 having reinforcing corner assemblies 151 formed within the secondary forming station of forming station 1200. FIG. 31 shows a schematic cross-sectional view of blank 10 being formed into partially formed container 1010 within the secondary forming station of forming station 1200. FIG. 32 shows a perspective view of transfer mechanisms suitable for use in an upstream end of the secondary forming station for positioning blank 10 within the secondary forming station and transporting blank 10 through the secondary forming station. FIG. 33 shows a perspective view of blank 10 being positioned within the secondary forming station prior to reinforcing corner assemblies 151 being formed. FIG. 34 shows a perspective view of an angling station and a second adhesive application station within forming station 1200. FIG. 35 is a perspective view of a downstream end of the angling station and the second adhesive application station.

Figure 36:
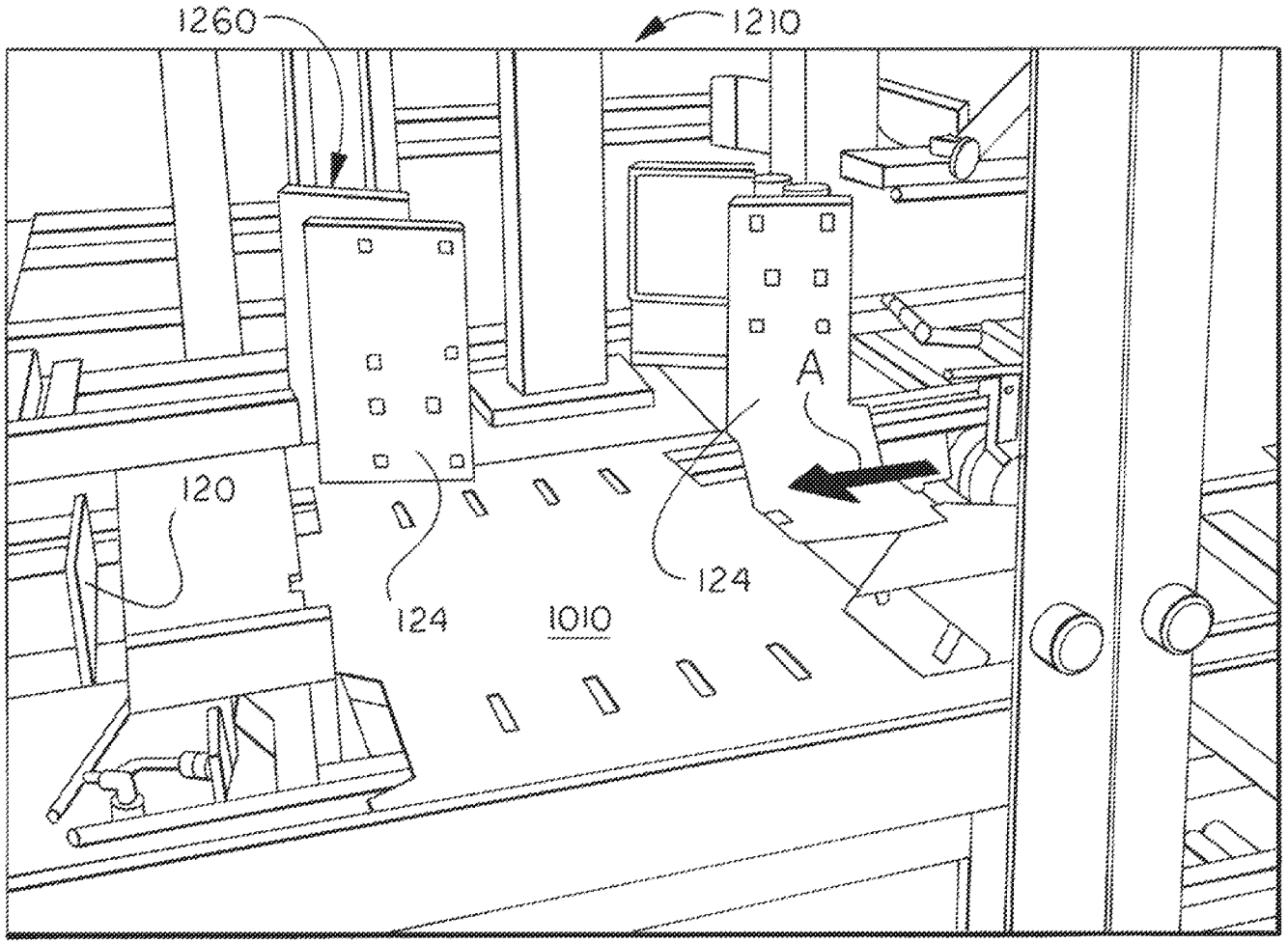
FIG. 36 is a perspective view of a compression station of the forming station shown in FIGS. 23 and 24, the compression station having a blank positioned therein.
Figure 37:
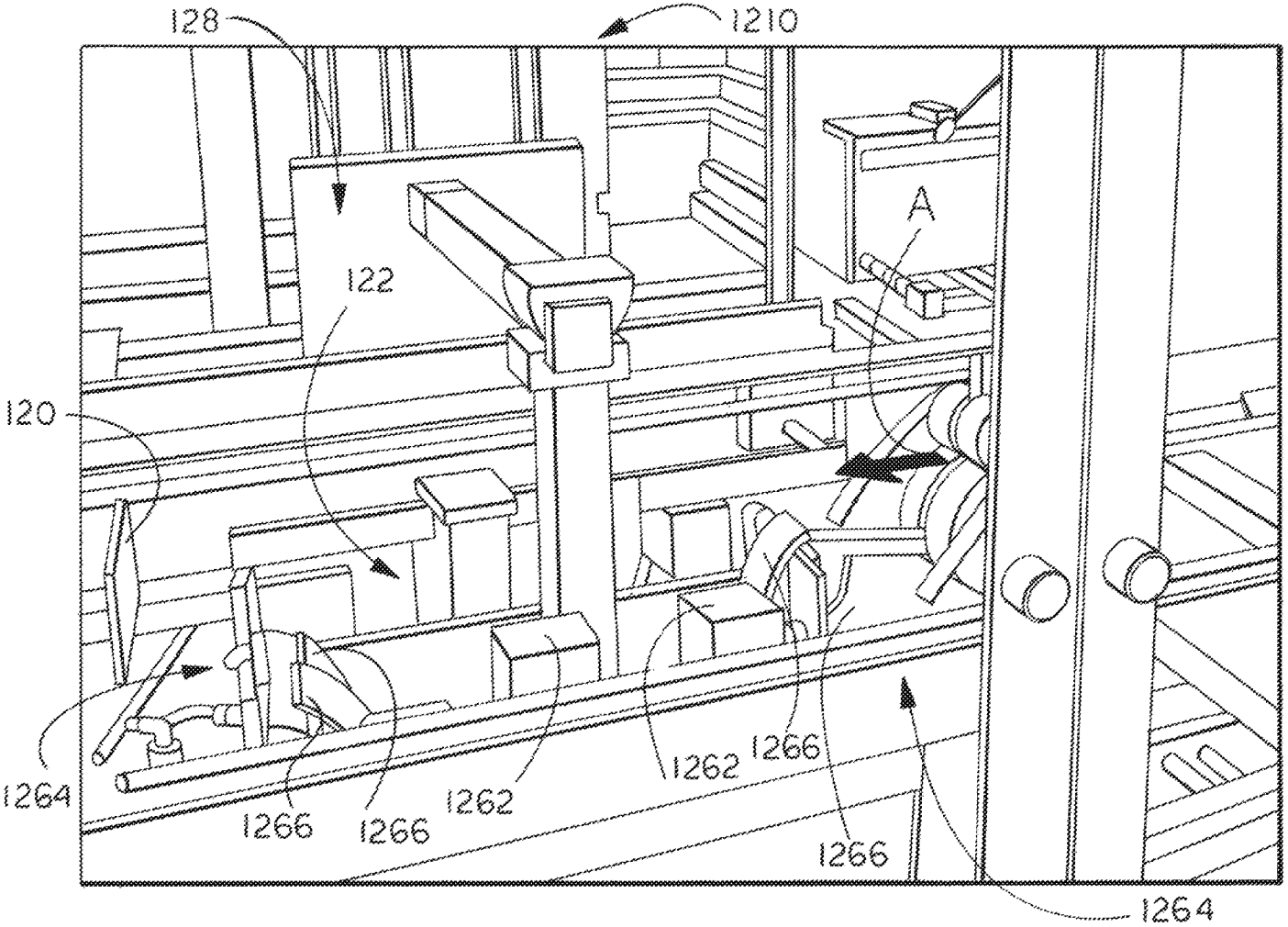
FIG. 37 is another perspective view of the compression station shown in FIG. 36.
Figure 38:
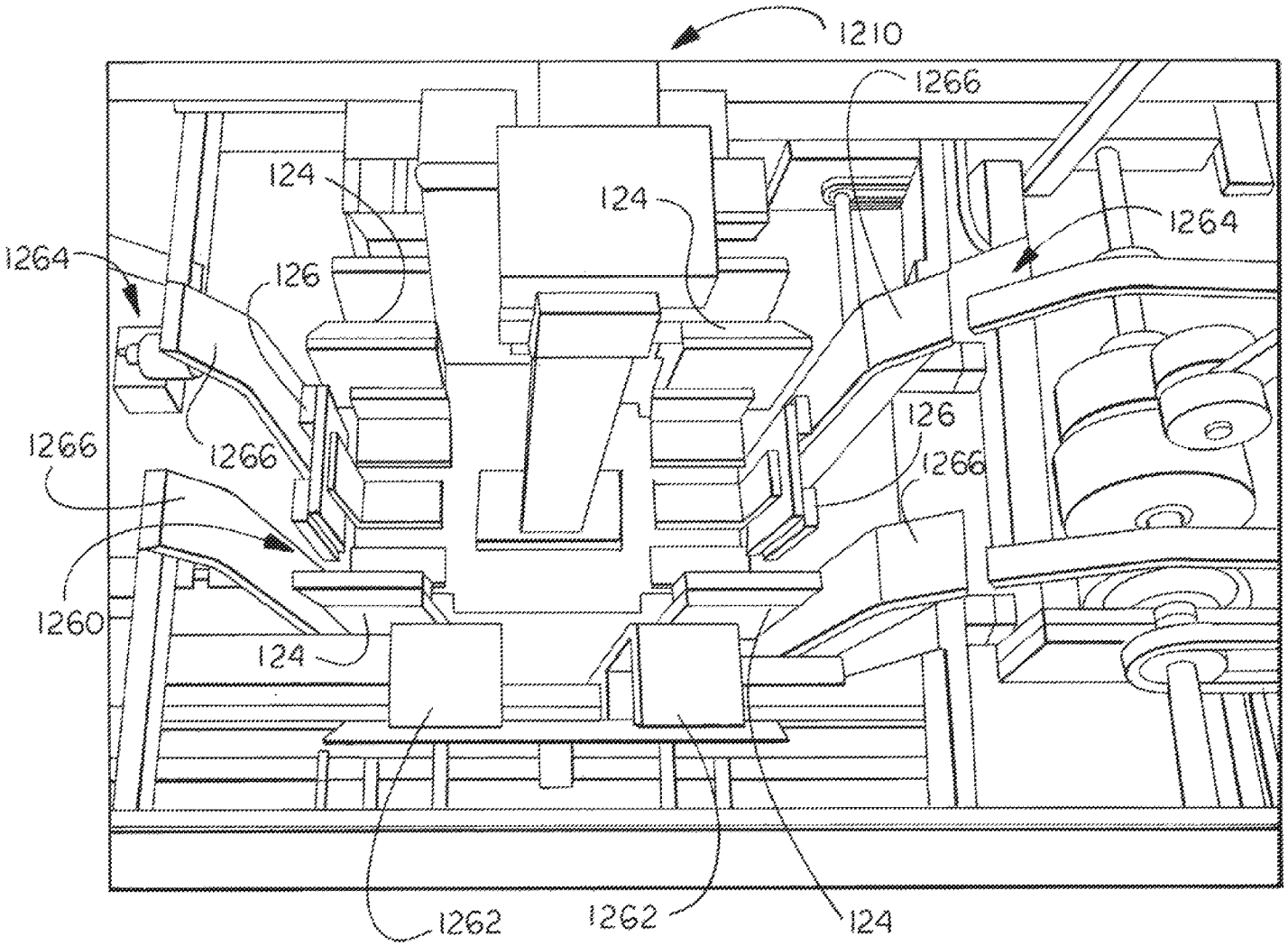
FIG. 38 is a top perspective view of the compression station shown in FIG. 36 without a blank positioned therein.
Figure 39:
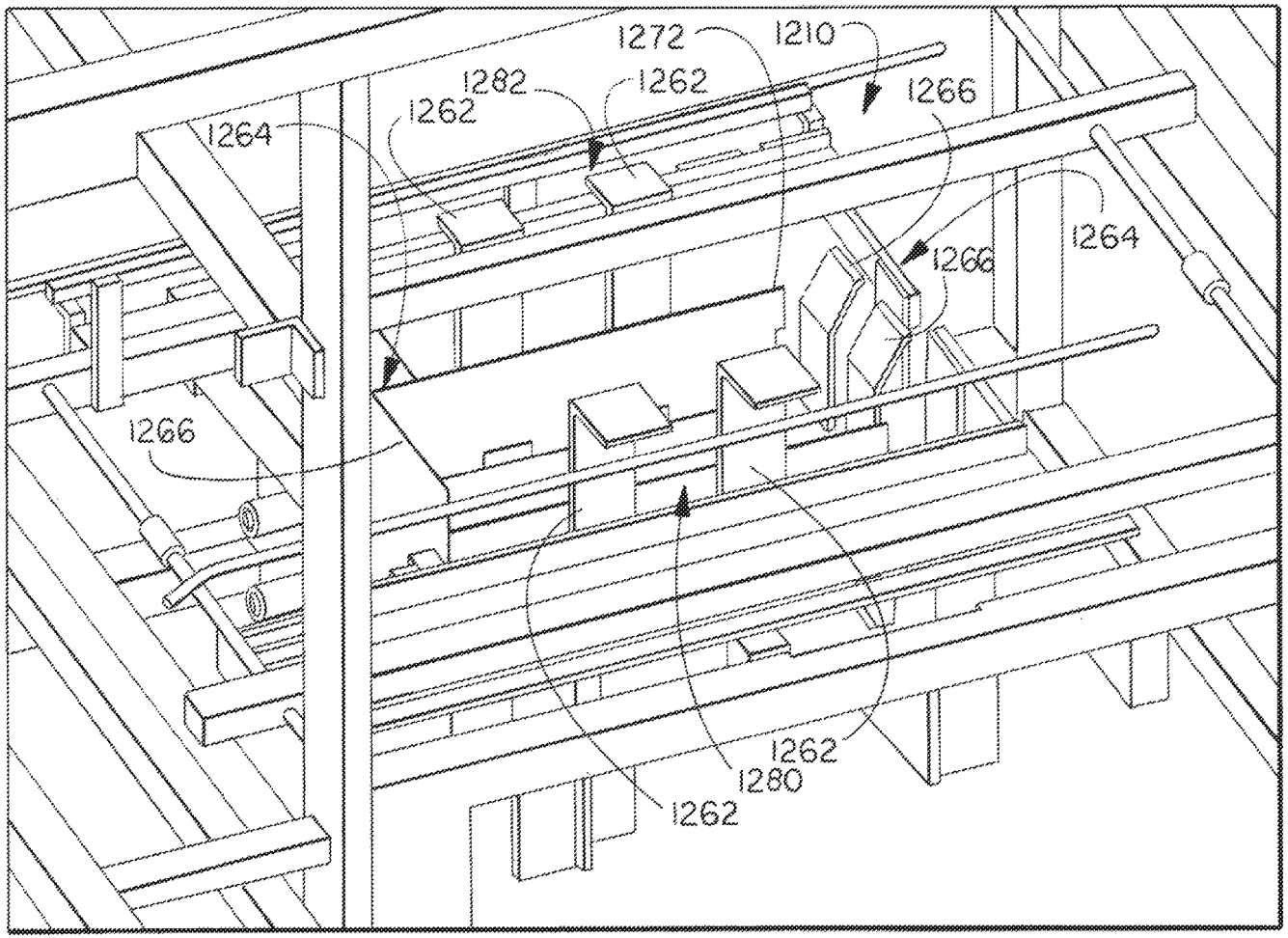
FIG. 39 is another perspective view of the compression station shown in FIG. 36.
Figure 40:
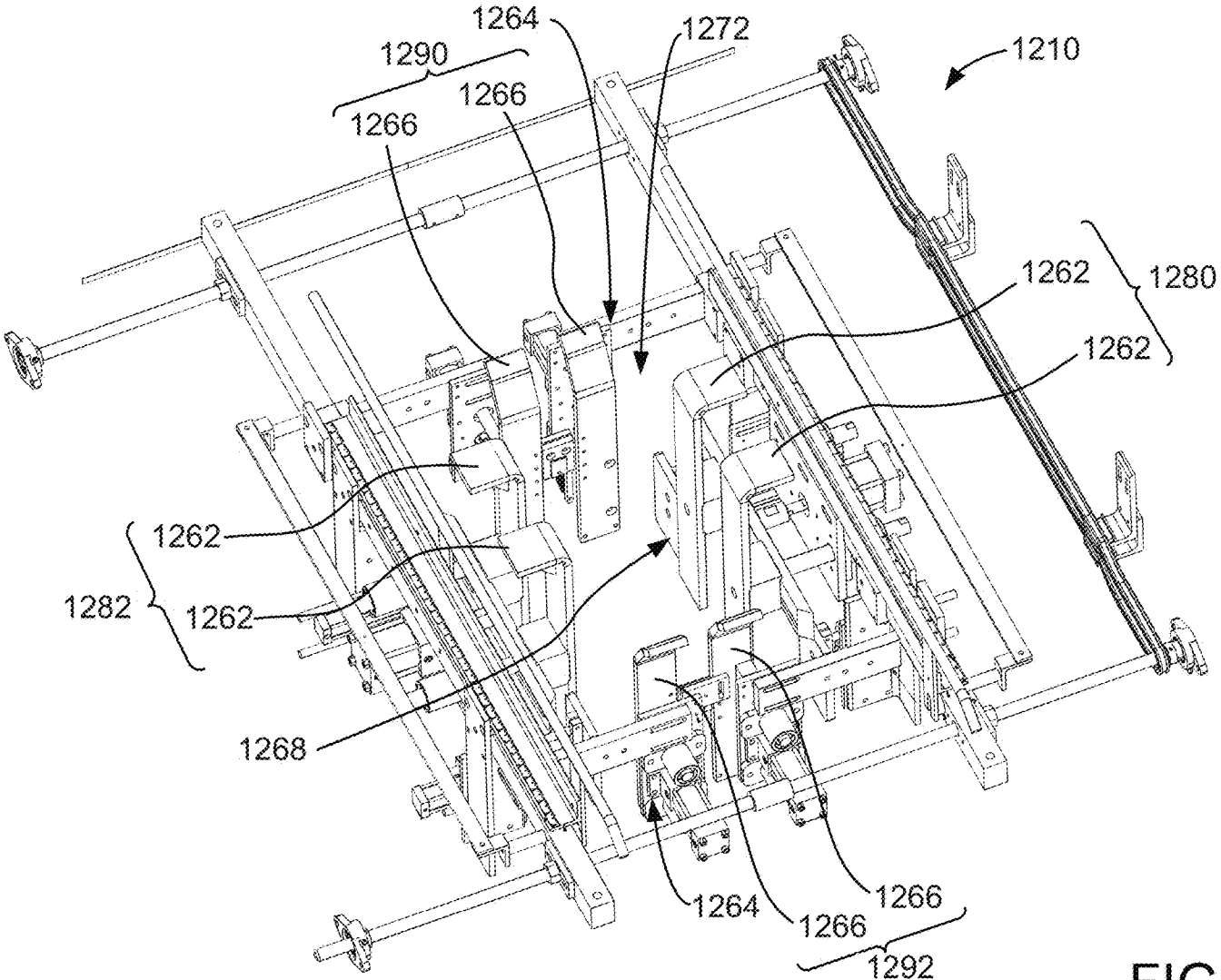
FIG. 40 is another perspective view of the compression station shown in FIG. 36 without a blank positioned therein.
Figure 41:
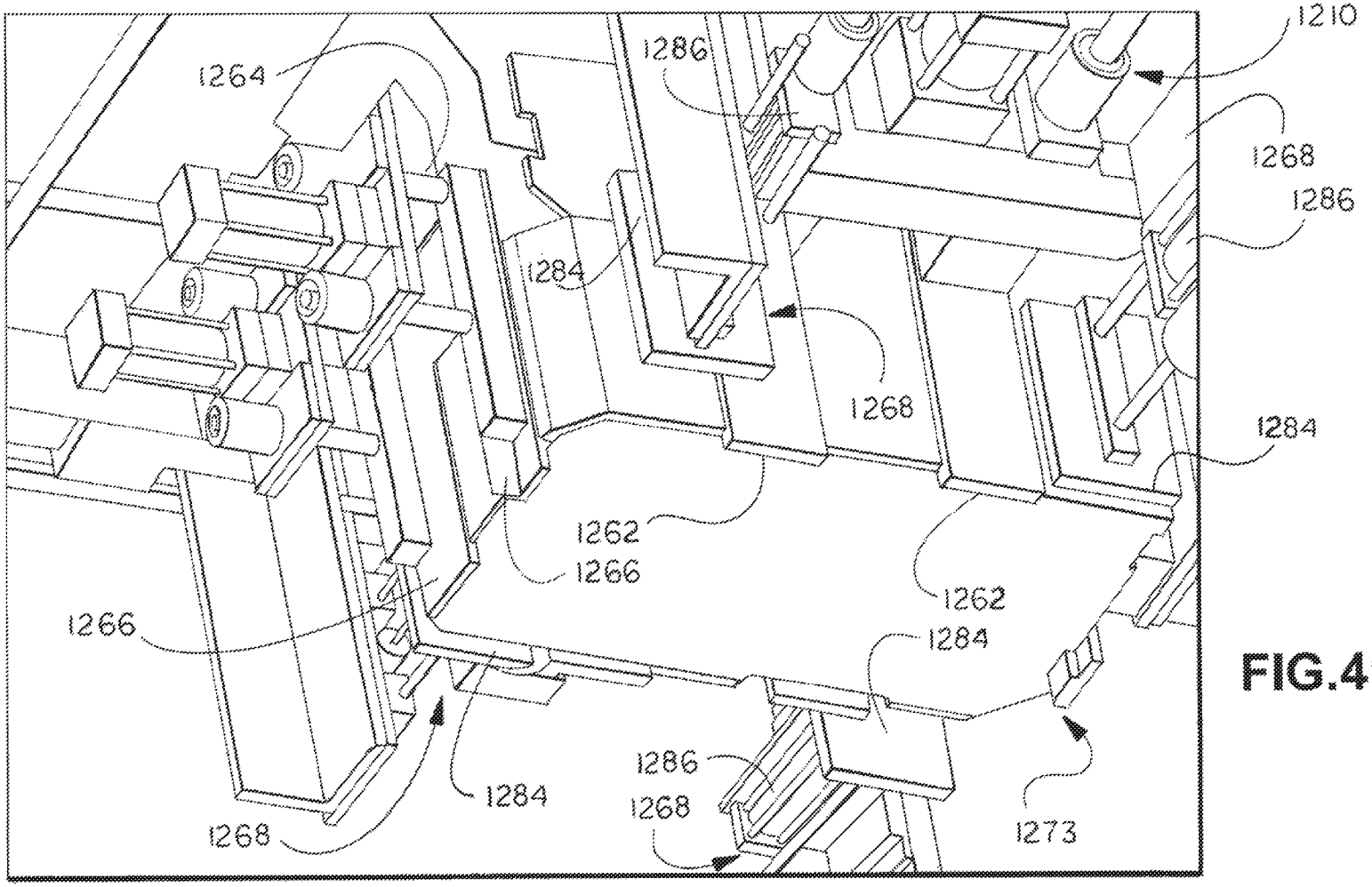
FIG. 41 is a perspective view of the compression station shown in FIG. 36 from a bottom end of the compression station.
Figure 42:
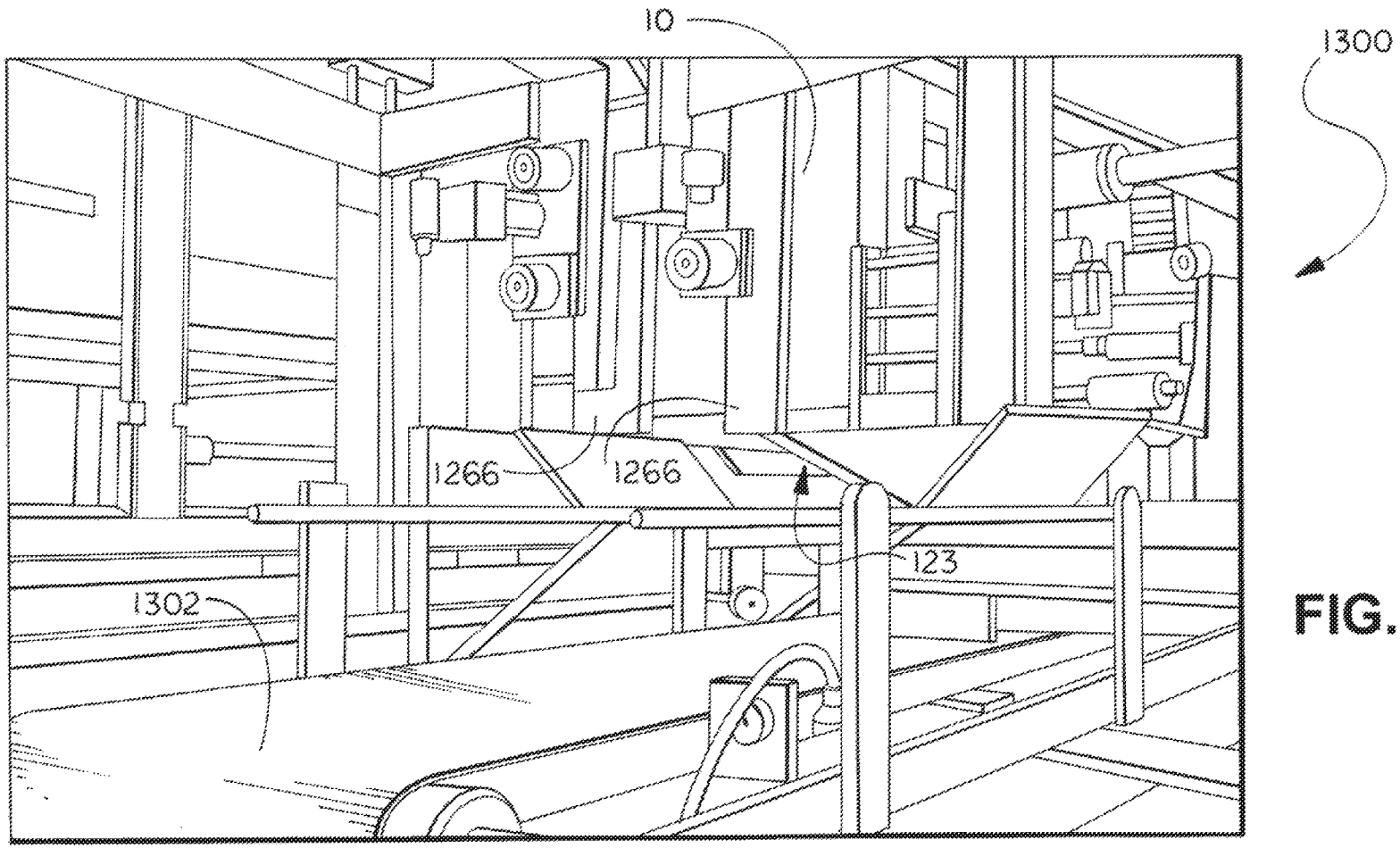
FIG. 42 is a perspective view of an ejection station of the machine shown in FIGS. 20 and 21.

FIG. 36 shows a perspective view of partially formed container 1010 positioned within a compression station of forming station 1200. FIG. 37 shows a perspective view of partially formed container 1010 being formed into container 150 within the compression station. FIG. 38 shows a top perspective view of the compression station without partially formed container 1010 positioned therein. FIG. 39 shows another perspective view the compression station without a plunger (described below) and with a formed container 150 positioned therein. FIG. 40 shows another perspective view of the compression station without the plunger and without partially formed container 1010 or container 150 positioned therein. FIG. 41 shows a perspective view of the compression station from a bottom of the compression station. FIG. 42 shows a perspective view of ejection station 1300, and a formed container 150 being held within the compression station of forming station 1200 above exit conveyor 1302.

Referring to FIGS. 20-42, machine 1000 is substantially symmetrical about a longitudinal axis 1012 that extends from a rear end 1014 of machine 1000 to a front end 1016 of machine 1000. As a container 150 is formed using machine 1000, blank 10 moves along longitudinal axis 1012 from rear end 1014 to front end 1016.

Referring to FIGS. 22-24, hopper station 1100 includes a hopper 1102, a feed mechanism 1104, a transfer arm 1106, and an upper suction device 1108. Hopper 1102 is configured to support stack 1006 of blanks 10 in a substantially vertical position on feed mechanism 1104. Feed mechanism 1104 is part of transport system 1050, and includes, in the example embodiment, a conveyor belt mechanism for transporting blanks 10 downstream toward transfer arm 1106. Blanks 10 within hopper 1102 are in an unformed, substantially planar state. Hopper 1102 is further configured to facilitate maintaining alignment of blanks 10 within machine 1000 such that an individual blank 10 may be transported from hopper station 1100 and precisely placed within forming station 1200.

Referring to FIGS. 23-41, forming station 1200 includes an initial forming station 1202, a first adhesive application station 1204, a secondary forming station 1206, a second adhesive application station 1208, and a compression station 1210. In the illustrated embodiment, forming station 1200 also includes a drive system 1212 which drives and/or actuates various components of machine 1000 as described below. Although drive system 1212 is illustrated as being located in forming station 1200 in the example embodiment, drive system 1212 may be located at any suitable location that enables machine 1000 to function as described herein.

Referring to FIGS. 23-27, initial forming station 1202 includes a lower suction device 1214, a pusher plate 1216, stationary folding plows 1218, moveable folding plows 1220, side plates 1222, support rails 1224, and outer side rails 1226. Outer side rails 1226 extend the length of machine 1000 and are used to help guide the outer side edges of blank 10 as blank 10 moves through machine 1000.

Referring to FIG. 27, in some embodiments, initial forming station 1202 may include rotatable guide rails 1227 configured to maintain inner reinforcing panel assemblies 90 and inner end panels 92 in an upright position, as described in more detail below. In the illustrated embodiment, a rotatable guide rail 1227 is rotatably coupled to each folding plow 1218 and 1220. Rotatable guide rails 1227 are configured to rotate about a vertical axis from a first position, in which rotatable guide rails 1227 are oriented substantially perpendicular to downstream direction A, to a second position in which rotatable guide rails 1227 are oriented substantially parallel to the downstream direction A of machine 1000. Further, in embodiments including rotatable guide rails 1227, moveable folding plows 1220 may be replaced with stationary folding plows 1218. In the embodiment illustrated in FIG. 27, one rotatable guide rail 1227 is shown in the first position, two rotatable guide rails 1227 are shown in the second position, and one rotatable guide rail 1227 is shown in an intermediate position between the first position and the second position.

Referring to FIG. 25-26, first adhesive application station 1204 includes drive rollers 1228 and a first adhesive applicator 1230. As explained below in detail, drive rollers 1228 are part of transport system 1050 and are used to help transport blank 10 from initial forming station 1202 past first adhesive applicator 1230. First adhesive applicator 1230 includes a plurality of adhesive sprayers that apply hot glue or any other type of adhesive to certain panels of blank 10. Specifically, first adhesive applicator 1230 applies adhesive to portions of each corner panel 98, each first reinforcing side panel 100, and first and second end panels 64 and 70. In an alternative embodiment, first adhesive applicator 1230 applies adhesive to a portion of at least some of these panels. First adhesive application station 1204 also includes photo-eyes, sensors, proximity switches and other location detectors for detecting a location of blank 10 within first adhesive application station 1204. Location data is provided to control system 1008, and control system 1008 controls when adhesive sprayers are turned on and off to properly apply adhesive to blank 10. In the exemplary embodiment, first adhesive applicator 1230 includes a plurality of glue modules that are each separately controllable by control system 1008. As such, any suitable number of glue modules are activated depending on a size and/or placement of blank 10.

Referring to FIGS. 28-31, secondary forming station 1206 is downstream from initial forming station 1202 and first adhesive application station 1204. Secondary forming station 1206 helps form reinforcing corner assemblies 151 on each blank 10 that passes through machine 1000. Secondary forming station 1206 includes a push lug 1232, a stop lug 1234, a servo-mechanical system 1236 (also known as a servo drive), a servo chain 1238, rotating folder arms 1240, male forming members 1242, female forming members 1244, and inner side rails 1246. In the example embodiment, servo drive 1236 is controlled by control system 1008. Servo drive 1236 drives servo chain 1238 which includes at least one push lug 1232 coupled to servo chain 1238. Accordingly, servo drive 1236 drives servo chain 1238 around a first and second sprocket such that each push lug 1232 attached to servo chain 1238 rotates from an upstream location within secondary forming station 1206 to a downstream location within secondary forming station 1206. Push lug 1232 is configured to engage blank 10 at trailing top edge 68 or 74 of blank 10. Push lug 1232 pushes blank 10 into a forming position by pushing blank 10 until the opposing leading top edge 74 or 68 of blank 10 contacts stop lug 1234.

Stop lug 1234 is positioned downstream of push lug 1232. Stop lug 1234 is configured to precisely stop blank 10 so that blank 10 can be further formed within secondary forming station 1206, and move downwardly out of the path of blank 10 so that, after secondary forming, blank 10 is able to move further downstream within machine 1000. More specifically, in the exemplary embodiment, a stop lug 1234 is positioned on each side of servo chain 1238, and stop lugs 1234 move upward from below servo chain 1238 to above servo chain 1238 to stop blank 10 at an appropriate position. Stop lugs 1234 can be movably coupled to inner side rails 1246 and width-wise adjustable through adjustment of a width of inner side rails 1246. Stop lugs 1234 are moveable upstream and downstream with respect to inner side rails 1246 for length-wise adjustment. As such, positions of stop lugs 1234 are adjustable depending on a size of blank 10.

Rotating folder arms 1240 are mounted on each side of secondary forming station 1206 proximate to inner side rails 1246. Folder arm 1240 is configured to rotate inwardly toward blank 10 from a starting position to a folding position, and then outwardly to return to the starting position. In rotating between the starting position and the folding position, folder arm 1240 contacts a portion of inner reinforcing panel assemblies 90 and/or inner end panels 92 to fold inner reinforcing panel assemblies 90 and inner end panels 92 from the substantially perpendicular position to a nearly flat position (shown in FIG. 33) wherein inner reinforcing panel assemblies 90 overlie respective outer reinforcing panel assemblies 88, and inner end panels 92 overlie a respective end panel 64 or 70. As folder arm 1240 folds inner reinforcing panel assemblies 90 and inner end panels 92, a portion of inner reinforcing panel assemblies 90 and/or inner end panels 92 contacts a respective male forming member 1242 causing inner reinforcing panel assemblies 90 to bend along fold line 114 and inner end panel 92 to bed along fold line 96. The pre-bending of fold lines 96 and 114, sometimes referred to as "pre-breaking," facilitates forming reinforcing corner assemblies 151, as explained below in greater detail.

After folder arm 1240 folds inner reinforcing panel assemblies 90 and inner end panels 92, folder arm 1240 rotates back to the starting position so that male forming members 1242 and female forming members 1244 are able to move together and form reinforcing corner assemblies 151, as shown in FIG. 31. More specifically, each male forming member 1242 has an outer surface shaped complementary to an interior surface of one of reinforcing corner assemblies 151, and each female forming member 1244 has an outer surface shaped complementary to an exterior surface of one of the reinforcing corner assemblies 151. Thus, when male forming members 1242 and female forming members 1244 move toward each other, each female forming member 1244 interfaces with the outside of blank 10 and each male forming member 1242 interfaces with the inside of blank 10 such that outer reinforcing panel assemblies 88 are glued to respective inner reinforcing panel assemblies 90, and end panels 64 and 70 are glued to a respective inner end panels 92. In addition, the outer profiles of male forming members 1242 and female forming members 1244 form corner walls 162, 164, 166, and/or 168 of each reinforcing corner assembly 151. As described above, initial forming station 1202 and secondary forming station 1206 cooperate with one another to form reinforcing corner assemblies 151. As such, initial forming station 1202 and secondary forming station 1206 are collectively referred to herein as a reinforcing corner assembly forming station.

After forming reinforcing corner assemblies 151, male forming members 1242 and female forming members 1244 move away from each other. Inner side rails 1246 are positioned to contact first reinforcing side panel 100 on each reinforcing corner assembly 151 to maintain an overall angle of reinforcing corner assembly 151 at substantially 90 degrees. In other words, inner side rails 1246 help prevent the formed reinforcing corner assemblies 151 from springing back out of a perpendicular position. Further, stop lug 1234 moves out of the travel path of partially formed container 1010 such that partially formed container 1010 can be further moved downstream within machine 1000.

Referring to FIGS. 32-33, secondary forming station 1206 may also include, in addition to or as an alternative to push lug 1232, stop lug 1234, and/or servo chain 1238, a pusher arm 1247 and a slide mechanism 1249. Pusher arm 1247 includes a vertically oriented bar 1251 coupled to a vertically-oriented rotatable plate 1253 that is rotatable in the downstream direction A, but is restricted from rotating in the upstream direction. In the illustrated embodiment, for example, rotatable plate 1253 is restricted from rotating beyond a substantially vertical orientation (shown in FIG. 32) in the upstream direction. In other words, rotatable plate 1253 allows blank 10 to move downstream, but acts as a pusher arm after blank 10 passes downstream of rotatable plate 1253 to position blank 10 within secondary forming station 1206. Pusher arm 1247 is moveable from a first position (shown in FIG. 32) to a second position (shown in FIG. 33) to engage a trailing edge of blank 10 with rotatable plate 1253 to position blank 10 within secondary forming station 1206. Slide mechanism 1249 is configured to move in the downstream direction A and engage a trailing edge of partially formed container 1010 to transfer partially formed container 1010 from secondary forming station 1206, through second adhesive application station 1208, and to compression station 1210. Pusher arm 1247 and slide mechanism 1249 may be communicatively coupled to control system 1008 to control movements of pusher arm 1247 and slide mechanism 1249.

Referring to FIGS. 34 and 35, machine 1000 also includes an angling station 1207 positioned between forming members 1242 and 1244 and compression station 1210. Angling station 1207 is configured to orient reinforcing side panels 100 and 104, after reinforcing side panels 100 and 104 are joined together by forming members 1242 and 1244, to be at an obtuse angle (an angle of greater than approximately 90 degrees) with respect to interior surface 12 of end panels 64 and/or 70. Angling station 1207 includes a guide bar 1248 and a miter plate 1250. In the example embodiment, miter plate 1250 is substantially parallel to longitudinal axis 1012 and oriented at an angle corresponding to an angle between corner panels 98 and 102 and end panels 64 and/or 70. Miter plate 1250 is configured to force reinforcing side panels 100 and 104 to rotate outward with respect to end panels 64 and/or 70 to orient reinforcing side panels 100 and 104 at an obtuse angle with respect to end panels 64 and/or 70. In the example embodiment, the upstream end of miter plate 1250 includes an angled portion that causes reinforcing side panels 100 and 104 to rotate outward with respect to end panels 64 and/or 70 as partially formed container 1010 is transported downstream from secondary forming station 1206 to compression station 1210. Guide bar 1248 is oriented substantially parallel to miter plate 1250, and is configured to maintain the orientation of and/or prevent over rotation of reinforcing corner assemblies 151 as reinforcing side panels 100 and 104 are rotated outward by miter plate 1250. In the example embodiment, reinforcing corner assembly 151 is positioned between miter plate 1250 and guide bar 1248 as partially formed container 1010 is transported downstream from secondary forming station 1206 past second adhesive application station 1208. As such, angling station 1207 facilitates positioning reinforcing corner assemblies 151 on an exterior surface of side panels 22 and/or 26 when container 150 is formed, as described in more detail below.

Still referring to FIGS. 34 and 35, second adhesive application station 1208 includes a second adhesive applicator 1252 positioned adjacent each miter plate 1250. Push lug 1232 or slide mechanism 1249 (shown in FIG. 32) pushes partially formed container 1010 through second adhesive application station 1208 to compression station 1210. Second adhesive applicator 1252 includes a plurality of adhesive sprayers that apply hot glue or any other type of adhesive to certain panels of blank 10. Specifically, second adhesive applicator 1252 applies adhesive to portions of exterior surface 14 of second reinforcing side panels 104. Additionally or alternatively, second adhesive applicator 1252 may include a glue module configured to apply adhesive to portions of exterior surface of first and second side panels 22 and 26. Second adhesive application station 1208 also includes photo-eyes, sensors, proximity switches and other location detectors for detecting a location of partially formed container 1010 within second adhesive application station 1208. Location data is provided to control system 1008, and control system 1008 controls when adhesive sprayers are turned on and off to properly apply adhesive to partially formed container 1010. In the example embodiment, second adhesive applicator 1252 includes a plurality of glue modules that are each separately controllable by control system 1008. As such, any suitable number of glue modules are activated depending on a size and/or placement of blank 10. In the example embodiment, guide bars 1248 and miter plates 1250 are positioned to maintain an appropriate distance between second adhesive applicators 1252 and exterior surface 14 of the respective second reinforcing side panel 104 as partially formed container 1010 passes through machine 1000 to ensure a proper amount and placement of adhesive on the panel.

As shown in FIGS. 34-35, machine 1000 also includes a pusher arm 1254 positioned just downstream of second adhesive application station 1208. In the example embodiment, pusher arm 1254 includes a pair of vertically-oriented bars 1256 coupled to a pair of vertically-oriented rotatable bars 1258 that are rotatable in the downstream direction, but are restricted from rotating in the upstream direction. In the illustrated embodiment, for example, rotatable bars 1258 are restricted from rotating beyond a substantially vertical orientation (shown in FIG. 34) in the upstream direction. In other words, rotatable bars 1258 allow partially formed container 1010 to move downstream, but act as pusher arms after partially formed container 1010 passes downstream of rotatable bars 1258. Rotatable bars 1258 are configured to engage a rear edge of partially formed container 1010 as partially formed container 1010 is ejected from second adhesive application station 1208. When rotatable bars 1258 engage the rear edge, pusher arm 1254 transfers partially formed container 1010 from second adhesive application station 1208 into compression station 1210. In the example embodiment, pusher arm 1254 is a component of transport system 1050.

Referring to FIGS. 36-41, compression station 1210 includes a plunger 1260, two pairs of side panel plows 1262, a pair of end panel plow assemblies 1264 each including a frame and a pair of end panel plows 1266 coupled to the frame, a plurality of side wall presser assemblies 1268, and an adjustable stop plate 1270. Adjustable stop plate 1270 is positioned at a downstream end of compression station 1210 for stopping movement of partially formed container 1010 through compression station 1210.

End panel plows 1266 and side panel plows 1262 define a plunger opening 1272 that extends from top ends of side panel plows 1262 and end panel plows 1266 to exit conveyor 1302 (FIG. 42). Plunger 1260 is configured to contact interior surface 12 of bottom panel 24, and push blank 10 into and through plunger opening 1272. In the example embodiment, plunger 1260 has a shape that corresponds to a cross sectional shape of container 150. More specifically, plunger 1260 corresponds to end walls 158 and 160 and side walls 154 and 156 of container 150. Plunger 1260 is open at corner walls 162, 164, 166, and 168. Alternatively, plunger 1260 may also include walls at corner walls 162, 164, 166, and/or 168.

In the example embodiment, plunger 1260 includes at least four upright plates 1274 and 1276 coupled to a vertical actuator 1278 (FIG. 37). More specifically, side wall upright plates 1274 extend substantially parallel to longitudinal axis 1012 (FIG. 21) and are oriented substantially vertically, and end wall upright plates 1276 are substantially perpendicular to side wall upright plates 1274 and longitudinal axis 1012 and are oriented substantially vertically. Upright plates 1274 and 1276 are configured to prevent over-rotation of side panels 22 and 26 and end panels 64 and 70 into cavity 170 (shown in FIG. 2) of container 150. Vertical actuator 1278, which is driven by drive system 1212, is configured to move plunger 1260 between a first position (shown in FIG. 36), also referred to as a raised position, and a second position (shown in FIG. 38), also referred to as a lowered position. Control system 1008 is in operational control communication with vertical actuator 1278 for controlling movement of plunger 1260 between the first position and the second position.

Referring to FIGS. 39 and 40, in the illustrated embodiment, compression station 1210 includes a first pair 1280 of side panel plows 1262 and a second pair 1282 of side panel plows 1262. First and second pairs 1280 and 1282 of side panel plows 1262 are positioned on opposite sides of plunger opening 1272. In the example embodiment, each side panel plow 1262 includes a substantially horizontal upper surface, a rounded inner surface, and a substantially vertical inner wall. The top surfaces and rounded inner surfaces are configured to rotate side panels 22 and/or 26 inwardly toward plunger opening 1272 and/or plunger 1260 when plunger 1260 pushes blank 10 through plunger opening 1272. The vertical inner walls extend into plunger opening 1272 to at least partially define plunger opening 1272, and the top surfaces are oriented generally perpendicular to the vertical inner walls. The rounded inner surfaces extend between and interconnect the vertical inner walls and the top surfaces.

Compression station 1210 also includes side wall presser assemblies 1268 configured to press at least a portion of reinforcing corner assemblies 151 against a respective side panel 22 or 26 to form side walls 154 and 156 of container 150. Each presser assembly 1268 is positioned alongside one of side panel plows 1262, and includes a presser plate 1284 and an actuator 1286. Presser plate 1284 is operatively coupled to actuator 1286, and actuator 1286 is configured to move presser plate 1284 towards and away from plunger opening 1272. Actuator 1286 moves presser plate 1284 from a first, outer position, to a second, inner position where presser plate 1284 contacts and/or presses one or more panels of reinforcing corner assembly 151 against a respective side panel 22 or 26. In the example embodiment, each presser plate 1284 is oriented substantially parallel a respective side panel 22 and 26 of blank 10 when the side panels 22 and 26 are rotated to be substantially perpendicular to bottom panel 24 of the blank 10. Also, in the example embodiment, actuator 1286 is configured to move presser plate 1284 in a direction substantially perpendicular to longitudinal axis 1012. Presser assemblies 1268 are configured to couple reinforcing corner assemblies 151 to respective side panels 22 or 26 by compressing a reinforcing corner assembly 151 and a respective side panel 22 or 26 against one of upright plates 1274 of plunger 1260. More specifically, each presser plate 1284 is configured to contact an exterior surface of one reinforcing corner assembly 151, and press an interior surface of the reinforcing corner assembly 151 against an exterior surface 14 of a respective side panel 22 or 26. In the example embodiment, presser plates 1284 are configured to contact exterior surface 14 of first reinforcing side panels 100, and press exterior surface 14 of second reinforcing side panels 104 against exterior surface 14 of a respective side panel 22 or 26.

As noted above, compression station 1210 includes a pair of end panel plow assemblies 1264 that each include a frame and a pair of end panel plows 1266 coupled thereto. In the illustrated embodiment, the end panel plow assemblies 1264 include a rear pair 1288 of end panel plows 1266 and a front pair 1290 of end panel plows 1266. Rear pair 1288 and front pair 1290 of end panel plows 1266 are positioned on opposite sides of plunger opening 1272. Each end panel plow 1266 is moveable with respect to machine 1000 and is configured to upwardly rotate an end panel 64 or 70 to be substantially perpendicular to bottom panel 24. More specifically, front pair 1290 is configured to fold a front end panel 64 or 70, and rear pair 1288 is configured to fold a rear end panel 70 or 64. Each end panel plow 1266 includes an angled inner surface and a vertical inner wall. As used with respect to end panel plows 1266 and side panel plows 1262, the term "inner" refers to a direction facing toward plunger opening 1272. The angled inner surfaces of end panel plows 1266 are configured to rotate end panels 64 and 70 inwardly toward plunger opening 1272. In the example embodiment, the vertical inner wall extends into plunger opening 1272 to at least partially define plunger opening 1272, and the inner angled surface extends from the vertical inner wall at an oblique angle and away from plunger opening 1272.

Side panel plows 1262 and end panel plows 1266 are configured to rotate reinforcing corner assemblies 151 into face-to-face relationship with an exterior surface 14 of a respective side panel 22 or 26. More specifically, side panel plows 1262 and end panel plows 1266 are positioned such that side panels 22 and 26 of blank 10 are rotated before end panels 64 and 70 such that reinforcing corner assemblies 151 extending from end panels 64 and 70 are positioned in face-to-face relationship with exterior surface 14 of side panels 22 and 26 when the end panels 64 and 70 are oriented substantially perpendicular to bottom panel 24. In the illustrated embodiment, for example, each side panel plow 1262 is positioned vertically closer to plunger 1260 (e.g., when plunger 1260 is in the first position) than end panel plows 1266 such that side panels 22 and 26 are contacted and rotated by side panel plows 1262 before end panels 64 and 70 are contacted and rotated by end panel plows 1266 when plunger 1260 pushes blank 10 through plunger opening 1272.

In the example embodiment, each end panel plow 1266 and each side panel plow 1262 is configured to rotate and/or move inwardly toward plunger opening 1272 and outwardly away from plunger opening 1272. As such, each end panel plow 1266 and each side panel plow 1262 moves between a first position, also referred to as an outer position, and a second position, also referred to as a forming position. In other suitable embodiments, one or more of end panel plows 1266 and side panel plows 1262 may be stationary plows (i.e., not movable). Control system 1008 is in operational control communication with each end panel plow 1266 and each side panel plow 1262 for controlling rotation and/or movement between the outer position and the forming position. In the example embodiment, a sensor determines when partially formed container 1010 is positioned over plunger opening 1272. End panel plows 1266 and side panel plows 1262 are moved to the forming position when the sensor determines partially formed container 1010 is positioned over and/or within plunger opening 1272. End panel plows 1266 and side panel plows 1262 are moved to the outer position after plunger 1260 is at least partially retracted from plunger opening 1272. As such, container 150 is secured within plunger opening 1272 by end panel plows 1266 and side panel plows 1262 in the forming position, and container 150 is released from plunger opening 1272 onto exit conveyor 1302 when end panel plows 1266 and side panel plows 1262 are in the outer position.

Although the example embodiment is described as having four side panel plows 1262 and four end panel plows 1266, it should be understood that machine 1000 may include any suitable number of side panel plows 1262 and any suitable number of end panel plows 1266 that enables machine 1000 to function as described herein.

Referring to FIG. 42, exit conveyor 1302 extends past a bottom 1273 of compression station 1210 to receive containers 150 from forming station 1200. More specifically, exit conveyor 1302 continuously runs while machine 1000 is being operated to form containers 150. Alternatively, exit conveyor 1302 is operated intermittently when a container 150 is positioned within bottom 1273 of compression station 1210. In the example embodiment, container 150 is secured within plunger opening 1272 by side panel plows 1262, end panel plows 1266, and/or side wall presser assemblies 1268 over exit conveyor 1302. As such, when side panel plows 1262, end panel plows 1266, and/or side wall presser assemblies 1268 are moved to outer positions, container 150 is released from plunger opening 1272 onto exit conveyor 1302. Control system 1008 is in operational control communication with exit conveyor 1302 for control thereof. Top panels 20 and 28 remain unfolded with respect to a respective side panel 22 or 26, and container 150 is ejected from machine 1000 in the open configuration.

During operation of machine 1000, a method for forming a container 150 from blank 10 is performed. It should be understood that the method may be used to form any suitable container, such as containers 250, 350, 450, 550, 650, 750, 850 and/or 950 (shown in FIGS. 4, 6, 8, 10, 13, 15, 17 and 19), using machine 1000. In the example embodiment, the method is performed by control system 1008 sending commands and/or instructions to components of machine 1000. The processor within control system 1008 is programmed with code segments configured to perform the method. Alternatively, the method is encoded on a computer-readable medium that is readable by control system 1008. In such an embodiment, control system 1008 and/or the processor are configured to read computer-readable medium for performing the method.

Referring to FIGS. 20-42, drive system 1212 includes a motor, gears, a chain and sprockets that cause much of transport system 1050 to move. For example, drive system 1212 causes transfer arm 1106 to rotate to a position where upper suction device 1108 comes into contact with a first blank 10 stored within hopper 1102. First blank 10 being the most downstream blank housed within hopper 1102. More specifically, upper suction device 1108 comes into contact with interior surface 12 of first blank 10 such that upper suction device 1108 becomes releasably coupled to first blank 10. Transfer arm 1106, still being driven by drive system 1212, rotates with blank 10 coupled thereto such that blank 10 is placed in a substantially horizontal position with exterior surface 14 of blank 10 facing downwardly toward support rails 1224. Thus, transfer arm 1106 moves blank 10 from hopper 1102 to initial forming station 1202.

While transfer arm 1106 moves blank 10 into a substantially horizontal position within initial forming station 1202, lower suction device 1214 moves upwardly from below support rails 1224 to engage exterior surface 14 of blank 10. Thus, blank 10 is essentially transferred with a "handshake" from upper suction device 1108 to lower suction device 1214. Lower suction device 1214 then pulls blank 10 downwardly onto support rails 1224. As blank 10 is placed on support rails 1224, stationary folding plows 1218 and moveable folding plows 1220 engage inner reinforcing panel assemblies 90 and/or inner end panels 92 at each corner of blank 10, causing each inner reinforcing panel assembly 90 and each inner end panel 92 to rotate about 90 degrees with respect to outer reinforcing panel assembly 88 such that each inner reinforcing panel assembly 90 and each inner end panel 92 is substantially perpendicular to bottom panel 24 of blank 10. Feed mechanism 1104 pushes stack 1006 forward to position the next blank 10 to be removed from hopper 1102 by transfer arm 1106.

Blank 10 is moved from initial forming station 1202 to secondary forming station 1206 through first adhesive application station 1204. More specifically, blank 10 is transported forward into secondary forming station 1206 using pusher plate 1216 and/or drive rollers 1228. For example, pusher plate 1216 is moved in a substantially horizontal direction from a rear position to a forward position and blank 10 is slid forward into secondary forming station 1206 along support rails 1224. Moveable folding plows 1220 follow the motion of blank 10 to retain the position of rear inner reinforcing panel assemblies 90 and rear inner end panels 92. As blank 10 is transported forward, rear inner reinforcing panel assemblies 90 and rear inner end panels 92 are transferred from moveable folding plows 1220 to stationary folding plows 1218 to retain the position of inner reinforcing panel assemblies 90 and inner end panels 92.

In embodiments including rotatable guide rails 1227 (shown in FIG. 27), rotatable guide rails 1227 are initially positioned in the first position such that side panels 22 and 26 and/or top panels 20 and 28 may be received between folding plows 1218 and 1220 as blank 10 is pulled downwardly onto support rails 1224 by lower suction device 1214. Prior to or concurrently with blank 10 being moved from initial forming station 1202 to secondary forming station 1206, rotatable guide rails 1227 are rotated approximately 90 degrees to the second position to retain the position of rear inner reinforcing panel assemblies 90 and rear inner end panels 92 as blank 10 is transported forward. Rear inner reinforcing panel assemblies 90 and rear inner end panels 92 are transferred from rotatable guide rails 1227 to the downstream stationary folding plows 1218 as blank 10 is transported forward to retain the position of inner reinforcing panel assemblies 90 and inner end panels 92.

Drive rollers 1228 contact a leading end panel 64 or 70 and/or bottom panel 24 as blank 10 is transferred from initial forming station 1202 to first adhesive application station 1204. Once drive rollers 1228 engage blank 10, pusher plate 1216 retracts to the rear position.

As blank 10 is transported through first adhesive application station 1204, adhesive is applied to interior surface 12 of corner panels 98, first reinforcing side panels 100, and/or end panels 64 and/or 70 using first adhesive applicator 1230. More specifically, sensors within first adhesive application station 1204 detect a position of blank 10 with respect to first adhesive applicator 1230 to control first adhesive applicator 1230 to properly apply the adhesive. As the trailing top edge 68 or 74 of blank 10 exits first adhesive application station 1204, push lug 1232 engages trailing top edge 68 or 74 to move blank 10 through secondary forming station 1206. More specifically, using sensors and/or other devices, control system 1008 controls servo drive 1236 to position push lug 1232 adjacent trailing top edge 68 or 74. Servo drive 1236 then controls movement of blank 10 through secondary forming station 1206 using push lug 1232. In the example embodiment, push lug 1232 moves blank 10 through secondary forming station 1206 until leading top edge 74 or 68 is adjacent to, or in contact with, stop lug 1234. Push lug 1232 and stop lug 1234 are configured to properly position blank 10 within secondary forming station 1206.

In embodiments including pusher arm 1247 (shown in FIGS. 32 and 33), the leading top edge 74 or 68 of blank 10 engages rotatable plate 1253 as blank 10 exits first adhesive application station 1204, and rotates rotatable plate 1253 in the downstream direction. Rotatable plate 1253 returns to its original vertical position once blank 10 has passed downstream of rotatable plate 1253. Pusher arm 1247 moves from the first position (shown in FIG. 32) to the second position (shown in FIG. 33) to engage the trailing top edge 68 or 74 of blank 10 with rotatable plate 1253, and to position blank 10 within secondary forming station 1206.

Within secondary forming station 1206, reinforcing corner assemblies 151 are formed using male forming member 1242 and female forming member 1244. More specifically, in the example embodiment, folder arm 1240 rotates from the starting position to the folding position to fold interior surface 12 of inner reinforcing panel assemblies 90 into face-to-face relationship with interior surface 12 of a respective outer reinforcing panel assembly 88. When folder arms 1240 are at the folding position, inner reinforcing panel assemblies 90 are not in contact with outer reinforcing panel assemblies 88; however, in some embodiments, inner reinforcing panel assemblies 90 can be rotated into contact with outer reinforcing panel assemblies 88 by folder arms 1240. In the example embodiment, as inner reinforcing panel assemblies 90 are rotated by folder arms 1240, inner end panels 92 and reinforcing corner panels 102 are slightly rotated about fold lines 96 and/or 114 by coming into contact with male forming member 1242. As such, folder arms 1240 and male forming members 1242 pre-break inner reinforcing panel assemblies 90 and inner end panels 92 along fold lines 114 and 96, respectively. Once inner reinforcing panel assemblies 90 are positioned with respect to outer reinforcing panel assemblies 88 and inner end panels 92 are positioned with respect to end panels 64 and/or 70, folder arms 1240 retract to the starting position.

When folder arms 1240 have retracted, male forming members 1242 move downward toward blank 10 and female forming members 1244 move upward toward blank 10. Male forming members 1242 contact the inner, or upper, surface of blank 10 and female forming members 1244 contact the outer, or lower, surface of blank 10. When male and female forming members 1242 and 1244 compress toward each other with blank 10 therebetween, corner panels 98 and 102 are rotated about fold lines 96 and 78, 80, 82, or 84 and reinforcing side panels 100 and 104 are rotated about fold lines 112 and 114. Further, when male and female forming members 1242 and 1244 move together, at least inner end panel 92 is adhered to a respective end panel 64 and 70. Alternatively or additionally, reinforcing side panels 100 and 104 are adhered together and/or corner panels 98 and 102 are adhered together by male and female forming members 1242 and 1244. When reinforcing corner assemblies 151 are formed by male and female forming members 1242 and 1244, partially formed container 1010 is formed from blank 10. Male forming members 1242 move upward and female forming members 1244 move downward to release partially formed container 1010. As partially formed container 1010 is released, inner side rails 1246 contact first reinforcing side panel 100 to maintain a position of reinforcing corner assembly 151 with respect to the remainder of blank 10.

Stop lug 1234 moves out of the path of partially formed container 1010, and push lug 1232 or slide mechanism 1249 (shown in FIG. 32) moves partially formed container 1010 into compression station 1210 through angling station 1207 and second adhesive application station 1208. As partially formed container 1010 is moved through angling station 1207, reinforcing side panels 100 and 104 are rotated to be at an obtuse angle to end panel 64 and/or 70 by guide bars 1248 and miter plates 1250. While partially formed container 1010 is transported through angling station 1207 and second adhesive application station 1208, second adhesive applicator 1252 applies adhesive to second reinforcing side panels 104, as described above. Pusher arm 1254 engages trailing top edge 68 or 74 of blank 10 to move partially formed container 1010 into compression station 1210 and over plunger opening 1272.

Pusher arm 1254 positions partially formed container 1010 between plunger 1260 and plunger opening 1272, and plunger 1260 moves downward from the upper position toward the lower position to contact interior surface 12 of bottom panel 24 using vertical actuator 1278. Plunger 1260 pushes bottom panel 24 into and through plunger opening 1272. Side panel plows 1262 and end panel plows 1266 are in the forming position as partially formed container 1010 is pushed through plunger opening 1272. As partially formed container 1010 is pushed through plunger opening 1272, side panel plows 1262 contact side panels 22 and 26, and rotate side panels 22 and 26 toward interior surface 12 of bottom panel 24 to be substantially perpendicular to bottom panel 24. After or as side panels 22 and 26 are rotated, end panel plows 1266 contact end panels 64 and 70, and rotate end panels 64 and 70 toward interior surface 12 of bottom panel 24 to be substantially perpendicular to bottom panel 24. In the example embodiment, the relative position of side panel plows 1262 and end panel plows 1266 causes side panels 22 and 26 to be rotated before end panels 64 and 70 are rotated. As end panels 64 and 70 are rotated, reinforcing corner assemblies 151 are also rotated into face-to-face relationship with a respective side panel 22 or 26. More specifically, an interior surface of each reinforcing corner assembly 151 is rotated into face-to-face relationship with an exterior surface 14 of a respective side panel 22 or 26.

After end panels 64 and 70 are rotated to be substantially perpendicular to bottom panel 24, and reinforcing corner assemblies 151 are positioned in face-to-face relationship with a respective side panel 22 or 26, side wall presser assemblies 1268 are actuated to press reinforcing corner assemblies 151 against a respective side panel 22 or 26. More specifically, actuator 1286 moves presser plate 1284 towards plunger opening 1272 and into contact with exterior surface 14 of first reinforcing side panel 100. Presser plate 1284 presses exterior surface 14 of second reinforcing side panel 104 against exterior surface 14 of a respective side panel 22 or 26, either or both of which have adhesive applied thereto, to couple reinforcing corner assembly 151 to a respective side panel 22 or 26. Presser assemblies 1268 are thus configured to press an interior surface of reinforcing corner assemblies 151 against an exterior surface 14 of a respective side panel 22 or 26 to secure reinforcing corner assemblies 151 to a respective side panel 22 or 26, and thereby form side walls 154 and 156. In the example embodiment, adhesive is applied by second adhesive applicator 1252 to an interior surface of reinforcing corner assemblies 151. More specifically, adhesive is applied to exterior surface 14 of second reinforcing side panels 104. Additionally or alternatively, adhesive is applied to exterior surface 14 of side panels 22 and 26.

Container 150 is then formed from blank 10. At any suitable time during formation of container 150 from blank 10, a second blank 10 may be removed from hopper 1102 to form a second container 150. As such, the method may be performed to continuously form containers 150 using machine 1000. After container 150 is formed, side panel plows 1262, end panel plows 1266, and/or sidewall presser assemblies 1268 secure container 150 within plunger opening 1272. Plunger 1260 retracts upwardly out of cavity 170 of container 150 to the upper position, and side panel plows 1262, end panel plows 1266, and/or sidewall presser assemblies 1268 move to outer positions to release container 150 from plunger opening 1272. In the example embodiment, container 150 then falls downward to exit conveyor 1302. Exit conveyor 1302 transports container 150 from plunger opening 1272 and/or forming station 1200. More specifically, exit conveyor 1302 extends from ejection station 1300 past the bottom of compression station 1210 for receiving container 150 from plunger 1260 and transferring container 150 from forming station 1200 to ejection station 1300. When machine 1000 forms a container having top panels, the container is ejected from machine 1000 without the top panels rotated into position such that the container is configured to have a product placed therein. Container 150 can then be filled with a product and transported to a machine that folds top panels 20 and 28 and secures container 150 in the closed position. The machine can also tape container 150 in the closed position.

The above-described blanks and containers provide a reinforcing polygonal container. More specifically, the embodiments described herein provide an octagonal container having reinforced corner walls, side walls, and end walls for storing and/or transporting a product therein. Further, the embodiments described herein provide a polygonal container having a top wall. More specifically, the top wall may be formed from top panels emanating from the side walls of the container or the end walls of the container. The top wall may be a full top wall covering substantially the entire cavity of the container or may be a partial top wall, such as top shoulders, that allows access to the cavity of the container when the top wall is formed. Additionally, the blanks and containers described herein may include a support wall for additional support of the container when, for example, the containers are stacked. The support wall may also act as a partition or divider for the cavity of the container.

Moreover, the blanks and containers described herein include reinforcing panel assemblies and reinforcing corner assemblies that are secured to an exterior surface of the containers such that the interior surface of the containers are substantially planar. As a result, the blanks and containers described herein are better suited for transporting products that can be easily damaged during storage or transport, such as fresh fruit or produce.

The machine described herein facilitates forming containers from the above-described blanks. More specifically, the machine more quickly and easily forms the containers, as compared to a person manually forming the containers from the blanks. As such, the machine facilitates producing many containers in a shorter time period, as compared to manual construction of the containers. Further, the above-described machine facilitates automating the method for forming a container from a blank such that cost and time for producing a container is reduced as compared to manually forming the containers. Further, the above-described machine facilitates securing the reinforcing corner assemblies of the blanks to an exterior surface of the container such that the interior surface of the containers are substantially planar.

Example embodiments of blanks, containers formed therefrom, and a machine for forming the containers from the blanks are described above in detail. The blanks, container, and machine are not limited to the specific embodiments described herein, but rather, components of the blanks, containers, and/or machine may be utilized independently and separately from other components described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for forming a polygonal container from a blank of sheet material, the polygonal container including at least five sides, the blank including a bottom panel, two opposing side panels each extending from a side edge of the bottom panel, two opposing end panels each extending from an end edge of the bottom panel, and a reinforcing panel assembly extending from a first side edge of a first end panel of the two end panels, wherein the reinforcing panel assembly includes a corner panel extending from the first side edge of the first end panel, a first reinforcing side panel extending from a side edge of the corner panel, a second reinforcing side panel extending from a side edge of the first reinforcing side panel, a reinforcing corner panel extending from a side edge of the second reinforcing side panel, and an inner end panel extending from a side edge of the reinforcing corner panel, said method comprising:

rotating the second reinforcing side panel toward an interior surface of the first reinforcing side panel about a fold line connecting the second reinforcing side panel and the first reinforcing side panel, said rotating aligning the first and second reinforcing side panels in a substantially face-to-face relationship, the corner panel and the reinforcing corner panel in a substantially face-to-face relationship, and the inner end panel and the first end panel in a substantially face-to-face relationship;

rotating the first side panel inwardly into a substantially perpendicular relationship with the bottom panel;

rotating the first end panel inwardly into a substantially perpendicular relationship with the bottom panel, the first end panel and inner end panel forming a first end wall of the polygonal container;

rotating the corner panel and the reinforcing corner panel toward the interior surface of the first end panel, the corner panel and the reinforcing corner panel forming a first corner wall of the polygonal container;

rotating the first and second reinforcing side panels toward the interior surface of the first end panel about a fold line connecting the second reinforcing side panel and the reinforcing corner panel and about a fold line connecting the first reinforcing side panel and the corner panel; and attaching the first side panel to one of the first and second reinforcing side panels to form a first side wall of the container;

wherein the corner panel and reinforcing corner panel are at an oblique angle with respect to the first end panel;

wherein the corner panel has a first height, and the reinforcing corner panel has a second height that is less than the first height;

wherein the reinforcing corner panel includes opposing top and bottom edges, and the difference between the first height and the second height is substantially equal to a thickness of the bottom panel, said method further comprising positioning the bottom edge of the reinforcing corner panel to rest against an interior surface of the bottom panel and positioning the corner panel to rest against an outer edge of the bottom panel.

2. A method in accordance with claim 1, wherein attaching the first side panel to one of the first and second reinforcing side panels comprises attaching an exterior surface of the second reinforcing side panel to an exterior surface of the first side panel.

3. A method in accordance with claim 1, wherein the blank includes an inner reinforcing corner panel extending from a side edge of the first side panel, said method further comprising attaching an exterior surface of the inner reinforcing corner panel to an interior surface of the reinforcing corner panel, wherein the reinforcing corner panel, the corner panel, and the inner reinforcing corner panel form the first corner wall.

* * * * *